US008783661B1

(12) United States Patent
Payne

(10) Patent No.: US 8,783,661 B1
(45) **Date of Patent: *Jul. 22, 2014**

(54) FENCE SYSTEM

(75) Inventor: John F. Payne, Ennis, TX (US)

(73) Assignee: Betafence USA LLC, Ennis, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/969,785

(22) Filed: Dec. 16, 2010

Related U.S. Application Data

(60) Division of application No. 12/024,102, filed on Jan. 31, 2008, now Pat. No. 7,866,635, which is a continuation-in-part of application No. 11/669,601, filed on Jan. 31, 2007, which is a continuation-in-part of application No. 11/110,579, filed on Apr. 19, 2005, now Pat. No. 7,628,386.

(60) Provisional application No. 60/763,851, filed on Jan. 31, 2006, provisional application No. 60/642,079, filed on Jan. 7, 2005.

(51) Int. Cl.
*E04H 17/02* (2006.01)

(52) U.S. Cl.
USPC ..... 256/49; 256/24; 256/33; 256/54; 256/73

(58) Field of Classification Search
USPC ..... 256/24, 25, 33, 47, 49, 52, 54, 73, 256/DIG. 3
See application file for complete search history.

(56) References Cited

U.S. PATENT DOCUMENTS

| | | | | |
|---|---|---|---|---|
| 424,936 | A | 4/1890 | Schoenfeld | |
| 465,509 | A | 12/1891 | Woelfel | |
| 715,927 | A | 12/1902 | Youngblood | |
| 1,204,126 | A | 11/1916 | Butzer | |
| 1,714,388 | A | 5/1929 | McBride | |
| 1,818,522 | A | 8/1931 | Youngblood | |
| 2,032,693 | A | 3/1936 | Fries et al. | |
| 2,723,107 | A * | 11/1955 | Parker | 256/24 |
| 3,140,858 | A | 7/1964 | Westphal | |
| 3,193,255 | A | 7/1965 | Burdett | |
| 3,323,530 | A | 6/1967 | Smith | |
| 3,604,686 | A | 9/1971 | Parisien | |
| 3,734,467 | A | 5/1973 | Weeden | |
| 3,770,245 | A | 11/1973 | Murdock | |
| 3,881,699 | A | 5/1975 | Nusbaum | |
| 4,098,493 | A | 7/1978 | Logan | |
| 4,255,913 | A | 3/1981 | Poma | |
| 4,266,757 | A | 5/1981 | Kirkwood | |
| 4,899,991 | A * | 2/1990 | Brunkan | 256/69 |

(Continued)

FOREIGN PATENT DOCUMENTS

| | | | |
|---|---|---|---|
| CA | 2130051 | A1 | 2/1996 |
| FR | 2785635 | A1 | 5/2000 |
| WO | 9611317 | A1 | 4/1996 |

*Primary Examiner* — Victor MacArthur
(74) *Attorney, Agent, or Firm* — Jack D. Stone, Jr.; Scheef & Stone, L.L.P.

(57) ABSTRACT

A fence system, and method for making same, includes at least one support member, and at least one infill material having an edge. At least one union strip is coupled to the at least one support member, the at least one union strip including at least one channel configured for receiving the edge of the at least one infill material. In one embodiment of the invention, the at least one channel is U-shaped, and the edge is configured in a U-shape for matingly engaging the at least one U-shaped channel.

15 Claims, 45 Drawing Sheets

(56) References Cited

U.S. PATENT DOCUMENTS

| | | | | | |
|---|---|---|---|---|---|
| 5,007,587 | A | | 4/1991 | Daroca | |
| 5,015,119 | A | | 5/1991 | Schmanski | |
| 5,036,799 | A | | 8/1991 | Jordan et al. | |
| 5,078,367 | A | * | 1/1992 | Simpson et al. | 256/24 |
| 5,141,207 | A | | 8/1992 | Meglino et al. | |
| 5,275,382 | A | | 1/1994 | Charbaut | |
| 5,341,610 | A | | 8/1994 | Moss | |
| 5,388,663 | A | * | 2/1995 | Phillippe et al. | 182/82 |
| 5,421,557 | A | | 6/1995 | Vise | |
| 5,436,811 | A | * | 7/1995 | Hecking | 362/152 |
| 5,480,126 | A | | 1/1996 | Teasdale | |
| 5,542,649 | A | | 8/1996 | Allegaert et al. | |
| 5,556,080 | A | | 9/1996 | Vise | |
| 5,676,351 | A | | 10/1997 | Speece et al. | |
| 5,730,426 | A | | 3/1998 | Tu | |
| 5,794,990 | A | | 8/1998 | Coppedge | |
| 6,020,116 | A | | 2/2000 | Camp et al. | |
| 6,138,993 | A | * | 10/2000 | Mitchell et al. | 256/25 |
| 6,217,007 | B1 | | 4/2001 | Grayson, II | |
| 6,557,666 | B1 | | 5/2003 | Drouin | |
| 6,581,914 | B2 | | 6/2003 | Sotillos | |
| 2003/0209701 | A1 | | 11/2003 | Goddard | |
| 2006/0226406 | A1 | | 10/2006 | Vise | |
| 2007/0272909 | A1 | | 11/2007 | Payne | |

* cited by examiner 102
110
2300
2400
2402
1702
1704
2600
2602
2604
2702
2900
2902
2904
2906
3002
24
25
27
28
30
31

102
110
3200
3202
3204
3206
3302
3500
3502
3504
3506
3800
3802
3803
3804
3806

110
3802
4100
4102
4104
4106
4202
4400
4402
4404
4406
4502
4700
4702
4704
4802
1702
1704

3802
5000
110
52
52
51
51

3802
5000
5100
5100
5102
5102
110

3802
5000
5100
5102
5102

5300
5302
5304
5306
5306
5308

5400

5500

5600

5700

5800

5900

6000

FENCE SYSTEM

CLAIM OF PRIORITY

This application is a divisional patent application of application Ser. No. 12/024,102, filed Jan. 31, 2008, which is a continuation-in-part of application Ser. No. 11/669,601, filed Jan. 31, 2007, which is a continuation-in-part of application Ser. No. 11/110,579, filed Apr. 19, 2005, now U.S. Pat. No. 7,628,386, issued Dec. 8, 2009, which claims the benefit of provisional Application No. 60/642,079, filed Jan. 7, 2005, which application Ser. No. 11/669,601 further claims the benefit of U.S. Provisional Application No. 60/763,851, filed Jan. 31, 2006, all of which applications are incorporated by reference herein in their entirety.

TECHNICAL FIELD

The invention relates generally to fences and, more particularly, to fences adapted to architectural applications, trellises, and/or to provide high security.

BACKGROUND

Fences are well known in the art for providing security to property. Typically, a fence includes a series of posts set in ground, cement, a concrete slab, or the like, with a fencing infill material spanning between or across the posts. A common type of fencing infill material is chain link. A chain link fence, however, is easy to breach with wire cutters. For example, if one wire of a chain link fence is cut, the integrity of the whole fence is compromised, since chain link is a continuous piece of fabric. It may be appreciated that cutting a wire of chain link fence is analogous to cutting a link of chain, wherein the tension on the complete fence or chain is lost. Once the wire is cut, an opening in the fence may then be readily formed through which a person may readily pass with appropriated goods.

Fencing infill material that is heavier and less susceptible to the aforementioned drawbacks of chain link, such as heavy gauge wire mesh, is also available. However, such heavier fencing material is only manufactured in standard widths, and thus requires that fence posts be spaced apart at very precise intervals, to match the width of the fencing material, so that the heavier fencing material will properly span between the posts. This problem is particularly acute when one fencing material (e.g., chain link) that has been hung between posts spaced at certain intervals is to be replaced with fencing infill material (e.g., heavy gauge wire mesh) that requires different and more precise post spacing intervals. In such cases, the old posts, which are typically embedded in cement or a concrete slab, must be removed and new posts must be installed (requiring core drilling in concrete slabs) at precise spacing intervals. Once new posts are set at proper spacing intervals, fencing material must be manufactured into panels by putting a frame, such as angle iron, around them. The fabricated panels are preferably also galvanized to prevent rust. The fabricated panels of fencing infill material are then installed individually between the posts.

Another fencing infill material that has been used to construct fences which are less susceptible to the aforementioned drawbacks of chain link is expanded metal, as exemplified by U.S. Pat. Nos. 5,421,557 and 5,556,080 to Vise. However, in addition to the many of the drawbacks mentioned above, expanded metal typically includes sharp edges which is prone to cut people, thereby creating a potential liability for users of expanded metal. Because expanded metal must be overlapped at joints, as indicated in the Vise patents, the potential for there to be sharp edges which could cut people, and thus increase potential liability, is increased even further.

Therefore, what is needed is a system and method for incorporating any standard sheeted fencing (infill) material into a secure fence with posts spaced apart by non-standard intervals. Such system and method should, among other things, accommodate posts of virtually any size, cross-section, and spacing. Still further, such system and method should preferably be easy to install, not require fabrication of a frame for panels of fencing material, and therefore, no post-fabrication galvanization, and should preferably also be aesthetically appealing and not have sharp edges which are prone to cut people.

SUMMARY

The present invention, accordingly, provides a fence having at least one support member, and at least one infill material having an edge. At least one union strip is coupled to the at least one support member, the at least one union strip including at least one channel configured for receiving the edge of the at least one infill material.

In one embodiment of the invention, the at least one channel is U-shaped, and the edge is configured in a U-shape for matingly engaging the at least one U-shaped channel.

In another embodiment of the invention, two or more vertically-spaced rails extend substantially horizontally across the at least one support member, and two or more horizontally-spaced union strips extend substantially vertically across the rails. An edge of sheeted infill material is positioned within one channel of the at least one channel of each of two of the two or more union strips, so that the sheeted infill material extends between union strips, to thereby form a fence system.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
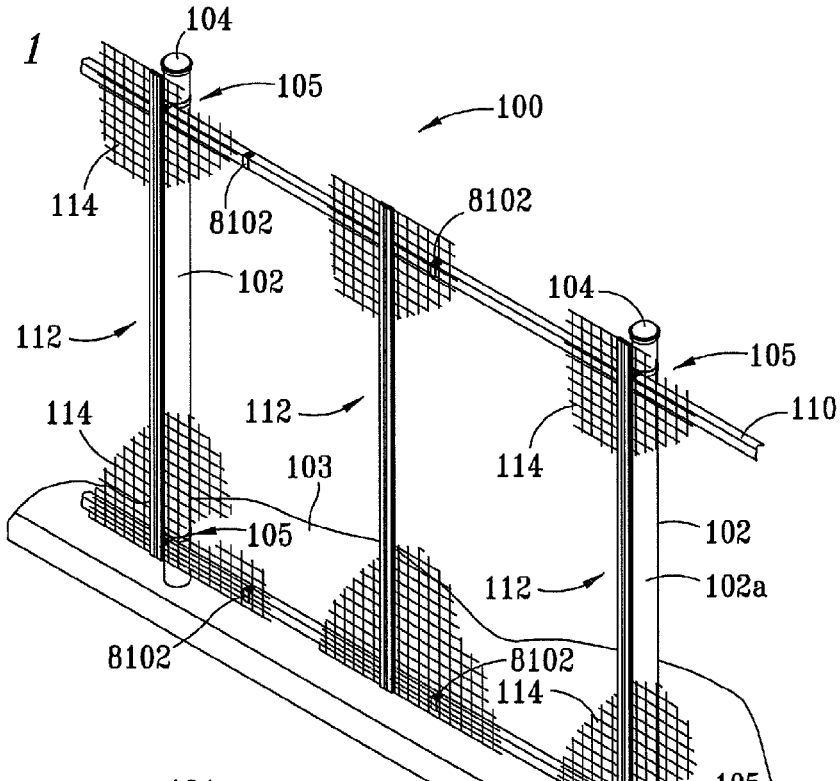
FIG. 1 presents a perspective view of a portion of one preferred embodiment of a fence system embodying features of the present invention.

Refer now to the drawings wherein depicted elements are, for the sake of clarity, not necessarily shown to scale, and wherein like or similar elements may be designated by the same reference numeral through several views.

Referring to FIG. 1 of the drawings, the reference numeral 100 generally designates a fence system embodying features of the present invention. The fence system 100 preferably includes a number of support members, such as posts 102 (two of which are shown in FIG. 1), each of which posts preferably include a conventional cap 104 positioned at the top of each respective post. The posts 102 may be of any desired length (e.g., four, eight, or twenty feet), of any desired cross-section (e.g., round, square, elliptical, I-beam, angle iron, and the like), of any desired material (e.g., wood, steel, and the like) and set substantially vertically in cement, a concrete slab, or the like, 103 in any conventional manner as desired. As described in further detail below, in a preferred embodiment of the invention, at least one substantially horizontal rail 110 extends across and is attached to a longitudinal surface 102*a* of each of at least two of the posts 102, at least two substantially vertical union strips 112 are attached to the at least one rail 110, and infill material 114 is retained by the union strips 112. Infill material 114 is preferably further retained to the rails 110 by clips, exemplified by clips 8102, such clips being described in further detail below with respect to FIGS. 71-88. The infill material 114 may comprise any material effective for running between union strips 112, such as, by way of example and not limitation, wire mesh, woven wire mesh, welded wire mesh, expanded metal mesh, perforated panel, steel grate panel, solid sheets of steel, stainless steel, aluminum, plastic, multi-ply ballistic fiberglass laminate produced from ballistic fiberglass impregnated with a thermo set polyester resin binder, and the like.

Figure 2:
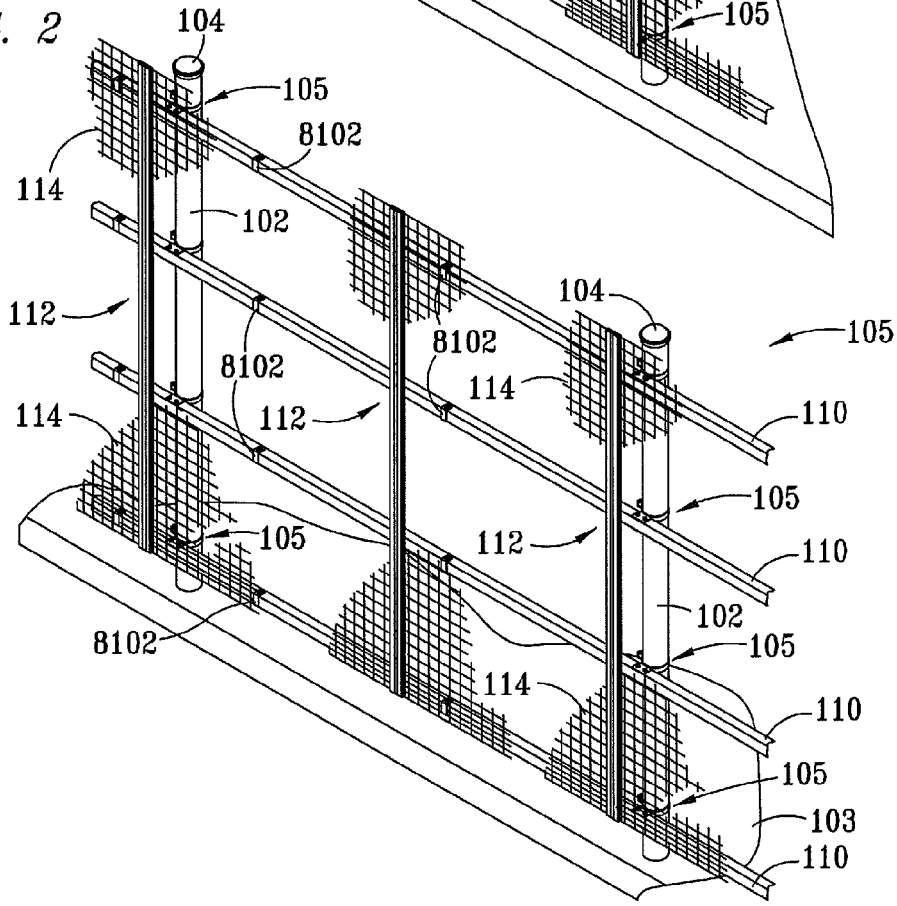
FIG. 2 presents a perspective view of one alternative embodiment of the fence of FIG. 1.

As exemplified by FIG. 2, the fence system 100 may comprise four, or any number of, rails 110, and there is no necessity for the union strips 112 to be aligned with the posts 102. That the union strips 112 may be aligned or offset from the posts 102 of FIGS. 1 and 2 is further depicted by FIGS. 3 and 4, respectively.

Each rail 110 is preferably secured to each of two or more posts 102 via a rail hanger 105. As shown more clearly in FIGS. 3 and 4, each rail hanger preferably comprises a conventional clamp 106 attached to a post 102, to which clamp a bracket 108 is attached (e.g., welded). The rail 110 is secured to each bracket 108 via conventional fasteners, such as screws, bolts and nuts, and/or the like.

Figure 3:
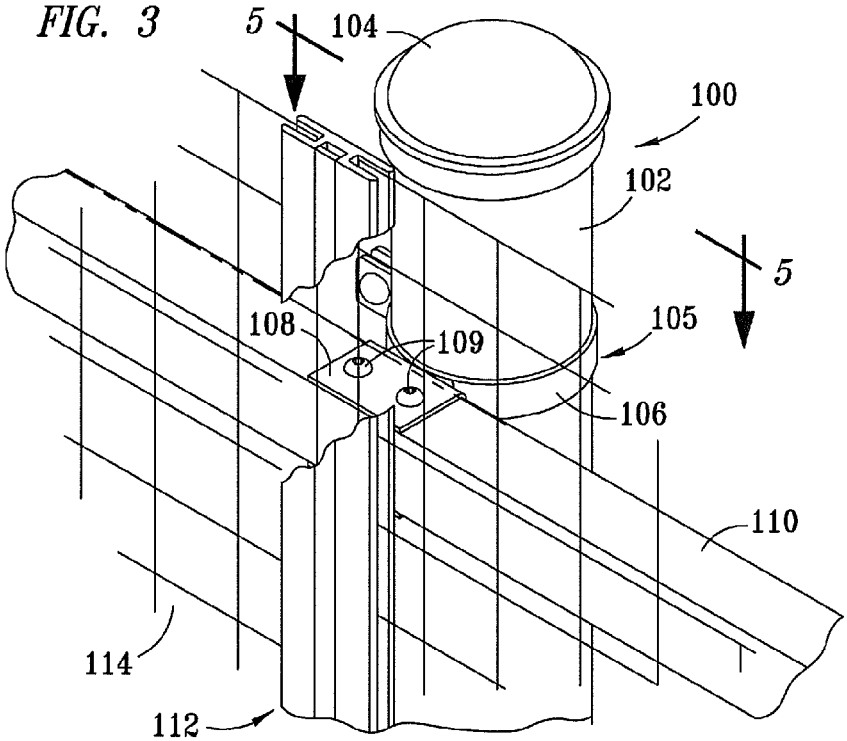
FIG. 3 presents a perspective view of a portion of the fence of FIG. 1.
Figure 4:
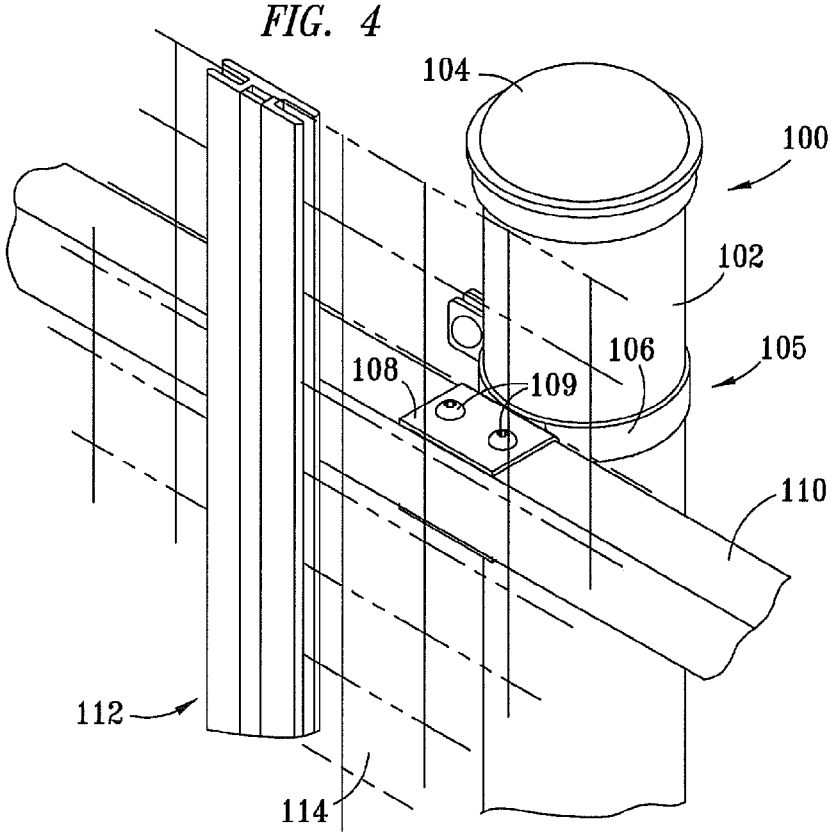
FIG. 4 presents a perspective view of a portion of the fence of FIG. 2 having an offset channel.
Figure 5:
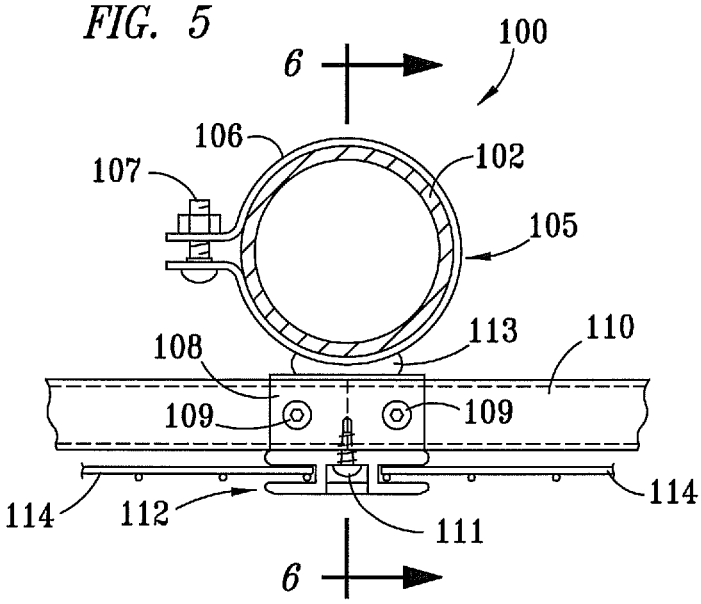
FIG. 5 presents a plan cross-sectional view of the portion of the fence of FIG. 1 taken along the line 5-5 of FIG. 3.

FIG. 5 is a plan cross-sectional view of the portion of the fence of FIG. 1 taken along the line 5-5 of FIG. 3. As shown therein, the rail hanger 105 preferably includes a clamp 106, and a bolt and nut 107 to tighten the clamp 106 about the post 102. The bracket 108 is preferably welded at a weld joint 113 to the clamp 106, and the rail 110 is secured to the bracket 108 preferably via four fasteners 109 (two of which are shown in each of FIGS. 3-5, and two of which are preferably utilized on the opposing side of the bracket 108, as shown more clearly in FIG. 6), although more or less than four fasteners may be utilized, such fasteners including, by way of example, but not limitation, self-tapping screws, screws with break-away nuts, rivets, and/or the like. As discussed in further detail below, the union strip 112 is preferably secured to each rail 110 via at least one fastener 111 such as, by way of example, self-tapping screws, screws with break-away nuts (FIG. 17), rivets, and/or the like.

Figure 6:
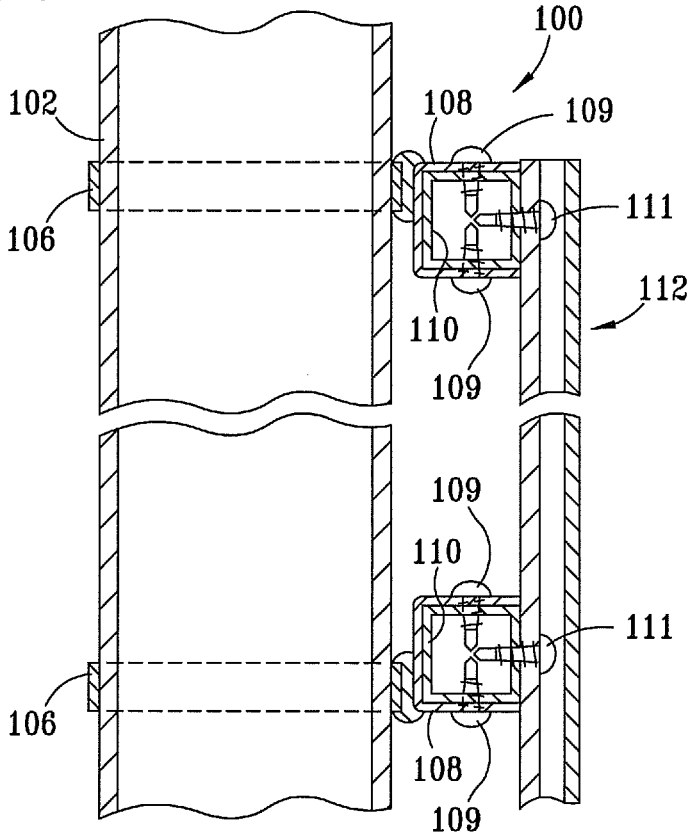
FIG. 6 presents a cross-sectional elevation view of the fence portion of FIG. 1 taken along the line 6-6 of FIG. 5.

FIG. 6 presents a cross-sectional elevation view of the fence portion of FIG. 1 taken along the line 6-6 of FIG. 5. As shown therein, the clamp 106 of each rail hanger 105 is vertically offset from its respective bracket 108, to thereby allow two rail hangers 105 to be complementarily secured to a post 102 for supporting two rails at the same height (e.g., at a corner of a fence), as exemplified and discussed in further detail below with respect to FIGS. 8 and 9.

Figure 7:
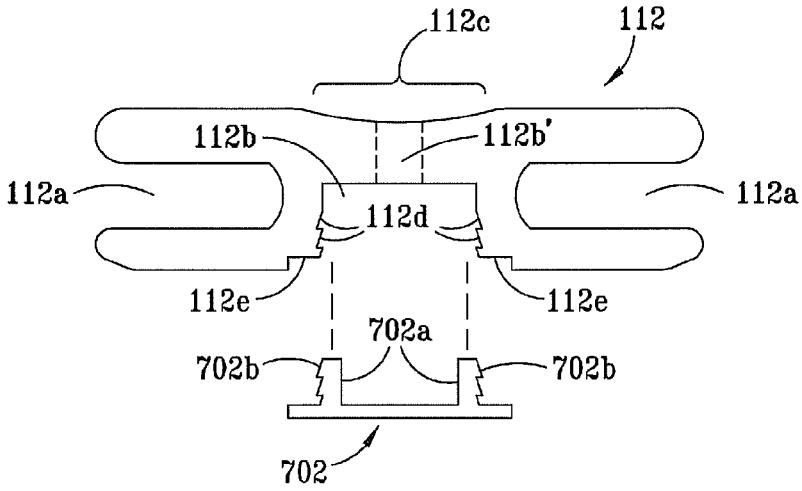
FIG. 7 presents a plan view of a union strip embodying features of the present invention for securing wire mesh to a fence system.

FIG. 7 presents a plan view of the union strip 112 embodying features of the present invention for securing infill material 114 to a fence system embodying features of the present invention. As shown therein, the union strip 112 preferably defines two channels 112*a*, though the union strip 112 may include but a single channel 112*a* where suitable, such as a termination point or corner of a fence. A center channel 112*b* is preferably formed in the union strip 112 between the channels 112*a*, and a hole 112*b*' is formed in the center channel 112*b* for facilitating the passage of a fastener 111 through the hole and to a rail 110 (not shown in FIG. 7), to thereby secure the union strip 112 to the rail 110. The center channel 112*b* further includes ratchet teeth 112*d* and an extended opening portion 112*e*. A cover strip 702 having projections 702*a* and ratchet teeth 702*b* is preferably configured for matingly engaging the center channel 112*b* and ratchet teeth 112*d*, and thereby precluding access to the fasteners 111 and enhancing security of the fence system 100. The union strip 112 preferably also defines a concave radius 112*c* opposing the center channel 112*b* for providing a spring action effective for enabling a fastener 111 to be securely tightened and, for certain configurations wherein a union strip directly abuts a post 102, for enabling the union strip 112 to seat against the post 102.

Figure 8:
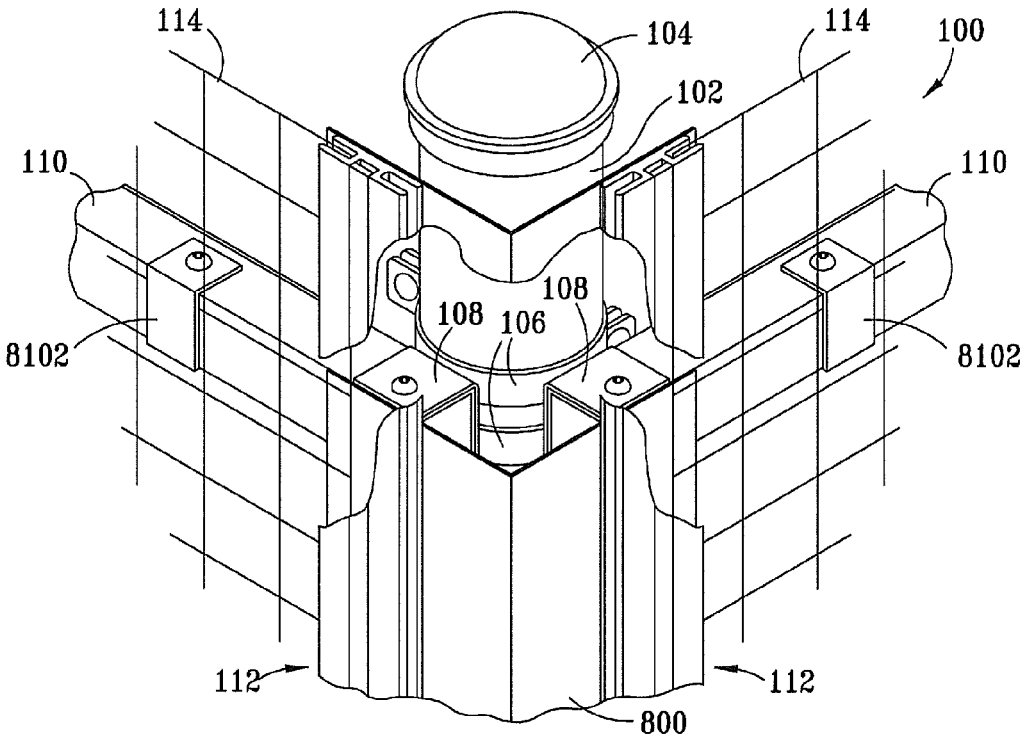
FIG. 8 exemplifies an embodiment of a fence portion of FIG. 1 adapted for securing an exterior corner in a fence system embodying features of the present invention.

FIG. 8 depicts a corner strip 800 adapted for securing an exterior corner of the fence system 100. The corner strip 800 preferably comprises sheet metal fabricated with a 90° bend in it, although the angle of the bend could be any angle suitable for the fence system 100, and could comprise multiple angles, such as two 45° angles instead of a single 90° angle. While not shown, the corner strip 800 is preferably mounted by passing a fastener, such as a self-tapping screw or the like, the hole 112*b*' and into the rail 110 securing the corner strip 800 thereto.

Figure 9:
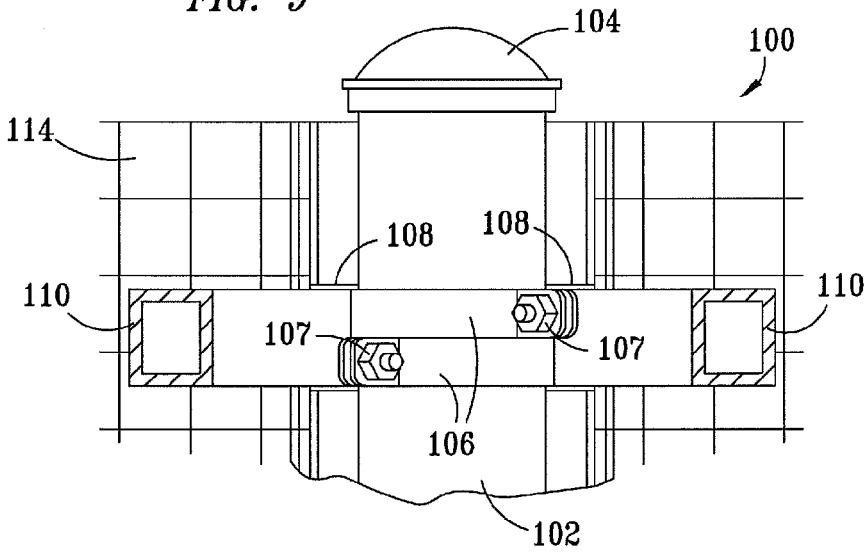
FIG. 9 presents an elevation view of the fence of FIG. 8 viewed from a back side of FIG. 8.

FIG. 9 presents an elevation view of the portion of the fence system 100 of FIG. 8 viewed from a back side of FIG. 8. As shown therein, and further to the discussion above with respect to FIG. 6, the clamps 106 are complementarily positioned relative to each other to permit two rails 110 to be supported at a common height from the same post 102.

Figure 10:
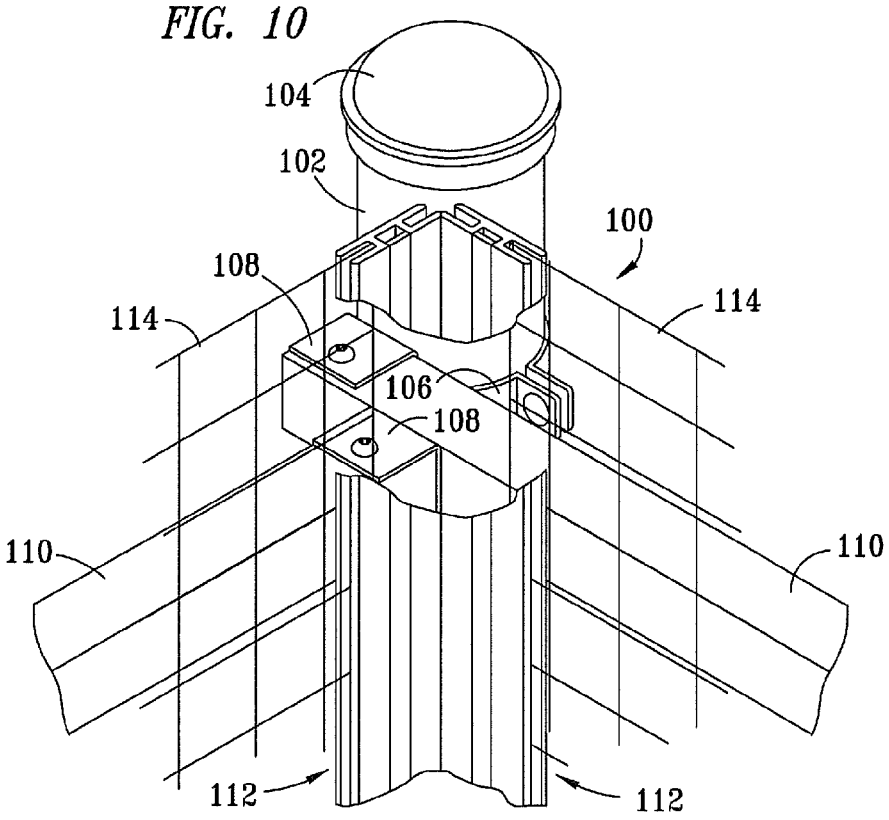
FIG. 10 exemplifies an alternative embodiment of the fence portion of FIG. 1 adapted for securing an interior corner in a fence system embodying features of the present invention.

FIG. 10 depicts an embodiment of a portion of the fence system 100 adapted for securing an interior corner in the fence system. Accordingly, two union strips 112 are preferably positioned on respective rails 110 so that they substantially abut one another, thereby obviating the need for the corner strip 800 discussed above with respect to the external corner depicted in FIG. 8. The rails 110 may be interconnected using any of a number of conventional techniques, such as discussed below with respect to FIGS. 97 and 98.

Figure 11:
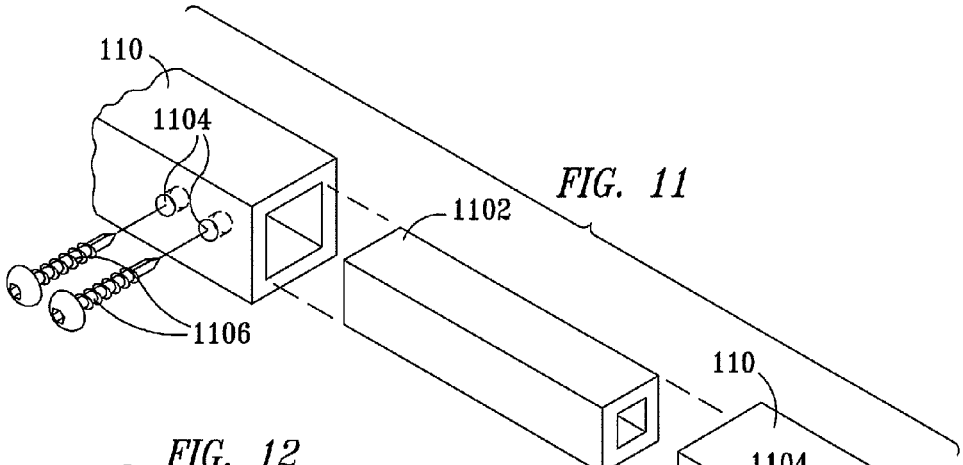
FIG. 11 exemplifies one embodiment for coupling rails together in accordance with principles of the present invention.
Figure 12:
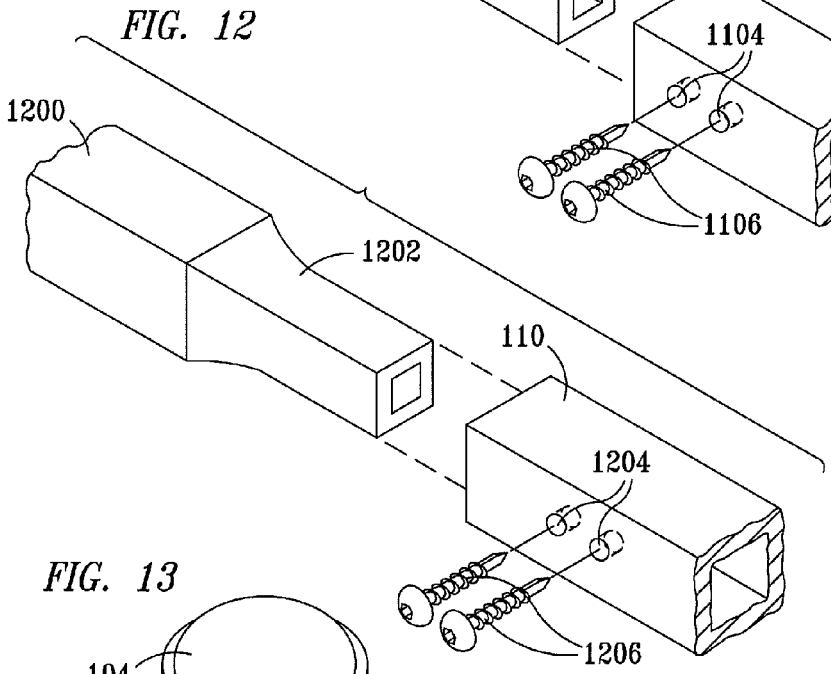
FIG. 12 exemplifies an alternative embodiment for coupling rails together in accordance with principles of the present invention.

FIGS. 11 and 12 depict two embodiments for coupling co-linear rails 110 together in accordance with principles of the present invention. In FIG. 11, an intermediate coupler 1102 is configured for fitting within the ends of two rails 110 to connect together the two rails. One or more holes 1104 are formed in each of the rails 110 to be coupled, so that when the rails 110 receive the coupler 1102, a fastener 1106, such as a self-tapping screw, or the like, may be extended through each hole 1104, and into the intermediate coupler 1102 to thereby secure together the two rails 110 via the coupler 1102. In FIG. 12, one rail 110, designated by the reference numeral 1200, is swaged at one end 1202 to fit within a corresponding rail 110, and one or more holes 1204 are defined in the rail 110, through each of which holes 1204 a fastener 1204, such as a self-tapping screw, or the like, is extended into the swaged end 1202 of the rail 1200 to secure together the two rails 110 and 1200.

Figure 13:
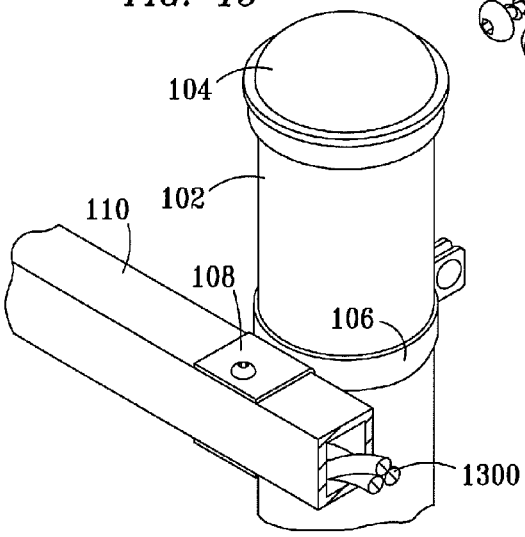
FIG. 13 exemplifies an alternative embodiment of a rail having cable extending through it for enhancing the security of a fence system embodying features of the present invention.

FIG. 13 presents a rail 110 having a cable 1300 extending through it for enhancing the security of the fence system 100. The cable 1300 is preferably secured at each end of the rail 110 to a relatively immovable object, such as a monument, anchor in the ground, or the like.

Figure 14:
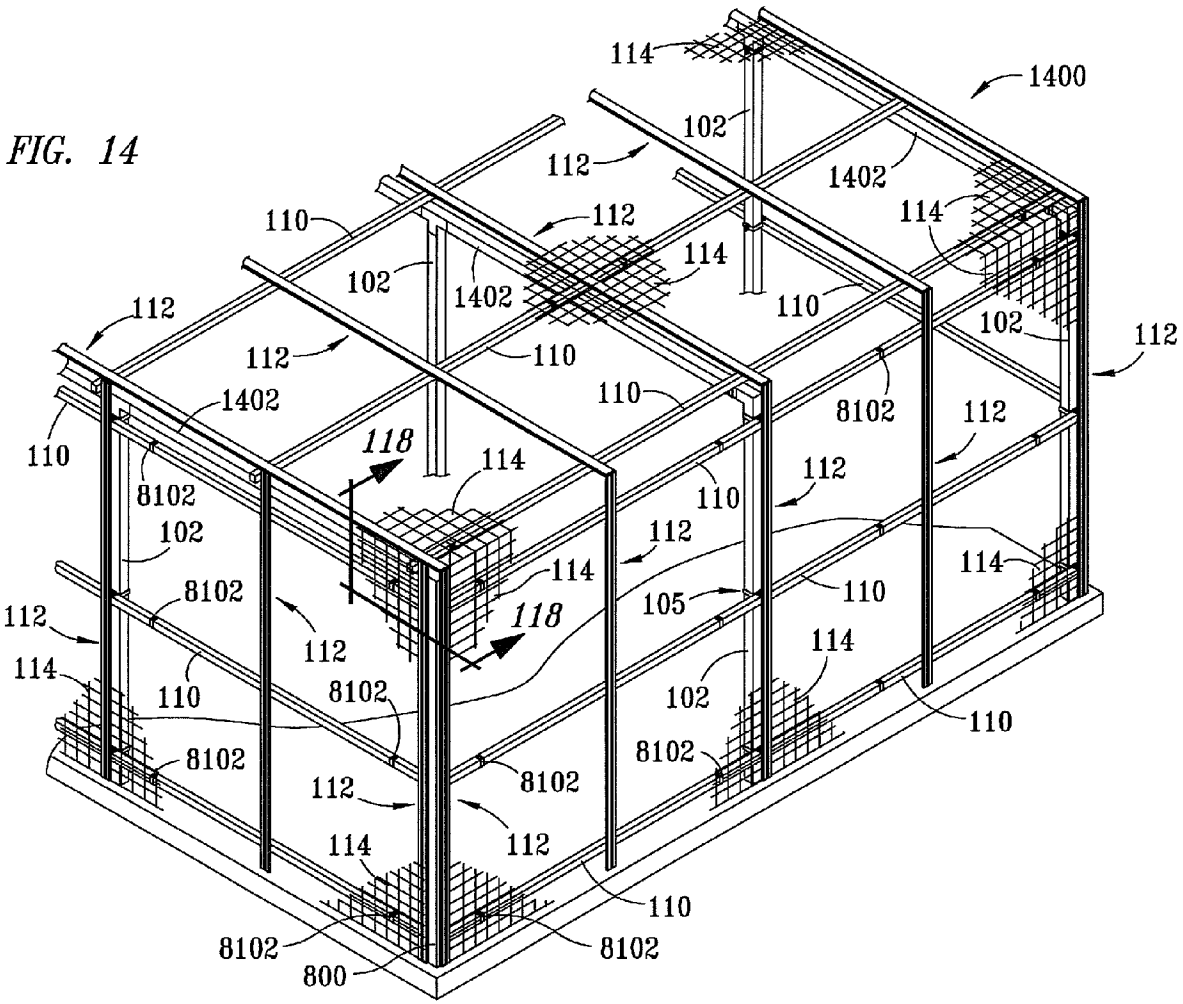
FIG. 14 exemplifies one embodiment of a fence system configured as an enclosure having infill material positioned on the exterior of the enclosure and extending across the top of the enclosure in accordance with principles of the present invention.

FIG. 14 exemplifies an embodiment of the present invention having infill material extending across the top of the fence system, to thereby form an enclosure 1400, such as a tool bin in a retail store. As shown therein, and as discussed in further detail below with respect to FIGS. 118 and 119, the rafters 1402 extend between the tops of posts 102, rails 110 extend across the rafters 1402, and union strips 112 extend across the rails 110. Infill material 114 is then positioned in, and retained by, the channels 112*a* of the union strips 112, and further retained to the rails via clips, such as the clips 8102, to secure the top of the enclosure 1400.

Figure 118:
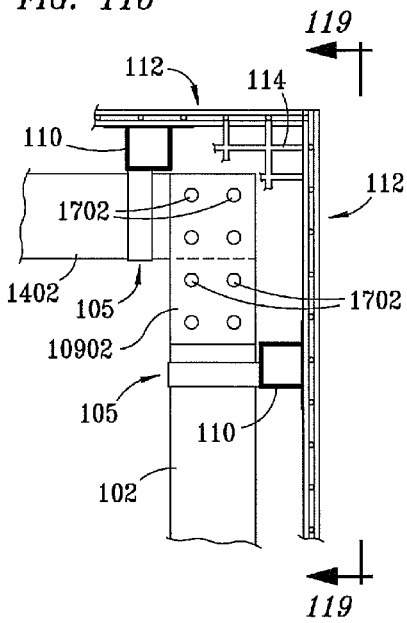
FIG. 118 presents an elevation view taken along the line 118-118 of FIG. 14 of one preferred embodiment for securing of a rafter to a post of the enclosure of FIG. 14.
Figure 119:
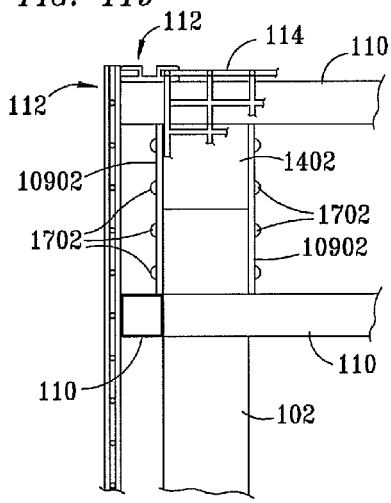
FIG. 119 presents an elevation view taken along the line 119-119 of FIG. 118.

Referring to FIGS. 118 and 119, there is depicted one preferred embodiment for securing a rafter 1402 to a post 102. Accordingly, the rafter 1402 is preferably positioned on top of the post 102, and is secured thereto by two plates 10902 (only one of which is shown in FIG. 118) fastened to both the rafter 1402 and the post 102 via conventional fasteners, such as the bolt 1702 or 1802 and nut 1704, described in further detail below with respect to FIGS. 17 and 18. Rails 110 are secured to the post 102 and rafter 1402 via rail hangers, such as the rail hangers 105 described above with respect to FIGS. 3-5. As also described above, union channels 112 are secured to the rails 110, and infill material 114 is positioned in, and retained by, the union channels 112, and further retained to the rails via clips, such as the clips 8102.

Figure 15:
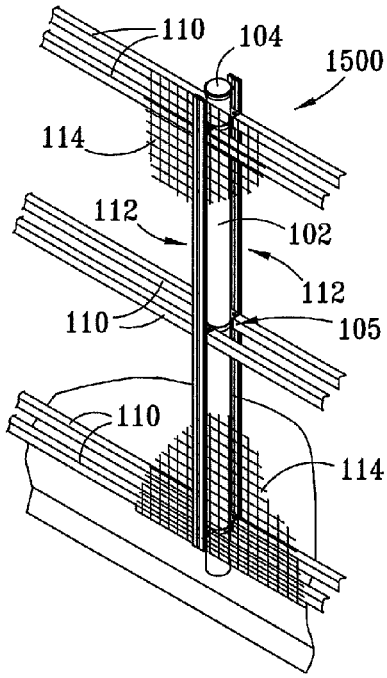
FIG. 15 exemplifies an alternative embodiment of the present invention wherein rails, union strips, and infill material are positioned on each of two sides of a fence system embodying features of the present invention.

FIG. 15 presents an alternative embodiment 1500 of the present invention wherein rails 110, union strips 112, and infill material 114, such as wire mesh, is secured to two sides of a fence system, to thereby provide additional security. It may be appreciated that the rails 110, union strips 112, and wire mesh 114 may be different on each side, as desired.

Figure 16:
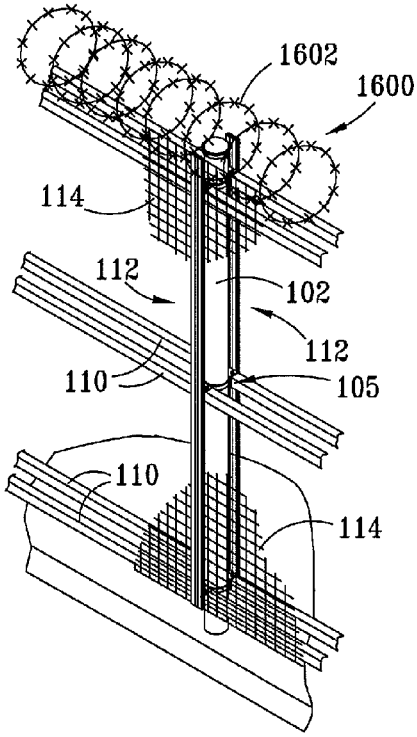
FIG. 16 exemplifies an alternative embodiment of the fence system of FIG. 15 wherein Constantina (also known as concertina) wire is positioned atop a fence system embodying features of the present invention.

FIG. 16 presents an alternative embodiment 1600 of the present invention wherein barbed wire, such as Constantina (also known as concertina) wire (i.e., barbed wire that is extended in a spiral for use as a barrier), is positioned atop the fence system of FIG. 15, to thereby provide still further security.

Figure 17:
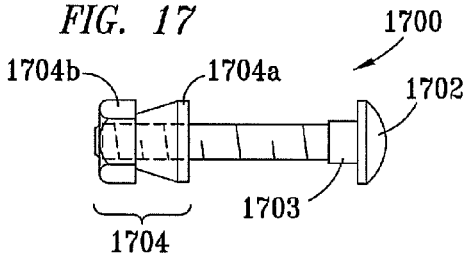
FIG. 17 exemplifies a bolt having a carriage head and break-away nut adapted for use in the present invention.

FIG. 17 depicts a bolt (or screw) 1700 preferably having a carriage type of head 1702 (i.e., a "dome-shaped" head with no driver slot) and square shoulder 1703, and configured for receiving a nut 1704, adapted for use in the present invention. The nut 1704 preferably comprises a main portion 1704*a* having a conical type head, and a breakaway portion 1704*b* configured for breaking away from the main portion 1704*a* upon the application of a predetermined amount of torque, thereby rendering the main portion 1704*a* on the bolt 1700 not readily removable, thereby enhancing security still further.

Figure 18:
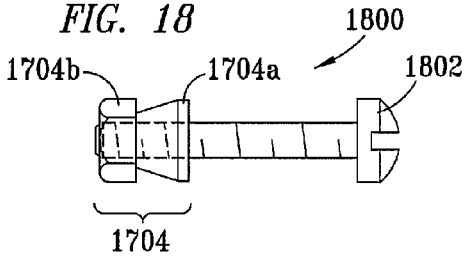
FIG. 18 exemplifies a bolt having a pan head and a breakaway nut adapted for use in the present invention.

FIG. 18 depicts a bolt (or screw) 1800 similar to the bolt (or screw) 1700, but for having a pan type of head 1802 (i.e., a head with a driver slot, such as a Phillips head, a square head, or the like), no square shoulder 1703, and configured for receiving the breakaway nut 1704, for use in the present invention.

Figure 19:
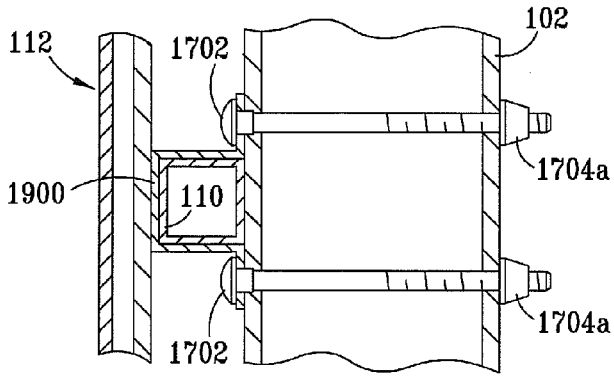
FIG. 19 presents a partial cross-sectional elevation view of one embodiment of a bolt and breakaway nut for securing a rail to a post of a fence system embodying features of a fence system embodying features of the present invention.

FIG. 19 presents a cross-sectional elevation view of an alternative embodiment of a rail hanger for securing a rail 110 to a post 102 of the fence system of FIG. 1, wherein a bracket 1900 wraps around the rail 110. As shown therein, bolts 1702 are extended through the bracket 1900 and post 102, and then secured thereto via a nut, such as the nut 1704 described above with respect to FIG. 17, to thereby secure the bracket 1900 and rail 110 to the post 102.

Figure 20:
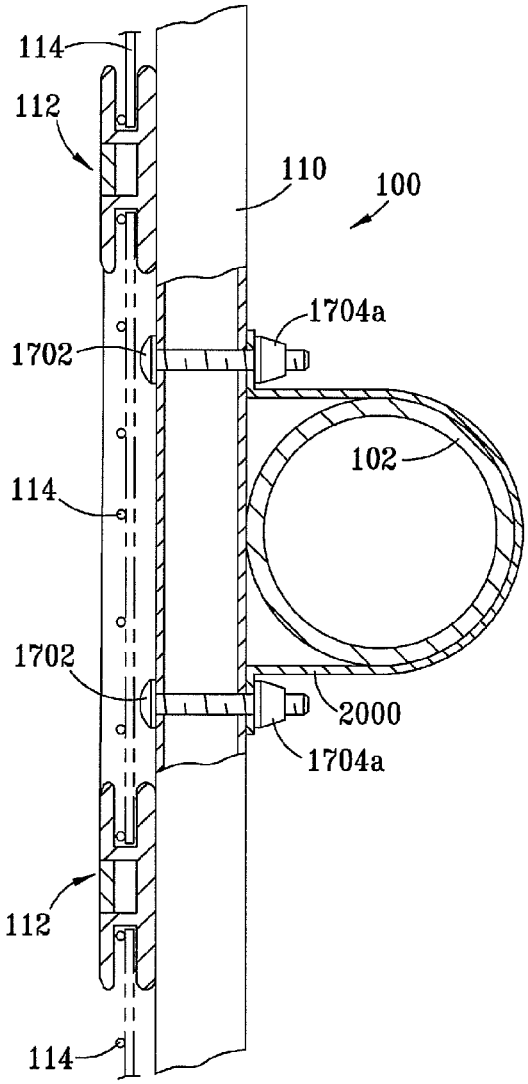
FIG. 20 presents a plan cross-sectional view of one embodiment of a bracket for securing a rail to a post of a fence system embodying features of the present invention.

FIG. 20 presents a plan, partial cross-sectional view of an alternative embodiment of a rail hanger for securing a rail 110 to a post 102 of the fence system 100, wherein a rail hanger bracket 2000 wraps around the post 102. As shown therein, bolts (or screws) 1702 extend from the rail 110 into the bracket 2000 and are secured thereto via a nut, such as the nut 1704, described above with respect to FIG. 17, to thereby secure the rail to the post 102.

Figure 21:
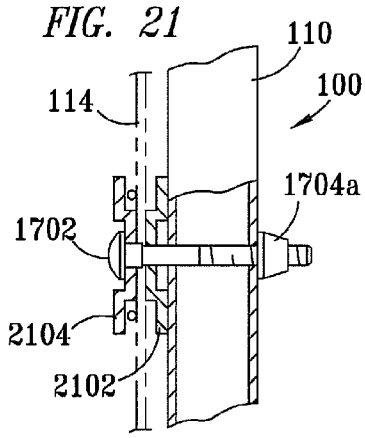
FIG. 21 exemplifies a plan view of an alternative embodiment of a union strip configured for securing infill material to a fence system embodying features of the present invention.

FIG. 21 presents a plan view of alternative means for securing infill material 114 to a rail 110 of the fence system 100. Accordingly, a first shaped bar, or strip, 2102, extending perpendicularly into the figure, as viewed in FIG. 21, is positioned against the rail 110, and a second shaped bar, or strip, 2104 similar to the first strip 2102, is positioned to abut the first strip 2102 and form channels similar to the channels 112*a*, and the strips 2102 and 2104 are secured to the rail 110 via a fastener, such as the bolt 1702 and nut 1704, a conventional screw, bolt, or the like, extended through holes suitably defined in the strips 2102 and 2104. Infill material 114 is sandwiched in the channels formed between the strips 2100 and 2102. The strips 2102 and 2104 are preferably fabricated from metal, such as steel or aluminum, or from a plastic, fiberglass, or the like, effective for securing the infill material 114 to the rails 110.

Figure 22:
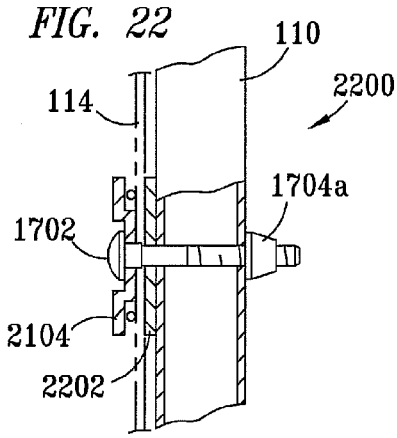
FIG. 22 exemplifies a plan view of a further alternative embodiment of a union strip configured for securing infill material to a fence system embodying features of the present invention.

FIG. 22 depicts an alternative embodiment 2200 of the fence system 100 similar to the embodiment described above with respect to FIG. 21, but for incorporating a flat bar, or strip, 2202 in place of the shaped strip 2102. The strips 2202 and 2104 are positioned to abut one against the other and form channels similar to the channels 112*a* into which infill material 114 is positioned.

Further to the rail hangers described above with respect to FIGS. 3-5, 19, and 20, FIGS. 23-52 exemplify additional alternative embodiments that may be implemented for mounting a rail 110 to a post 102 in accordance with principles of the present invention.

Figures 23, 24, 25, 26, 27, 28, 29, 30, 31:
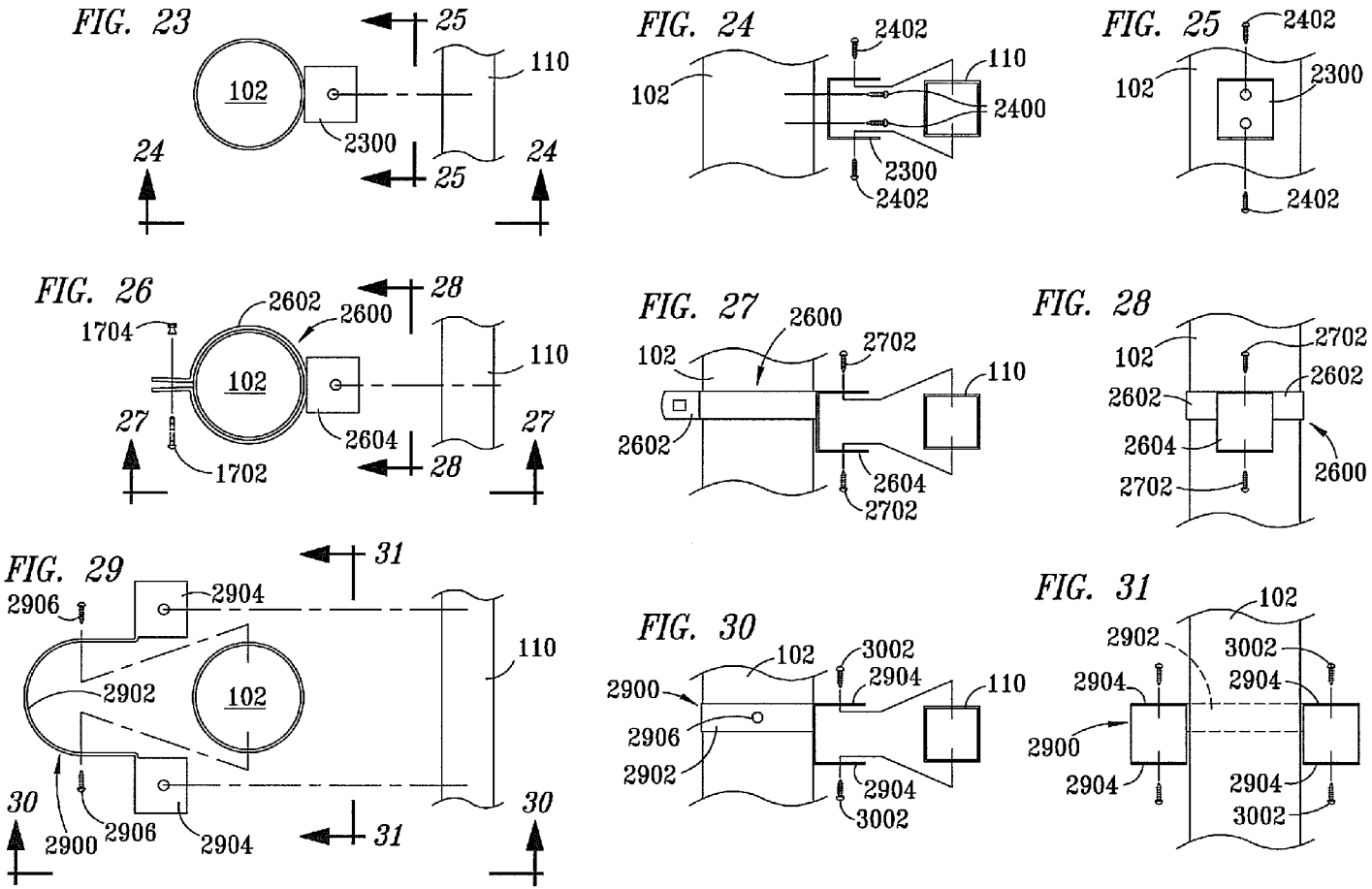
FIGS. 23-25 exemplify one plan view and two elevation views, respectively, of a bracket which may be adapted for securing a rail to a post of a fence system embodying features of the present invention.
FIGS. 26-28 exemplify one plan view and two elevation views, respectively, of an alternative bracket which may be adapted for securing a rail to a post of a fence system embodying features of the present invention.
FIGS. 29-31 exemplify one plan view and two elevation views, respectively, of an alternative bracket which may be adapted for securing a rail to a post of a fence system embodying features of the present invention.

FIGS. 23-25 depict one plan view and two elevation views, respectively, of one embodiment of a rail hanger 2300 adapted for mounting a rail 110 to a post 102 via a bracket 2300. As shown in FIG. 24, two or more fasteners 2400, such as self-tapping screws, rivets, or the like, are preferably utilized to secure the bracket 2300 directly to the post 102, and two or more fasteners 2402 are preferably utilized to secure the rail 110 to the bracket 2300. It will be appreciated that two opposing fasteners 2402 may be replaced by a single longer fastener, such as the bolt 1702 and nut 1704 described above with respect to FIG. 17.

FIGS. 26-28 depict one plan view and two elevation views, respectively, of one embodiment of a rail hanger 2600 adapted for mounting a rail 110 to a post 102. As shown in FIG. 26, the rail hanger 2600 comprises a clamp 2602 and a bracket 2604 secured (e.g., welded) to the clamp 2602. The clamp 2602 includes a fastener, such as a bolt 1702 and nut 1704 to secure the clamp to the post 102. As shown in FIGS. 27-28, two or more fasteners 2702, such as self-tapping screws, rivets, or the like, are preferably utilized to secure the rail 110 to the bracket 2604. It will be appreciated that two opposing fasteners 2702 may be replaced by a single longer fastener, such as the bolt 1702 and nut 1704 described above with respect to FIG. 17.

FIGS. 29-31 depict one plan view and two elevation views, respectively, of one embodiment of a rail hanger 2900 adapted for mounting a rail 110 to a post 102. As shown in FIG. 29, the rail hanger 2900 comprises a semi-circular wrap 2902 and two brackets 2904 secured (e.g., welded) to the wrap 2902. Preferably two or more fasteners 2906, such as self-tapping screws, rivets, or the like, are provided for securing the wrap 2902 to the post 102. As shown in FIGS. 30-31, four or more fasteners 3002 (only two of which are depicted in FIG. 30), such as self-tapping screws, rivets, or the like, are preferably utilized to secure the rail 110 to the bracket 2904. It will be appreciated that two opposing fasteners 2906 or 3002 may be replaced by a single longer fastener, such as the bolt 1702 and nut 1704 described above with respect to FIG. 17.

Figures 32, 33, 34, 35, 36, 37, 38, 39, 40:
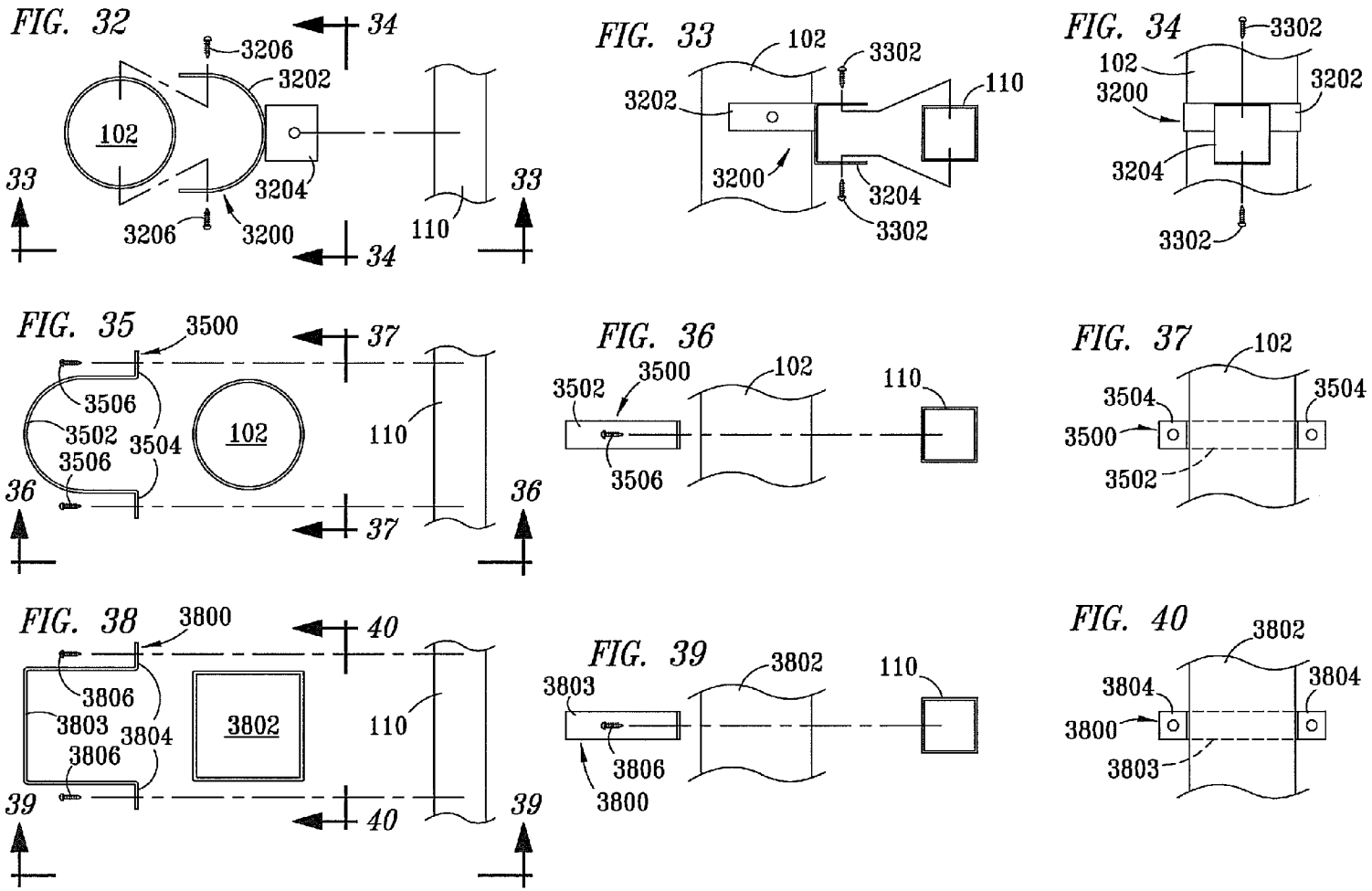
FIGS. 32-34 exemplify one plan view and two elevation views, respectively, of an alternative bracket which may be adapted for securing a rail to a post of a fence system embodying features of the present invention.
FIGS. 35-37 exemplify one plan view and two elevation views, respectively, of an alternative bracket which may be adapted for securing a rail to a post of a fence system embodying features of the present invention.
FIGS. 38-40 exemplify one plan view and two elevation views, respectively, of an alternative bracket which may be adapted for securing a rail to a post of a fence system embodying features of the present invention.

FIGS. 32-34 depict one plan view and two elevation views, respectively, of one embodiment of a rail hanger 3200 adapted for mounting a rail 110 to a post 102. As shown in FIG. 32, the rail hanger 3200 comprises a semi-circular wrap 3202 and a bracket 3204 secured (e.g., welded) to the wrap 3202. Preferably two or more fasteners 3206, such as self-tapping screws, rivets, or the like, are provided for securing the wrap 3202 to the post 102. As shown in FIGS. 33-34, at least two fasteners 3302, such as self-tapping screws, rivets, or the like, are preferably utilized to secure the rail 110 to the bracket 3204. It will be appreciated that two opposing fasteners 3206 or 3302 may be replaced by a single longer fastener, such as the bolt 1702 and nut 1704 described above with respect to FIG. 17.

FIGS. 35-37 depict one plan view and two elevation views, respectively, of one embodiment of a rail hanger 3500, similar to the rail hanger described above with respect to FIG. 20, adapted for mounting a rail 110 to a post 102. As shown in FIG. 35, the rail hanger 3500 comprises a semi-circular wrap 3502 and two ears 3504 formed and extending from the wrap 3502. Preferably two or more fasteners 3506, such as self-tapping screws, rivets, or the like, are provided for securing the rail hanger 3500 via the ears 3504 to the rail 110, and thus the rail to the post 102. While not shown, one or more fasteners may optionally be provided for further securing the rail hanger 3500 to the post 102.

FIGS. 38-40 depict one plan view and two elevation views, respectively, of one embodiment of a rail hanger 3800 adapted for mounting a rail 110 to a square post 3802, in a manner similar to that depicted in FIGS. 35-37, but for the post 3802 having a square cross-section. Accordingly, as shown in FIG. 38, the rail hanger 3800 comprises a semi-square wrap 3803 and two ears 3804 formed and extending from the wrap 3803. Preferably two or more fasteners 3806, such as self-tapping screws, rivets, or the like, are provided for securing the rail hanger 3800 via the ears 3504 to the rail 110, and thus the rail 110 to the post 3802. While not shown, one or more fasteners may optionally be provided for further securing the rail hanger 3800 to the post 3802.

Figures 41, 42, 43, 44, 45, 46, 47, 48, 49:
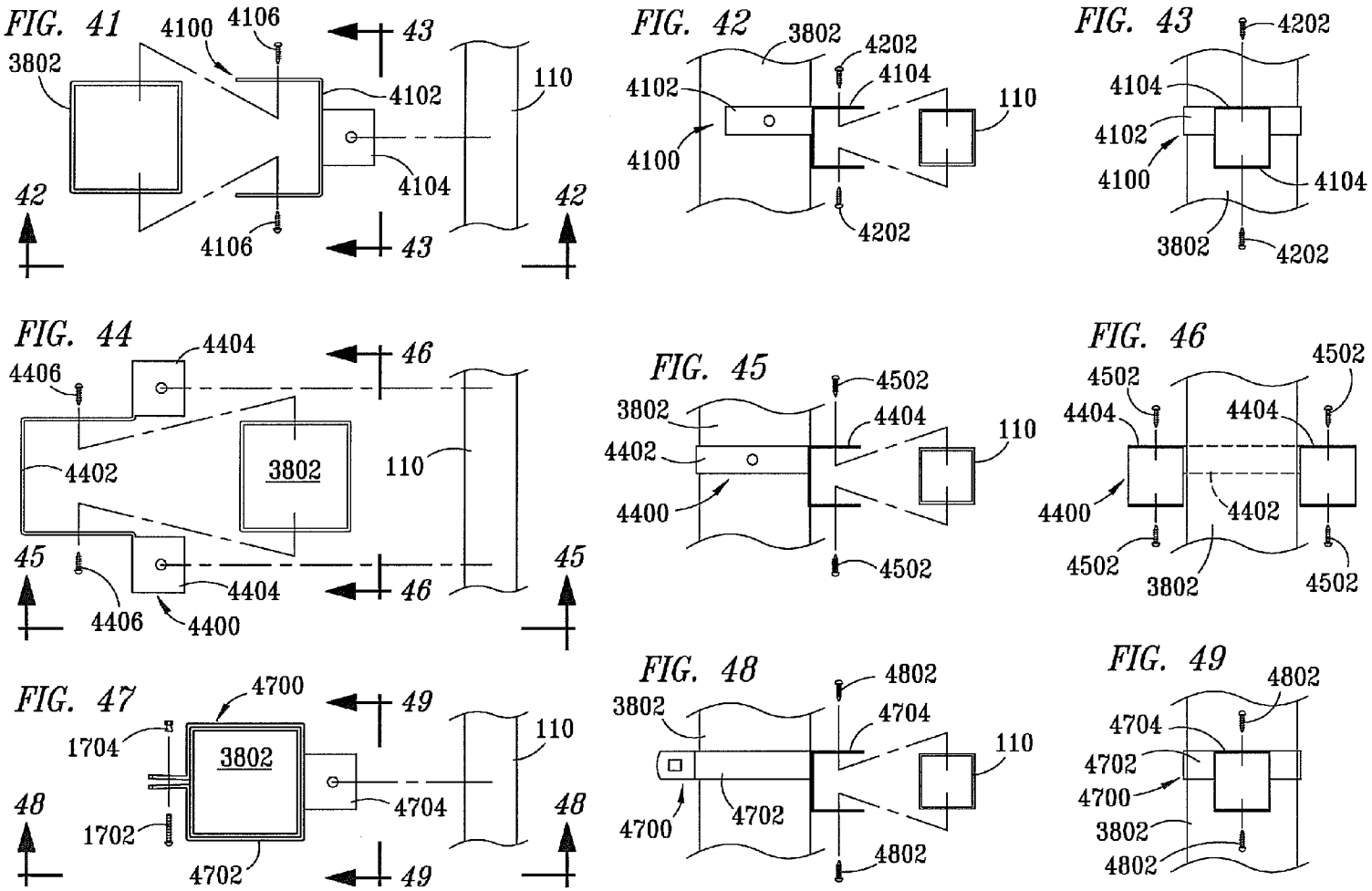
FIGS. 41-43 exemplify one plan view and two elevation views, respectively, of an alternative bracket which may be adapted for securing a rail to a post of a fence system embodying features of the present invention.
FIGS. 44-46 exemplify one plan view and two elevation views, respectively, of an alternative bracket which may be adapted for securing a rail to a post of a fence system embodying features of the present invention.
FIGS. 47-49 exemplify one plan view and two elevation views, respectively, of an alternative bracket which may be adapted for securing a rail to a post of a fence system embodying features of the present invention.

FIGS. 41-43 depict one plan view and two elevation views, respectively, of one embodiment of a rail hanger 4100 adapted for mounting a rail 110 to the square post 3802, in a manner similar to that depicted in FIGS. 32-34, but for the post 3802 having a square cross-section. Accordingly, as shown in FIG. 41, the rail hanger 4100 comprises a semi-square wrap 4102 and a bracket 4104 secured (e.g., welded) to the wrap 4102. Preferably two or more fasteners 4106, such as self-tapping screws, rivets, or the like, are provided for securing the wrap 4102 to the post 3802. As shown in FIGS. 42-43, at least two fasteners 4202, such as self-tapping screws, rivets, or the like, are preferably utilized to secure the rail 110 to the bracket 4104. It will be appreciated that two opposing fasteners 4106 or 4202 may be replaced by a single longer fastener, such as the bolt 1702 and nut 1704 described above with respect to FIG. 17.

FIGS. 44-46 depict one plan view and two elevation views, respectively, of one embodiment of a rail hanger 4400 adapted for mounting a rail 110 to the square post 3802, in a manner similar to that depicted in FIGS. 29-31, but for the post 3802 having a square cross-section. Accordingly, as shown in FIG. 44, the rail hanger 4400 comprises a semi-square wrap 4402 and two brackets 4404 secured (e.g., welded) to the wrap 4402. Preferably two or more fasteners 4406, such as self-tapping screws, rivets, or the like, are provided for securing the wrap 4402 to the post 3802. As shown in FIGS. 45-46, four or more fasteners 4502 (only two of which are depicted in FIG. 45), such as self-tapping screws, rivets, or the like, are utilized to secure the rail 110 to the bracket 4404. It will be appreciated that two opposing fasteners 4406 or 4502 may be replaced by a single longer fastener, such as the bolt 1702 and nut 1704 described above with respect to FIG. 17.

FIGS. 47-49 depict one plan view and two elevation views, respectively, of one embodiment of a rail hanger 4700 adapted for mounting a rail 110 to the square post 3802, in a manner similar to that depicted in FIGS. 26-28, but for the post 3802 having a square cross-section. Accordingly, as shown in FIG. 47, the rail hanger 4700 comprises a clamp 4702 and a bracket 4704 secured (e.g., welded) to the clamp 4702. The clamp 4702 includes a fastener, such as a bolt 1702 and nut 1704 to secure the clamp to the post 3802. As shown in FIGS. 48-49, two or more fasteners 4802, such as self-tapping screws, rivets, or the like, are preferably utilized to secure the rail 110 to the bracket 4704. It will be appreciated that two opposing fasteners 4802 may be replaced by a single longer fastener, such as the bolt 1702 and nut 1704 described above with respect to FIG. 17.

Figures 50, 51, 52, 53, 54, 55, 56, 57, 58, 59, 60:
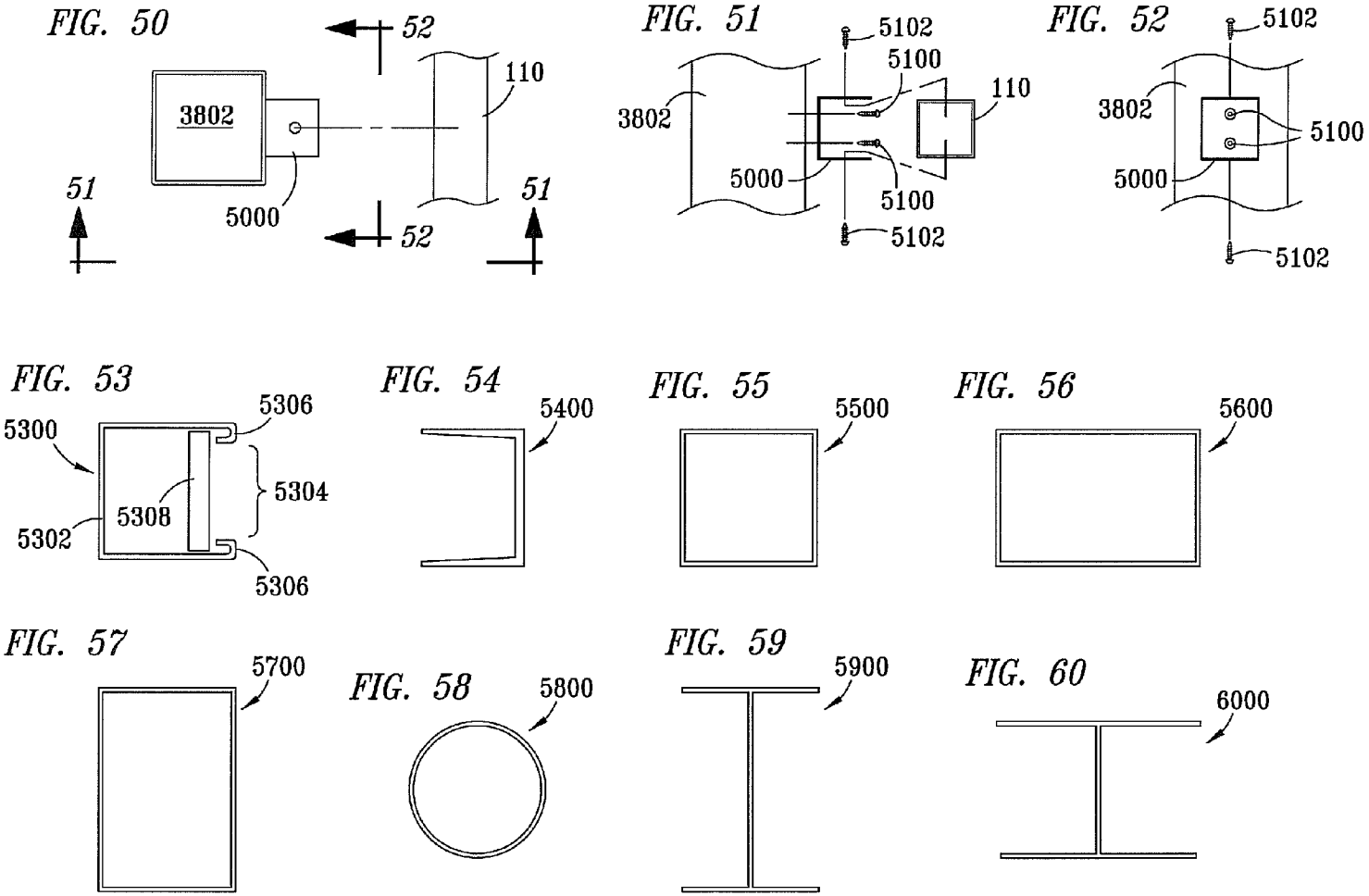
FIGS. 50-52 exemplify one plan view and two elevation views, respectively, of an alternative bracket which may be adapted for securing a rail to a post of a fence system embodying features of the present invention.
FIGS. 53-60 exemplify cross-sectional views of various alternative rails that may be utilized in a fence system embodying features of the present invention.

FIGS. 50-52 depict one plan view and two elevation views, respectively, of one embodiment of a rail hanger 5000 adapted for mounting a rail 110 to the square post 3802, in a manner similar to that depicted in FIGS. 23-25, but for the post 3802 having a square cross-section. Accordingly, as shown in FIG. 51, two or more fasteners 5100, such as self-tapping screws, rivets, or the like, are preferably utilized to secure the bracket 5000 directly to the post 3802, and two or more fasteners 5102 are preferably utilized to secure the rail 110 to the bracket 5000. It will be appreciated that two opposing fasteners 5102 may be replaced by a single longer fastener, such as the bolt 1702 and nut 1704 described above with respect to FIG. 17.

While the rail 110 may assume any of a number of different cross-sections, FIGS. 53-60 exemplify selected cross-sectional views of various rails that may be utilized with the present invention. More specifically, FIG. 53 depicts a cross-section of a rail 5300, configured using a Unistrut® metal frame, having a channel structure 5302 defining a channel opening 5304, and fabricated from a material such as metal. The structure 5302 includes edges 5306 turned inwardly and defining the channel opening 5304. A channel nut 5308 is positioned within the interior of the structure 5302, abutting the edges 5306. Use of the rail 5300 is described in further detail below with respect to FIG. 65.

FIG. 54 depicts a rail 5400 configured in the shape of a structural channel. FIG. 55 depicts a rail 5500 configured as square tubing. FIGS. 56 and 57 depict rails 5600 and 5700 configured in the shape of a substantially rectangular tubing, each rail being oriented 90° from the other. FIG. 58 depicts a rail 5800 configured in the shape of around tube or pipe. FIGS. 59 and 60 respectively depict a rail 5900 configured in the shape of a conventional I-beam, and a rail 6000 configured in the shape of a wide-flange I-beam. The rails presented herein are presented by of example, and not limitation, and rails utilized may assume any of a number of other configurations, such as, elliptical, angle iron, and the like.

Figure 61:
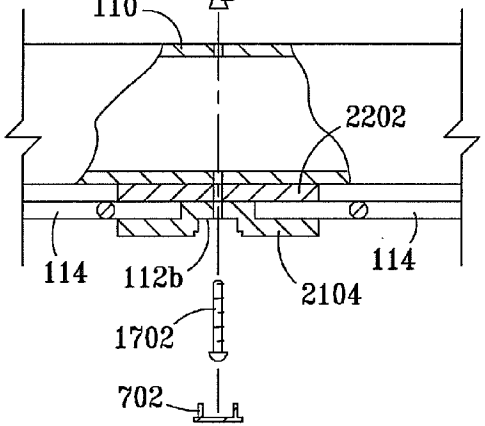

FIG. 61 depicts a plan view of an embodiment of a channel structure which is similar to the embodiment described above with respect to FIG. 22, but for further including the cover strip 702, and modifying the shaped strip 2104 to receive the cover strip 702. More specifically, as described above with respect to FIG. 22, the flat strip 2202 is positioned against the rail 110, and infill material 114 is sandwiched between the flat strip 2202 and the shaped strip 2104. The shaped strip 2104 is modified as described above with respect to FIG. 7 to define a center channel 112*b* with ratchet teeth 112*d* for matingly receiving the cover strip 702. Because the center channel 112*b* and cover strip 702 were described in some detail above with respect to FIG. 7, they will not be described in further detail herein.

Figure 62:
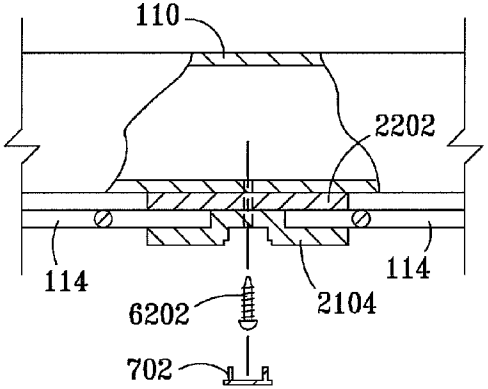
FIGS. 61 and 62 exemplify cross-sectional plan views of the union strip of FIG. 22 secured to a rail by means of fasteners with a cover positioned over the fasteners.

FIG. 62 is similar to FIG. 61, but for using a fastener 6202, such as a self-tapping screw, a rivet, or the like, in place of the bolt 1702 and nut 1704.

Figure 64:
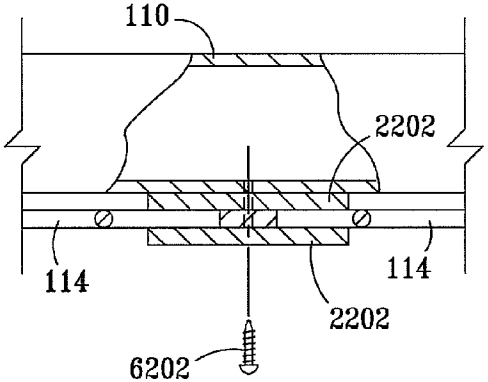
FIGS. 63 and 64 exemplify cross-sectional plan views of alternative embodiments for securing infill material directly to a rail of a fence system embodying features of the present invention.
Figure 63:
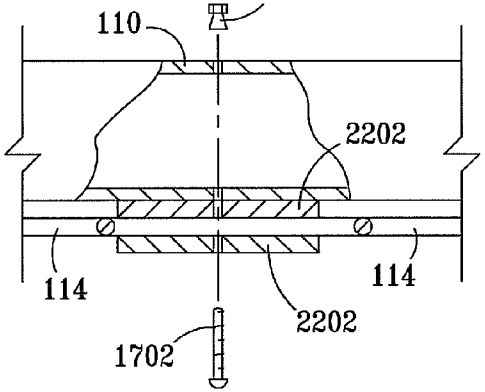

FIGS. 63 and 64 depict alternate embodiments of the channel structures described above with respect to FIGS. 61 and 62, respectively, but for replacing the shaped strip 2104 with a second flat strip 2202, and as a consequence, foregoing use of the cover strip 702.

FIGS. 65-70 are elevation views which exemplify, without limitation, a number of alternate embodiments for mounting, in accordance with principles of the present invention, a channel or flat bar for containing and retaining infill material to a rail.

Figure 65:
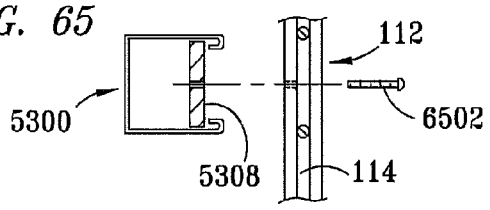
FIGS. 65-70 exemplify elevation cross-sectional views of various means for securing union strips to a rail of a fence system embodying features of the present invention.

Referring now to FIG. 65, a union strip 112 is positioned for being mounted on the Unistrut® channel rail 5300 described in further detail above with respect to FIG. 53. As shown in FIG. 65, the union strip 112 is mounted to the rail 5300 by passing a fastener 6502, such as a screwor the like, through the hole 112*b*' of the union strip 112 into the channel nut 5308 and tightening the fastener 6502. As the fastener 6502 is tightened, the channel nut 5308 maintains tension in the Unistrut® channel rail 5300, further securing the union strip 112 to the rail 5300.

Figure 66:
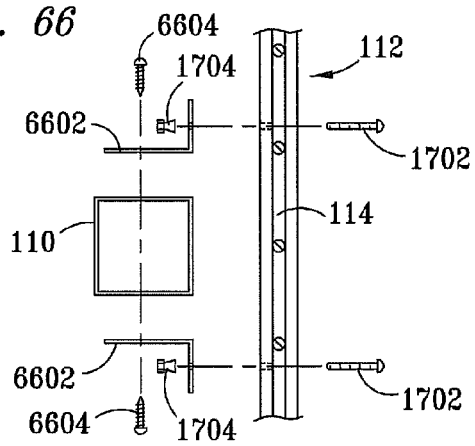

Referring now to FIG. 66, two angle brackets 6602 are mounted to the rail 110 via fasteners, such as screws, 6604. The union strip 112 is mounted to the brackets 6602, and hence to the rail 110, via fasteners, such as a bolt 1702 and nut 1704, described in further detail above with respect to FIG. 17.

Figure 67:
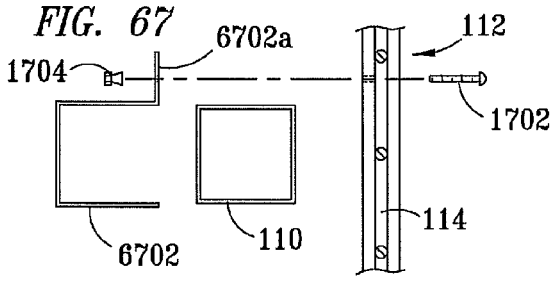

Referring now to FIG. 67, a bracket 6702 is configured to wrap the rail 110, and includes one ear 6702*a*. The union strip 112 is mounted to the ear 6702*a* of the bracket 6702, and hence to the rail 110, via fasteners, such as a bolt 1702 and nut 1704, described in further detail above with respect to FIG. 17.

Figure 68:
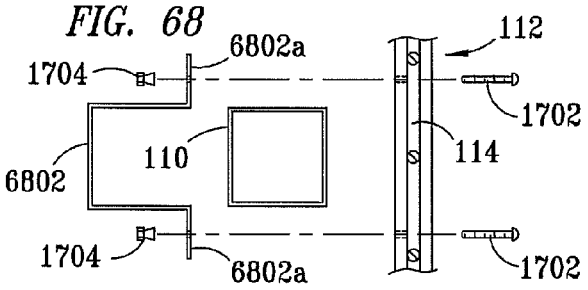

Referring now to FIG. 68, a bracket 6802 is configured to be wrap the rail 110, and includes two ears 6802*a*. The union strip 112 is mounted to the two ears 6802*a* of the bracket 6802, and hence to the rail 110, via fasteners, such as a bolt 1702 and nut 1704, described in further detail above with respect to FIG. 17.

Figure 69:
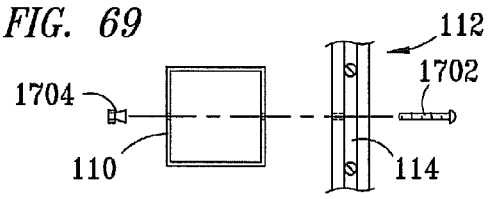

Referring now to FIG. 69, the union strip 112 is mounted directly to the rail 110 via fasteners, such as a bolt 1702 and nut 1704, described in further detail above with respect to FIG. 17.

Figure 70:
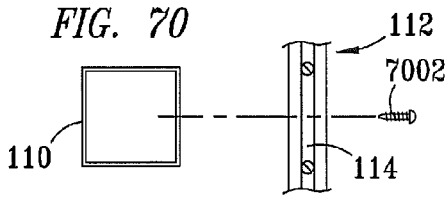

Referring now to FIG. 70, the union strip 112 is mounted directly to the rail 110 via a fastener 7002, such as a self-tapping screw, a rivet, or the like.

FIGS. 71-88 exemplify, without limitation, a number of alternate embodiments of clips for preferably further securing, in accordance with principles of the present invention, infill material 114 directly to a rail 110, 1200, 5300, or the like, intermediate to the channel strips 112.

Figure 71:
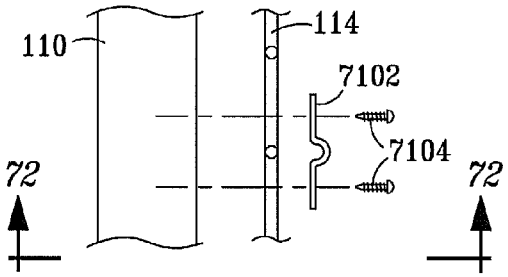
FIGS. 71-72 exemplify a plan view and a cross-sectional elevation view, respectively, of a bracket which may be adapted for securing infill wire mesh to a rail of a fence system embodying features of the present invention.
Figure 72:
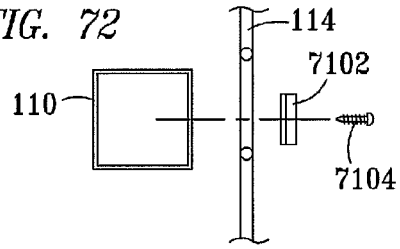

Referring now to FIGS. 71-72, a bracket 7102 is positioned over a portion (e.g., a wire) of infill material 114. Fasteners 7104, such as self-tapping screws, rivets, or the like, are provided for securing each end of the bracket 7102 to the rail 110, thereby securing the infill material 114 to the rail 110.

Figure 73:
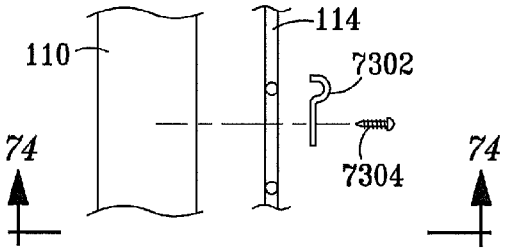
FIGS. 73-74 exemplify a plan view and a cross-sectional elevation view, respectively, of an alternative bracket which may be adapted for securing infill wire mesh to a rail of a fence system embodying features of the present invention.
Figure 74:
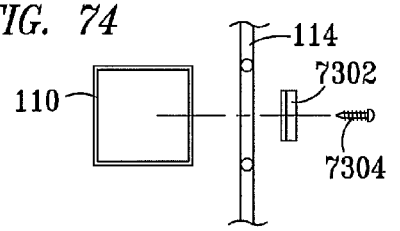

Referring now to FIGS. 73-74, a bracket 7302 is positioned over a portion (e.g., a wire) of infill material 114. A fastener 7304, such as a self-tapping screw, a rivet, or the like, is provided for securing one end of the bracket 7302 to the rail 110, thereby securing the infill material 114 to the rail 110.

Figure 75:
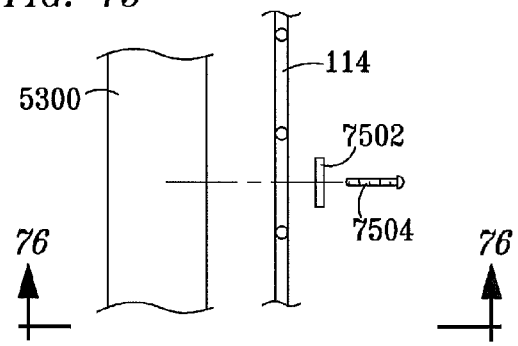
FIGS. 75-76 exemplify a plan view and a cross-sectional elevation view, respectively, of an alternative bracket which may be adapted for securing infill wire mesh to a rail of a fence system embodying features of the present invention.
Figure 76:
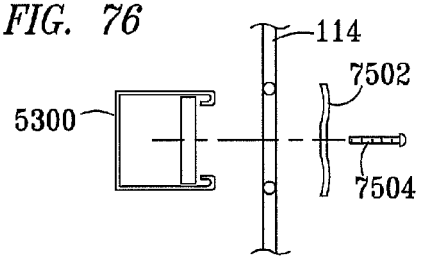

Referring now to FIGS. 75-76, a bracket 7502 is positioned over a portion (e.g., two wires) of infill material 114. A fastener 7504, such as a self-tapping screw, a rivet, or the like, is provided for securing a central portion of the bracket 7502 to a Unistrut® rail 5300, thereby securing the infill material 114 to the rail 5300.

Figure 77:
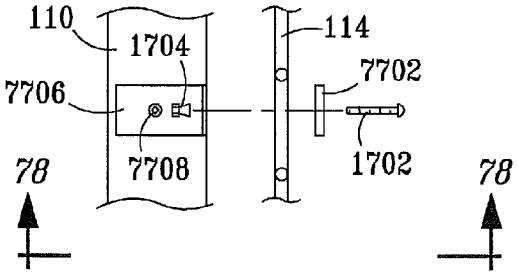
FIGS. 77-78 exemplify a plan view and a cross-sectional elevation view, respectively, of an alternative bracket which may be adapted for securing infill wire mesh to a rail of a fence system embodying features of the present invention.
Figure 78:
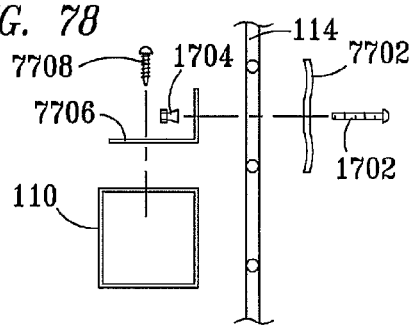

Referring now to FIGS. 77-78, an angle bracket 7706 is mounted on the rail 110 in any conventional manner, using, by way of example, one or more fasteners 7708 (e.g., a self-tapping screw or rivet). A bracket 7702 is positioned over a portion (e.g., two wires) of infill material 114. A fastener, such as a bolt 1702 and nut 1704 described above with respect to FIG. 17, is provided for securing a central portion of the bracket 7702 to the angle bracket 7706, thereby securing the infill material 114 to the rail 110.

Figure 79:
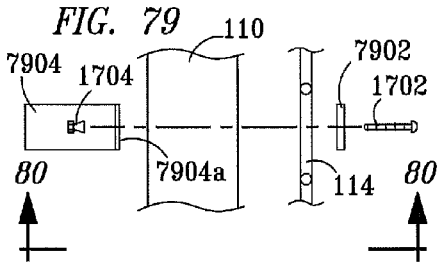
FIGS. 79-80 exemplify a plan view and a cross-sectional elevation view, respectively, of an alternative bracket which may be adapted for securing infill wire mesh to a rail of a fence system embodying features of the present invention.
Figure 80:
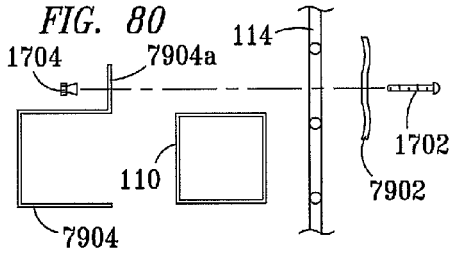

Referring now to FIGS. 79-80, a channel-shaped bracket 7904 having an ear 7904*a* is configured for fitting on the rail 110. A bracket 7902 is positioned over a portion (e.g., two wires) of infill material 114. A fastener, such as a bolt 1702 and nut 1704 described above with respect to FIG. 17, is provided for securing a central portion of the bracket 7902 to the ear 7904*a* of the bracket 7904, thereby securing the infill material 114 to the rail 110.

Figure 81:
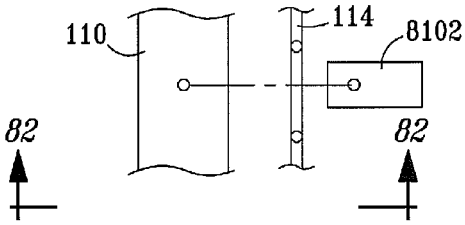
FIGS. 81-82 exemplify a plan view and a cross-sectional elevation view, respectively, of an alternative bracket which may be adapted for securing infill wire mesh to a rail of a fence system embodying features of the present invention.
Figure 82:
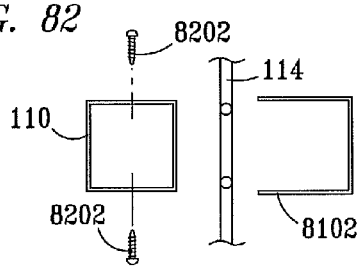

Referring now to FIGS. 81-82, a channel-shaped bracket 8102, also discussed above, e.g., with respect to FIGS. 1, 2, and 14, is sized for fitting on the rail 110. The bracket 8102 is positioned over a portion (e.g., one or two wires) of infill material 114, and then fitted over the rail 110. Two or more fasteners, such as self-tapping screws, rivets, or the like, are provided for securing the bracket 8102, and hence the infill material 114, to the rail 110.

Figure 83:
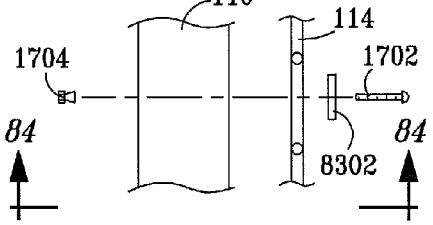
FIGS. 83-84 exemplify a plan view and a cross-sectional elevation view, respectively, of an alternative bracket which may be adapted for securing infill wire mesh to a rail of a fence system embodying features of the present invention.
Figure 84:
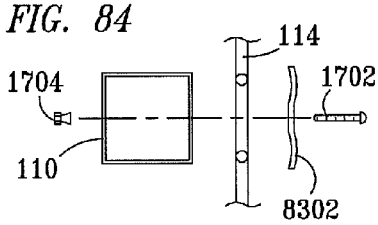

Referring now to FIGS. 83-84, a bracket 8302 is positioned over a portion (e.g., two wires) of infill material 114. A fastener, such as a bolt 1702 and nut 1704 described above with respect to FIG. 17, is provided for securing a central portion of the bracket 8302 to the rail 110, thereby securing the infill material 114 to the rail 110.

Figure 85:
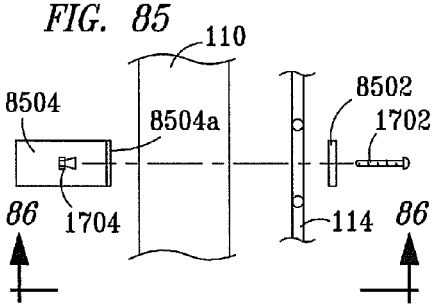
FIGS. 85-86 exemplify a plan view and a cross-sectional elevation view, respectively, of an alternative bracket which may be adapted for securing infill wire mesh to a rail of a fence system embodying features of the present invention.
Figure 86:
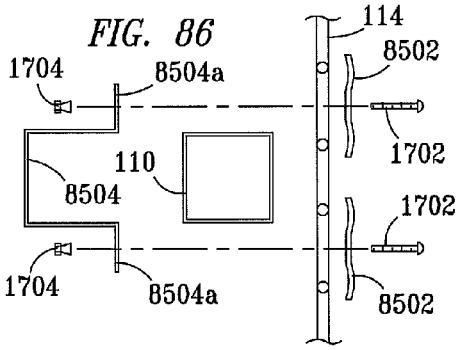

Referring now to FIGS. 85-86, a channel-shaped bracket 8504 having two ears 8504*a* is configured for fitting on the rail 110. Two brackets 8502 are positioned over a portion (e.g., two wires each) of infill material 114. A fastener, such as a bolt 1702 and nut 1704 described above with respect to FIG. 17, is provided for securing a central portion of each bracket 8502 to the ear 8504*a* of the bracket 8504, thereby securing the infill material 114 to the rail 110.

Figure 87:
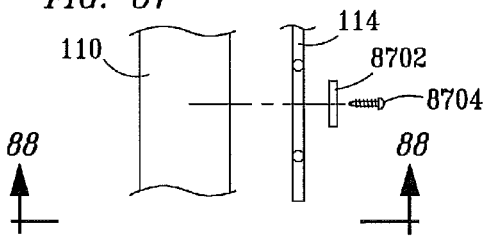
FIGS. 87-88 exemplify a plan view and a cross-sectional elevation view, respectively, of an alternative bracket which may be adapted for securing infill wire mesh to a rail of a fence system embodying features of the present invention.
Figure 88:
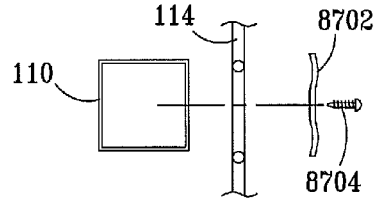

Referring now to FIGS. 87-88, a bracket 8702 is positioned over a portion (e.g., two wires) of infill material 114. A fastener 8704, such as a self-tapping screw, a rivet, or the like, is provided for securing a central portion of the bracket 8702 to the rail 110, thereby securing the infill material 114 to the rail 110.

Figure 89:
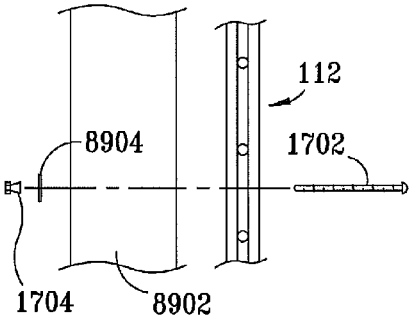
FIGS. 89-90 exemplify elevation views of two embodiments for mounting a union strip and infill material of a fence system embodying features of the present invention to a wall rather than posts.
Figure 90:
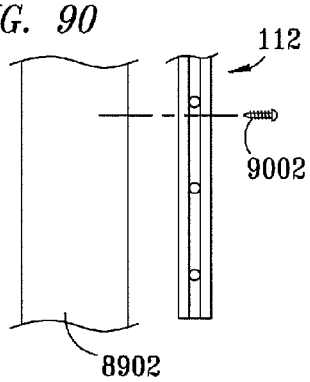

FIGS. 89-90 are elevation views which exemplify, without limitation, two alternate embodiments for mounting union strips 112, without rails, to a wall 8902, such as a concrete wall, a mortar wall, brick wall, or the like, rather than posts, in accordance with principles of the present invention. With specific reference to FIG. 89, a carriage head bolt 1702 is extended through a hole 112*b*' of a union strip 112 and through the wall 8902 and tightened onto a breakaway nut 1704, preferably with a washer 8904 positioned between the wall 8902 and the nut 1704. In FIG. 90, a fastener 9002, such as a self-tapping screw, a rivet, or the like, is extended through a hole 112*b*' of a union strip 112 and threaded or secured in the wall 8902. While not shown, in a further embodiment, the union strips 112 may be secured to the wall 8902 with a suitable adhesive, or adhesive may be used in conjunction with the embodiment depicted by FIG. 89 or 90 above.

FIGS. 91-94 are elevation views which exemplify, without limitation, four alternate embodiments for mounting rails 110 to the wall 8902 described above, in accordance with principles of the present invention.

Figure 91:
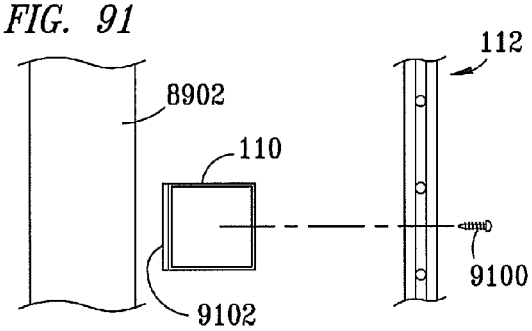
FIGS. 91-94 exemplify elevation views of four embodiments for mounting a rail, union strip, and infill material of a fence system embodying features of the present invention to a wall rather than posts.

With specific reference to FIG. 91, a rail 110 is secured to the wall 8902 using any suitable adhesive 9102 effective for adhering the rail to the wall, e.g., for adhering metal to concrete. The union strip 112 is secured to the rail 110 via one or more fasteners 9100, such as self-tapping screws, rivets, or the like. Alternatively, the union strip 112 may be secured to the rail 110 using any of a number of different techniques, such as exemplified in FIGS. 65-70 described above.

Figure 92:
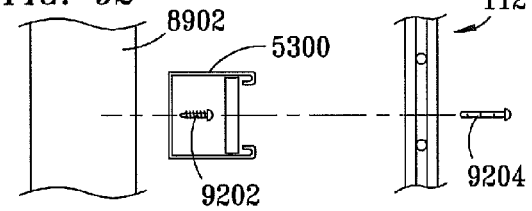

Referring to FIG. 92, a Unistrut® rail 5300 is secured to the wall via one or more fasteners 9202, such as, for example, self-tapping screws, or the like. A union strip 112 is secured to the rail 5300 via a fastener 9204 as described above with respect to FIG. 65.

Figure 93:
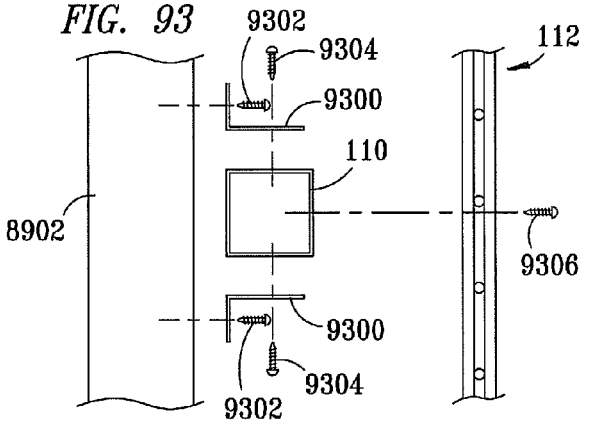

Referring to FIG. 93, upper and a lower angle brackets 9300 are positioned above and below the rail 110 and secured thereto with one or more fasteners 9304, such as, for example, self-tapping screws, rivets, or the like. The brackets 9300 are then secured to the wall 8902 via one or more fasteners 9302, such as, for example, self-tapping screws, or the like. The union strip 112 is secured to the rail 110 via one or more fasteners 9306, such as self-tapping screws, rivets, or the like. Alternatively, the union strip 112 may be secured to the rail 110 using any of a number of different techniques, such as exemplified in FIGS. 65-70 described above.

Figure 94:
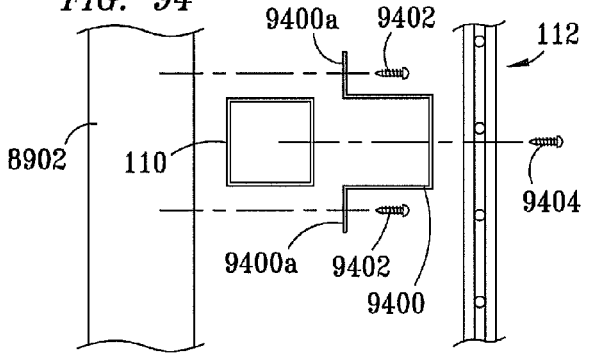

Referring to FIG. 94, a channel-shaped bracket 9400 having upper and lower ears 9400*a* is sized for fitting about the rail 110. Two or more fasteners, such as self-tapping screws, or the like, are provided for securing the ears 9400*a* of the bracket 9400, and hence the rail 110, to the wall 8902. The union strip 112 is secured to the rail 110 via one or more fasteners 9404, such as self-tapping screws, rivets, or the like. Alternatively, the union strip 112 may be secured to the rail 110 using any of a number of different techniques, such as exemplified in FIGS. 65-70 described above.

Figure 95:
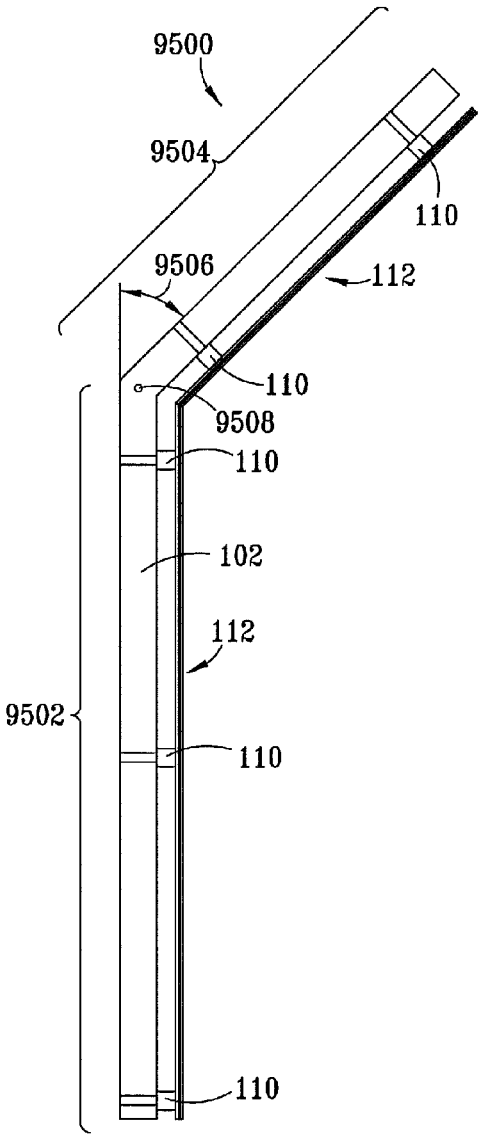
FIGS. 95-96 exemplify side and front elevation views, respectively, of a canted fence system embodying features of the present invention.
Figure 96:
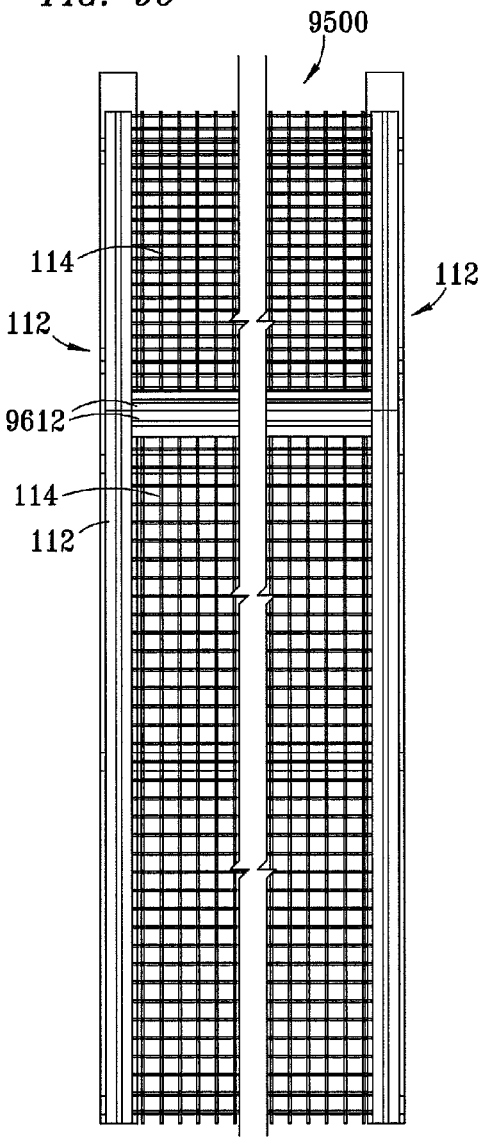

FIGS. 95 and 96 exemplify side and frontal elevation views, respectfully, of a canted fence system 9500 embodying features of the present invention. As shown in FIG. 95, the fence system 9500 includes a vertical portion 9502 and a canted portion 9504. The vertical portion 9502 is substantially similar to the embodiments of the fence system 100 described above with respect to FIGS. 1-94, and the canted portion 9504 is substantially similar to the vertical portion 9502, but for being canted at an angle 9506, such as 45°, though the angle may vary as desired between 1° and 90°. The post 102 is canted at the vertex 9508 in any conventional manner; for example, two straight posts may be welded together, or connected together via a post bend connected to each post, or an extended post 102 may be bent at the vertex 9508. Furthermore, to secure the vertex 9508, two union strips 9612, similar to the union strips 112, are preferably positioned to abut one another and receive the vertical and canted portions of infill material 114. Alternatively, the infill material may be bent at the vertex, or a corner strip, similar to the corner strip 800 (FIG. 8) may be positioned at the vertex. The rails 110 and union strips 112 are mounted to the posts 102 as described above with respect to FIGS. 1-94. While not shown, in alternative embodiments, one or more additional canted portions, similar to the canted portion 9504 but canted at a different angle, may be extended from the canted portion 9504. In a further embodiment, the canted portion 9504 may be curvilinear, and/or an additional canted portion 9504 may be mirrored, to thereby form a "Y", as viewed in FIG. 95. Still further, barbed wire or Constantina wire may be positioned atop the fence system 9500, as discussed above with respect to FIG. 16.

Figure 97:
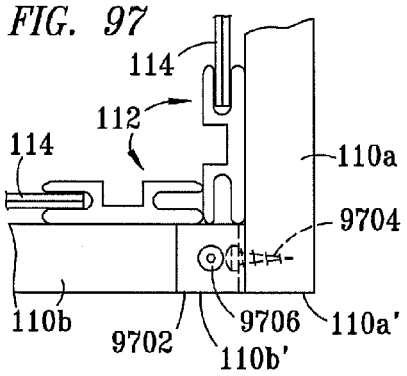
FIG. 97 exemplifies one embodiment for connecting together two rails to form an interior corner of a fence system embodying features of the present invention.

FIG. 97 is a plan view which exemplifies one embodiment for conjoining together a first rail 110*a* to a second rail 110*b* at a corner of a fence system embodying features of the present invention, similarly as discussed above with respect to FIG. 10. Accordingly, as viewed in FIG. 97, a channel-shaped bracket 9702 is positioned proximate to an end 110*a*' of the first rail 110*a*, and a fastener, such as a self-tapping screw 9704, is then extended through a hole (not shown) formed in the bracket 9702 and into the end 110*a*' of the first rail 110*a* to secure the bracket 9702 to the rail 110*a*. The end 110*b*' of the second rail 110*b* is then secured to the bracket 9702 in any conventional manner, such as by fasteners, such as a self-tapping screw, bolt, or the like, or via welding, or the like. As depicted in FIG. 10, union strips 112 positioned on the interior of the fence corner preferably abut one another to maximize the security of the fence system.

Figure 98:
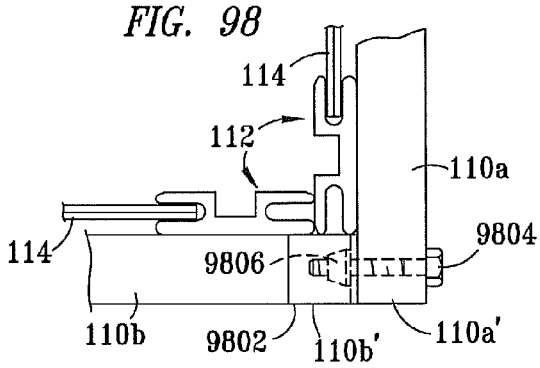
FIG. 98 exemplifies an alternate embodiment for connecting together two rails to form an interior corner of a fence system embodying features of the present invention.

FIG. 98 is a plan view which exemplifies an alternate embodiment for conjoining together a first rail 110*a* to a second rail 110*b* at a corner of a fence system, similarly as discussed above with respect to FIG. 97, but for using a fastener 9804, such as a bolt 1702 and nut 1704, which extends through the entire rail 110*a*.

Figure 99:
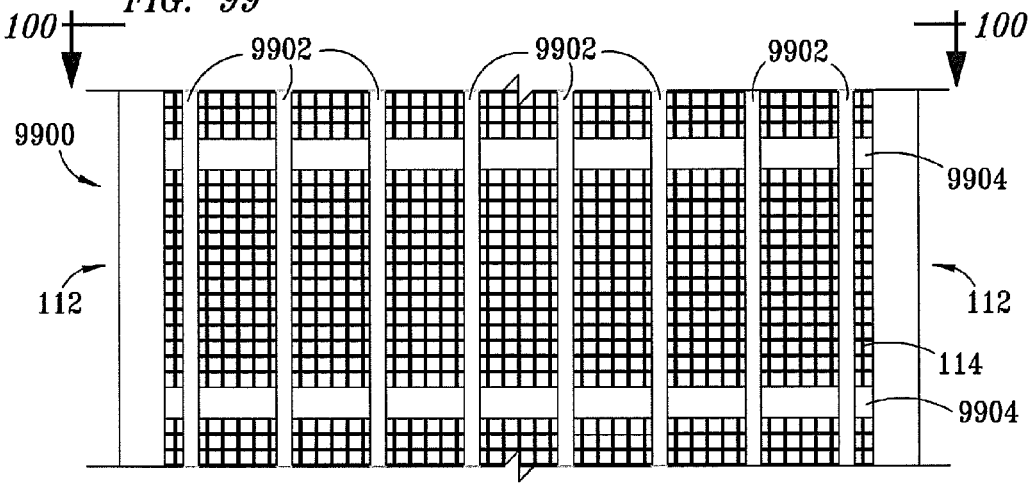
FIG. 99 exemplifies an elevation view of a fence system having pickets in accordance with principles of the present invention.
Figure 100:
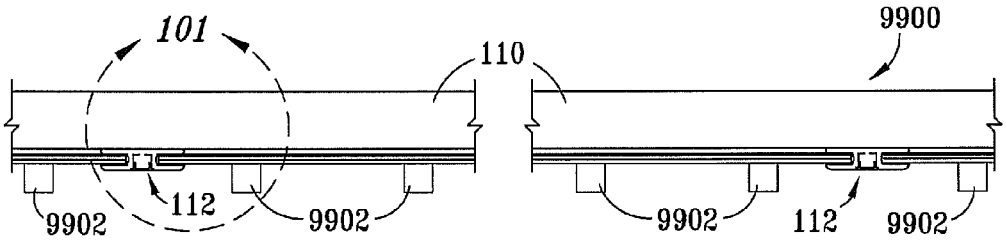
FIG. 100 depicts a plan view of the picket fence system of FIG. 99.
Figure 101:
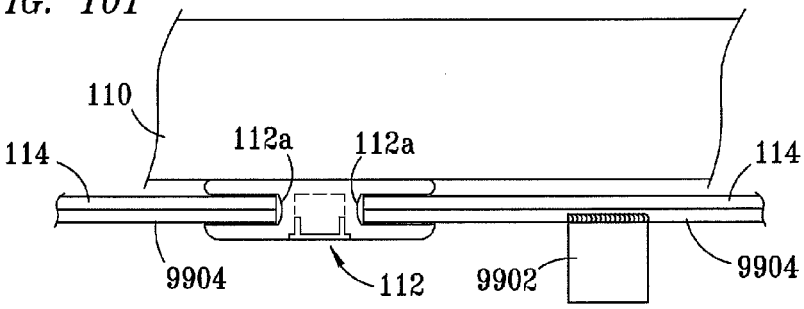
FIG. 101 depicts a detail portion of the fence system of FIG. 100.

FIGS. 99-101 exemplify one embodiment providing for pickets on a picket fence system 9900 in accordance with principles of the present invention, as may be desired by retail garden centers for not only enhancing security, but also providing a degree of ornamentation. With reference to FIG. 99, preferably two or more flat plates 9904 are positioned horizontally between two union strips 112 across infill material 114, and pickets 9902 are mounted (e.g., welded) on the flat plates 9904. FIG. 100, taken along the line 100-100 of FIG. 99, shows a plan view of the picket fence 9900. FIG. 101 depicts detail of a portion of the picket fence 9900 within the line 101 of FIG. 100. More specifically, as shown in FIG. 101, both the infill material 114 and the flat plates 9904 are positioned and secured within the channels 112*a* of the union strip 112.

Figure 102:
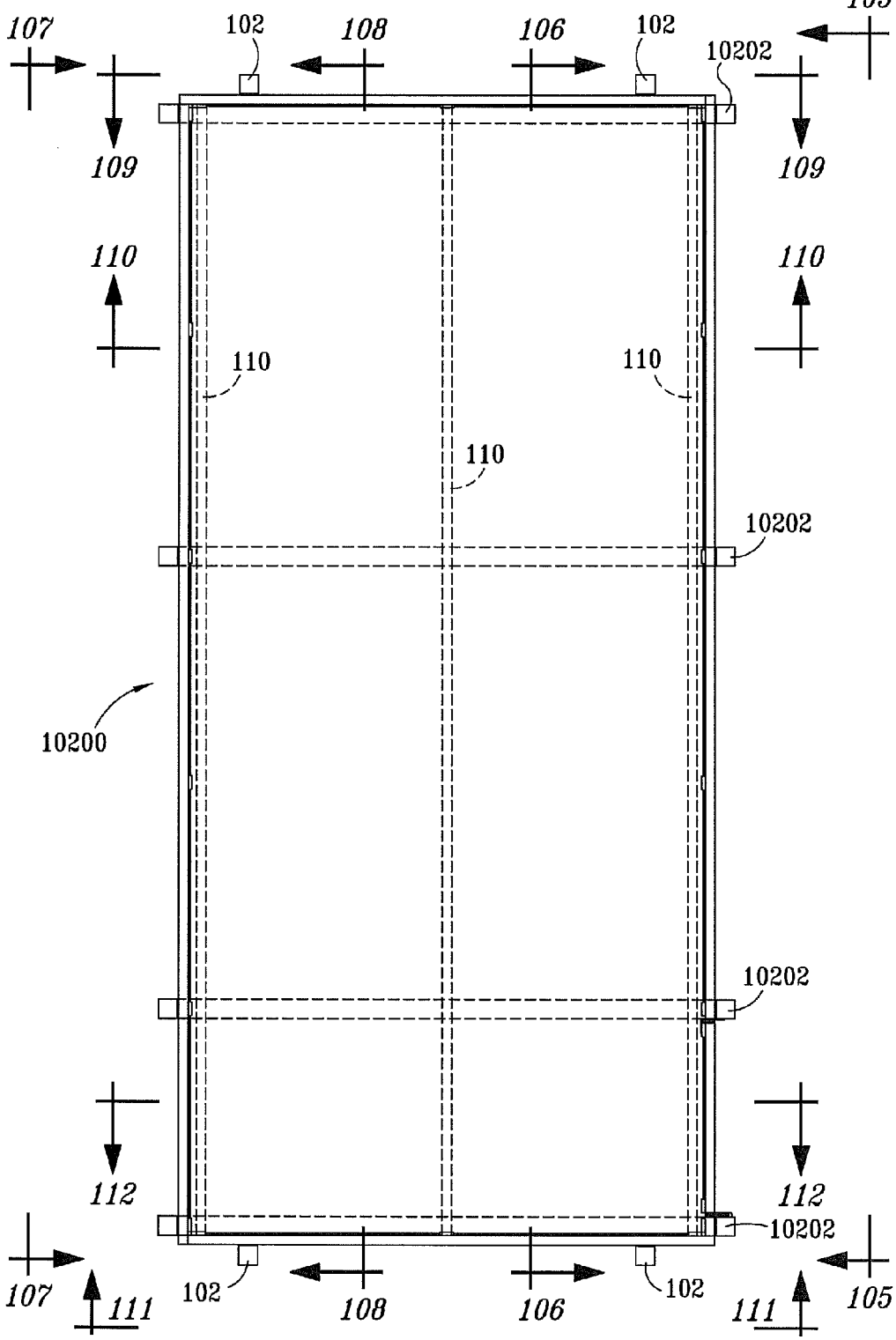
FIG. 102 exemplifies a site plan of a first embodiment of a fence system configured as an enclosure having infill material positioned on the interior of the enclosure and extending across the top of the enclosure in accordance with principles of the present invention.
Figure 103:
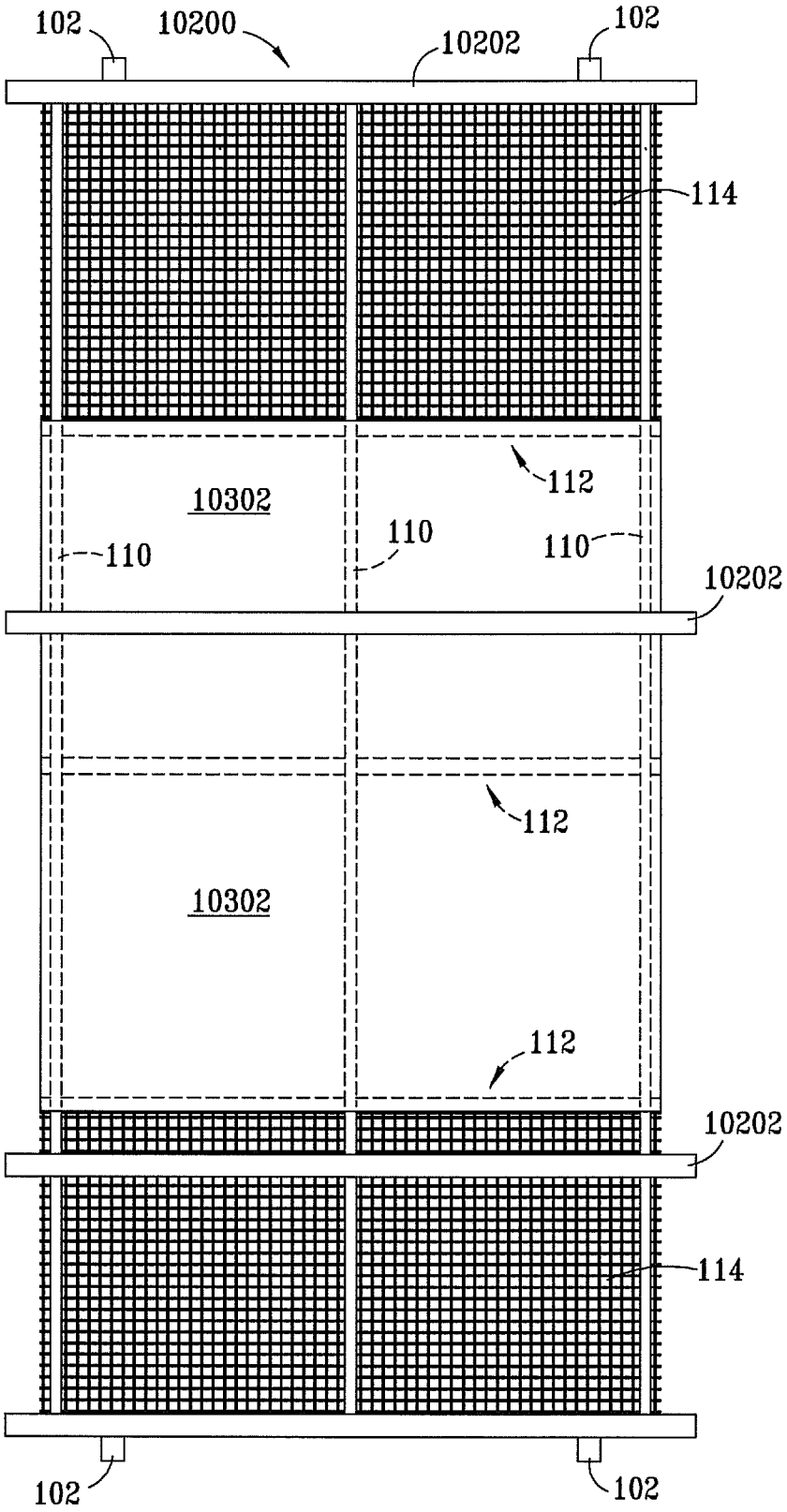
FIG. 103 presents a plan view of the fence system of FIG. 102.
Figure 104:
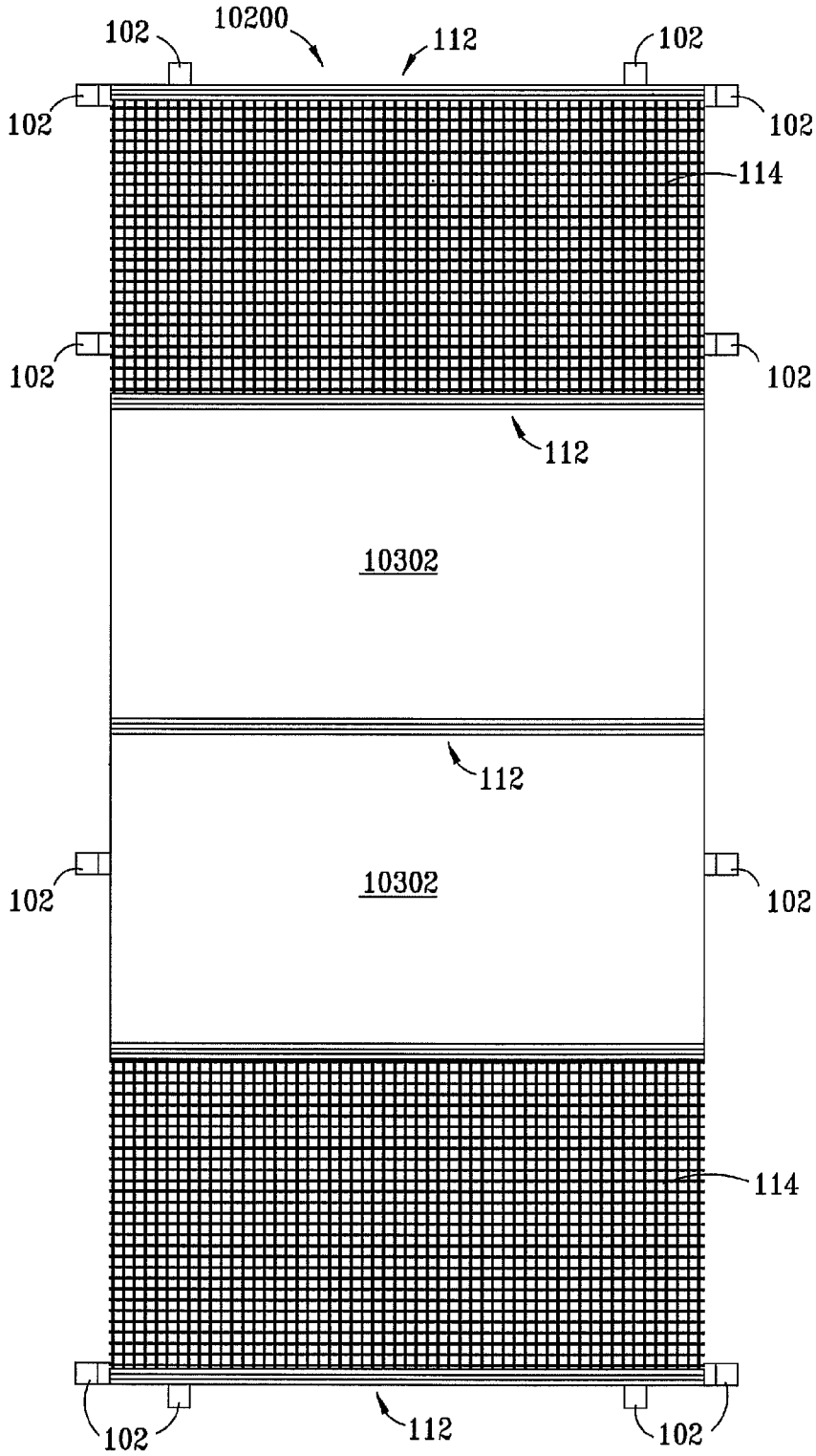
FIG. 104 presents a bottom view of the fence system of FIG. 102.

FIGS. 102-114 exemplify various views of an enclosure 10200 configured in accordance with principles of the present invention, for preventing persons on the inside from getting out, as in an exercise pen in a correctional institution. Referring to FIG. 102, a site plan view is shown of an overall structure for the enclosure 10200. As shown, the enclosure 10200 defines a structure having twelve posts 102 and four rafters 10202 (shown in dashed outline) extending between eight of the posts 102, though more or less posts and rafters may be utilized as suitable or desirable. Three rails 110 (shown in dashed outline, it being understood that more or less rails may be utilized as desired), extend perpendicularly across the rafters 10202. As shown more clearly in FIGS. 103 and 104, viewed as a plan view from above and below, respectively, union strips 112 extend perpendicularly across the rails 110. Infill material 114 and a solid sheet of material (e.g., aluminum or the like) 10302 extends between, and is retained by, union strips 112, and is preferably further retained to the rails 110 by clips, such as clips 8102, to thereby secure the top of the enclosure 10200.

Figure 105:
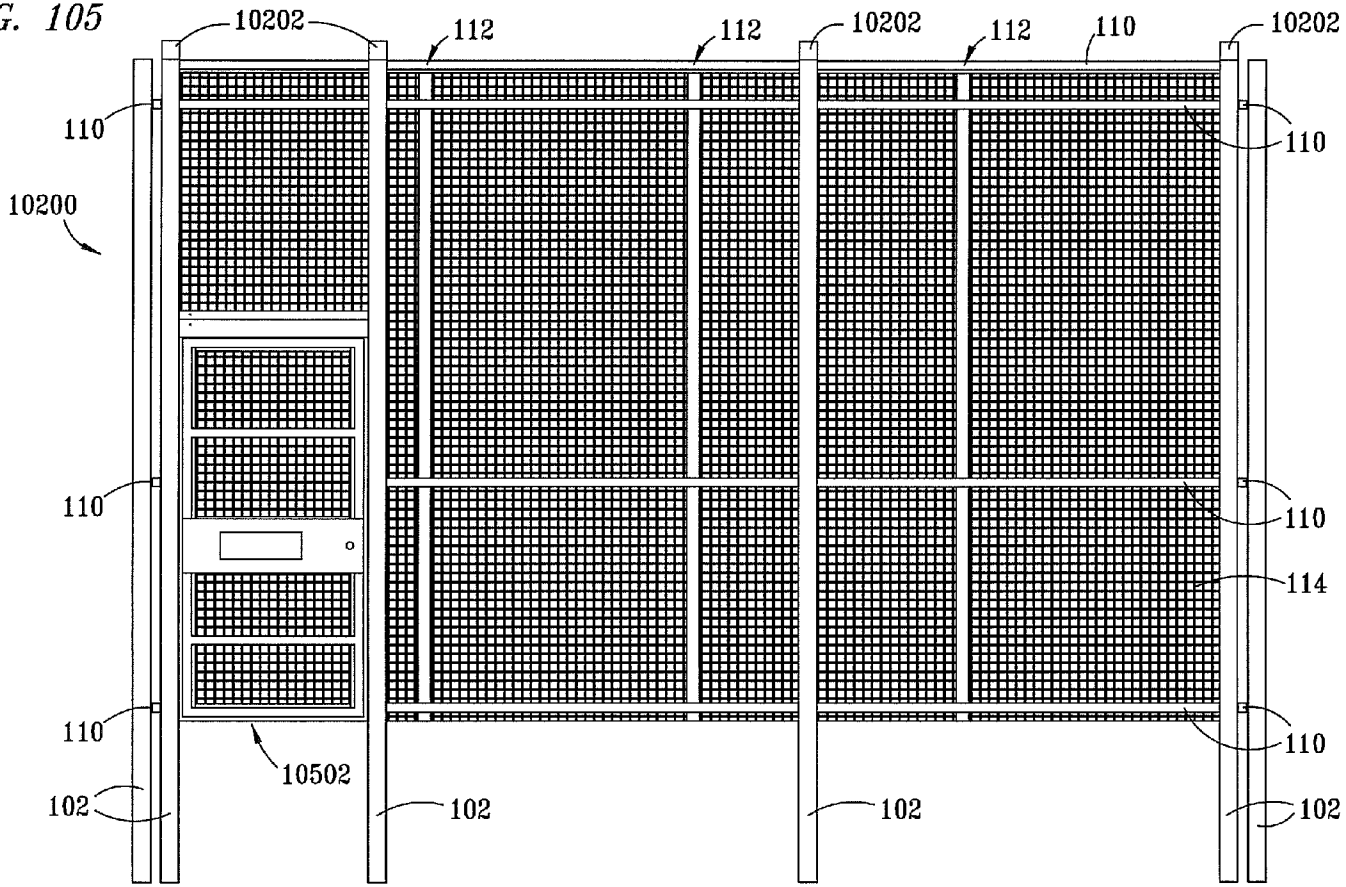
FIG. 105 presents an elevation view of the fence system of FIG. 102 taken along the line 105-105 of FIG. 102.
Figure 106:
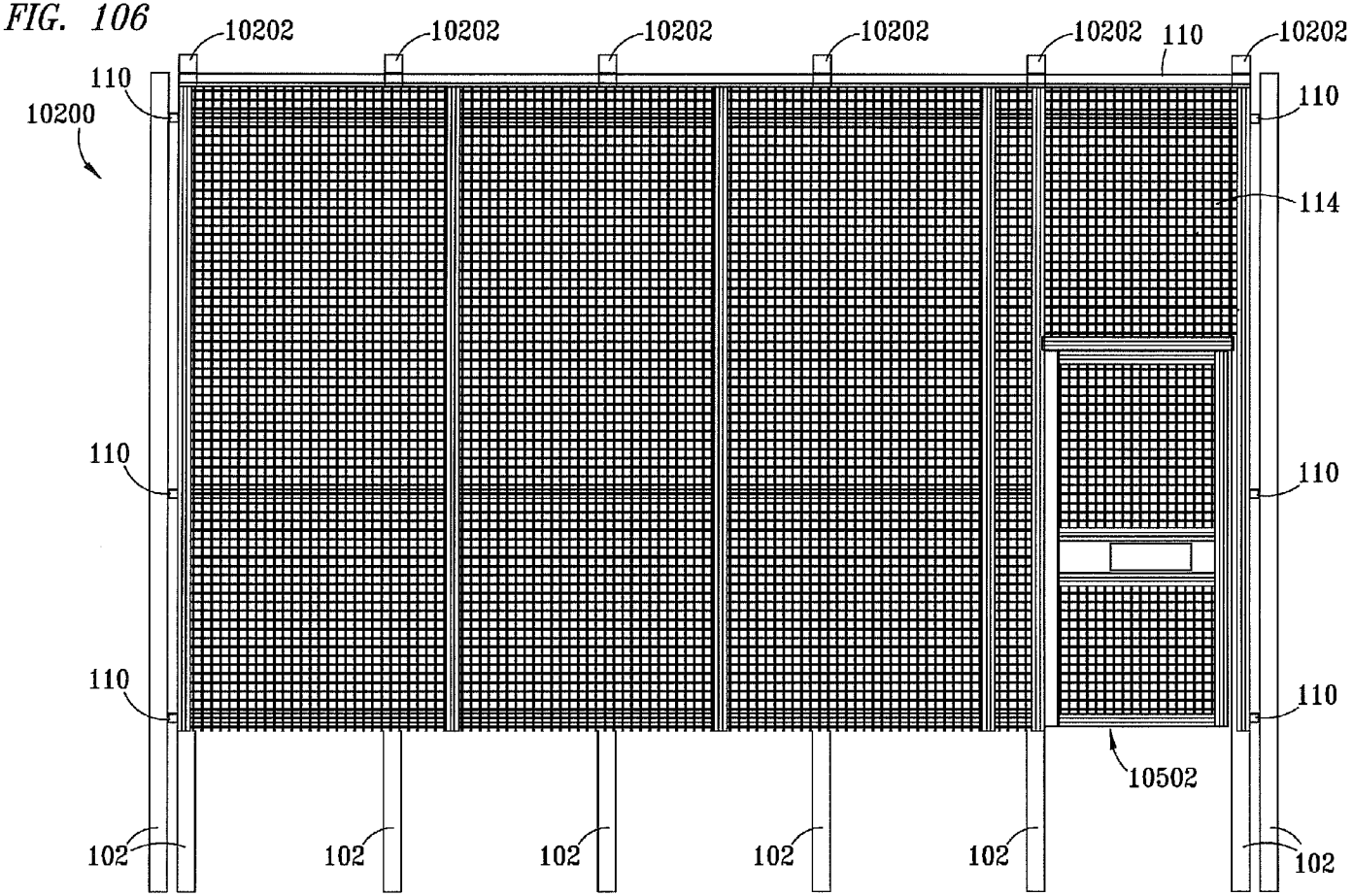
FIG. 106 presents an elevation view of the fence system of FIG. 102 taken along the line 106-106 of FIG. 102.

FIGS. 105 and 106 depict one side of the enclosure 10200, viewed from the exterior and interior sides of the enclosure, respectively. As shown therein, the enclosure 10200 is preferably provided with a gate 10502, discussed in further detail below with respect to FIG. 113. It is noted that posts 102 extend below the lower edge of the infill material 114 for being embedded in ground or a concrete slab.

Figure 107:
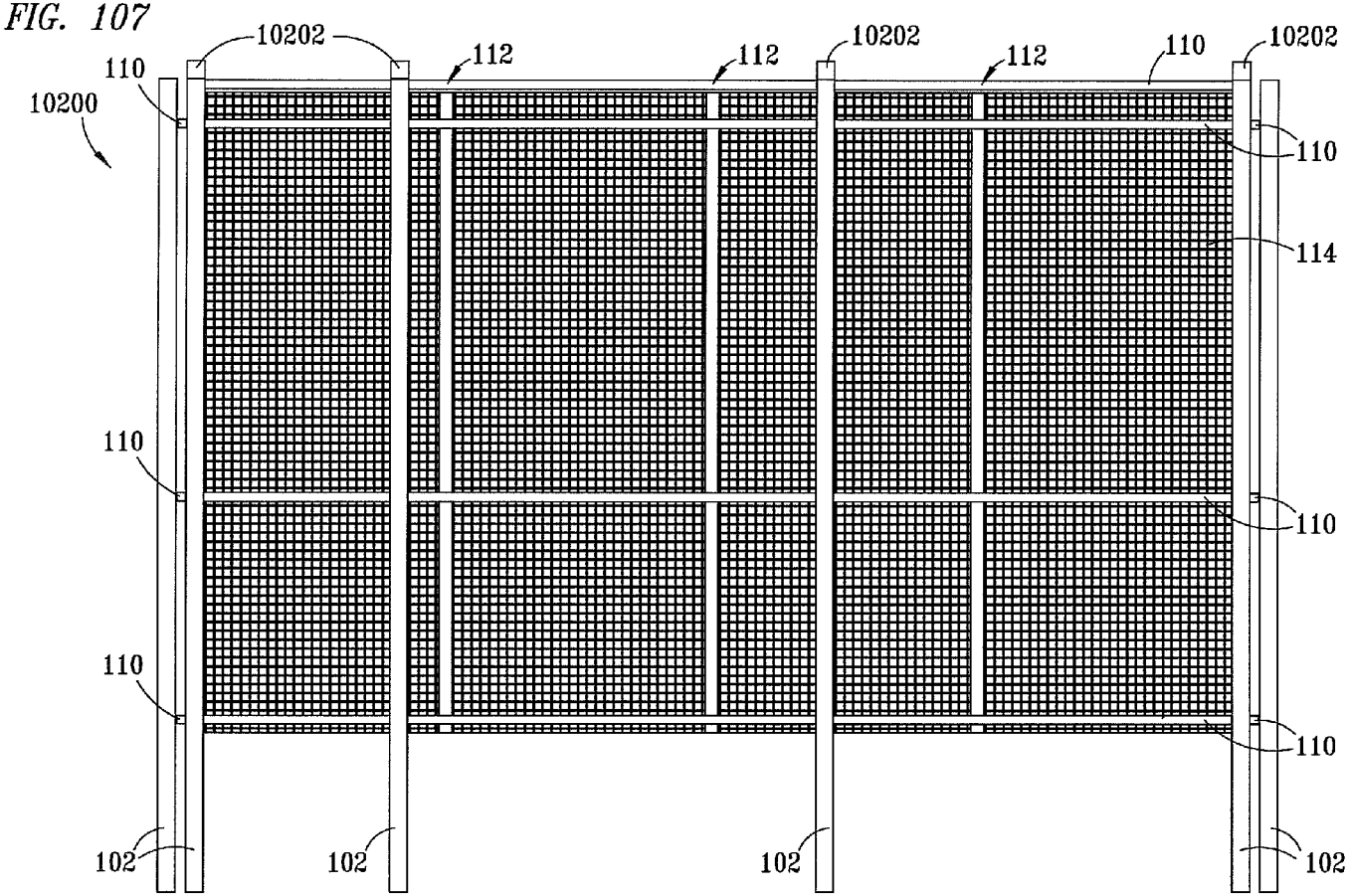
FIG. 107 presents an elevation view of the fence system of FIG. 102 taken along the line 107-107 of FIG. 102.
Figure 108:
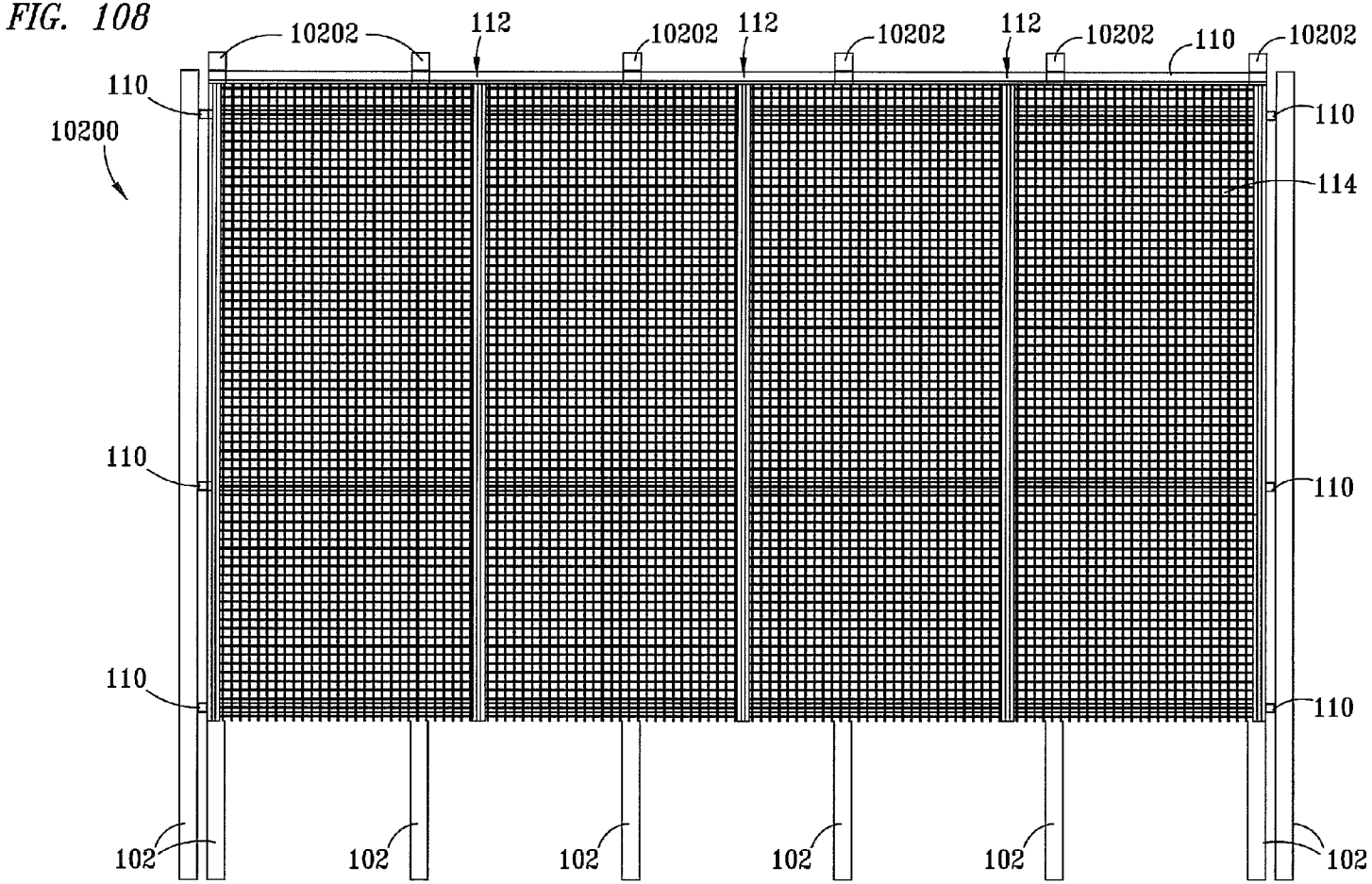
FIG. 108 presents an elevation view of the fence system of FIG. 102 taken along the line 108-108 of FIG. 102.

FIGS. 107 and 108 depict a side of the enclosure 10200 opposite the side depicted in FIGS. 105 and 106, viewed from the exterior and interior sides of the enclosure, respectively.

Figure 109:
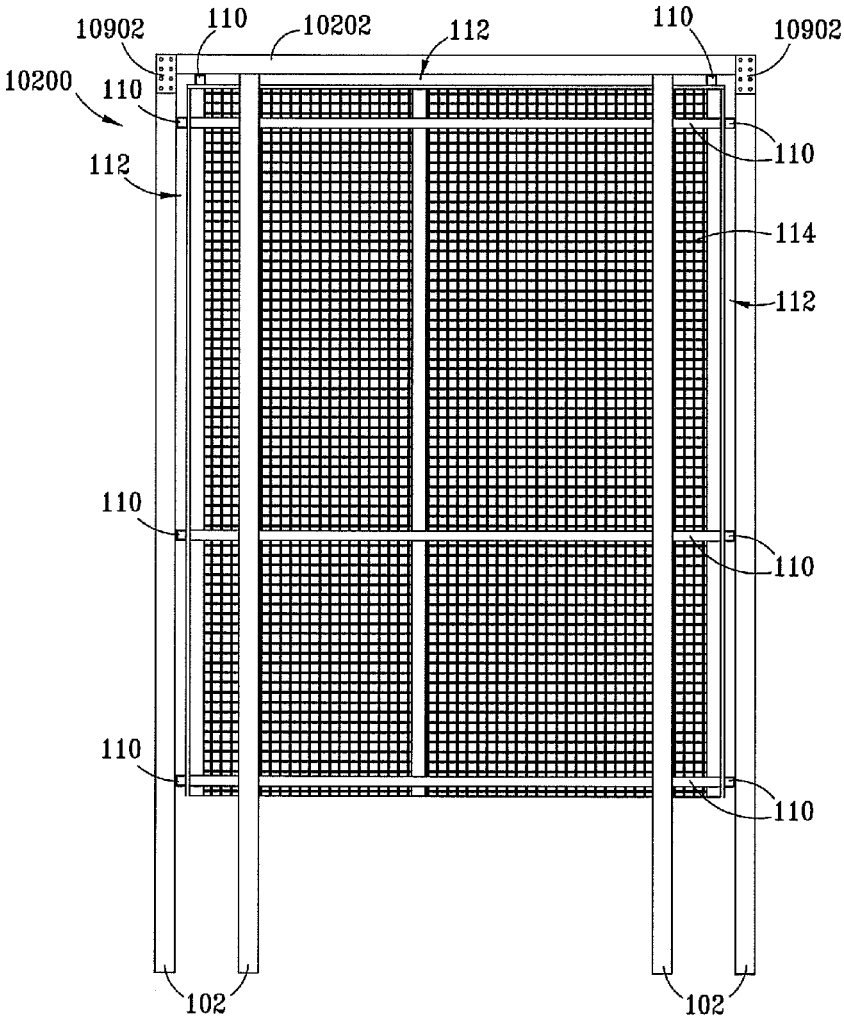
FIG. 109 presents an elevation view of the fence system of FIG. 102 taken along the line 109-109 of FIG. 102.
Figure 110:
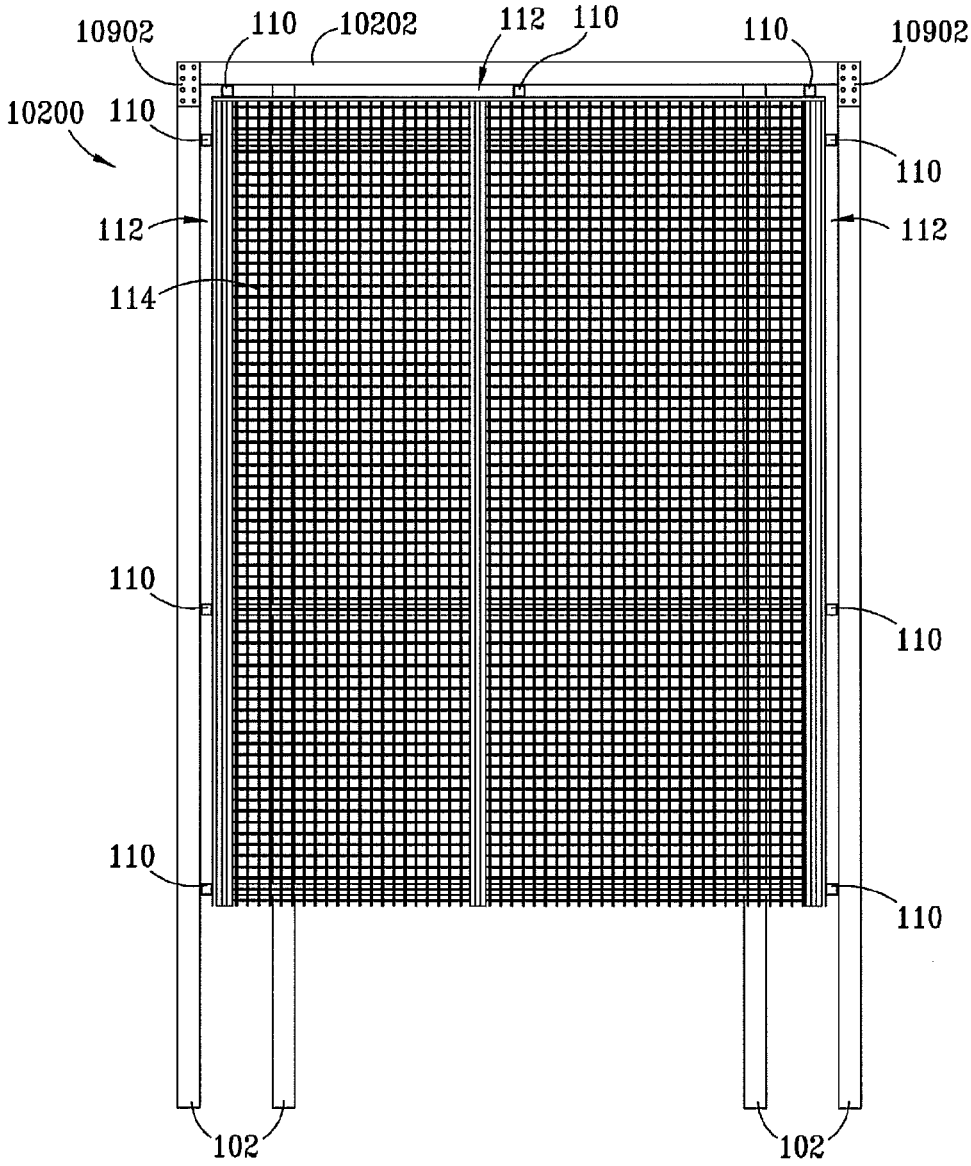
FIG. 110 presents an elevation view of the fence system of FIG. 102 taken along the line 110-110 of FIG. 102.

FIGS. 109 and 110 depict one end of the enclosure 10200, viewed from the exterior and interior sides of the enclosure, respectively. As shown therein, rafters 10202 are preferably mounted and secured to posts 102 via a rafter-post plate 10902, discussed below in further detail with respect to FIG. 116.

Figure 111:
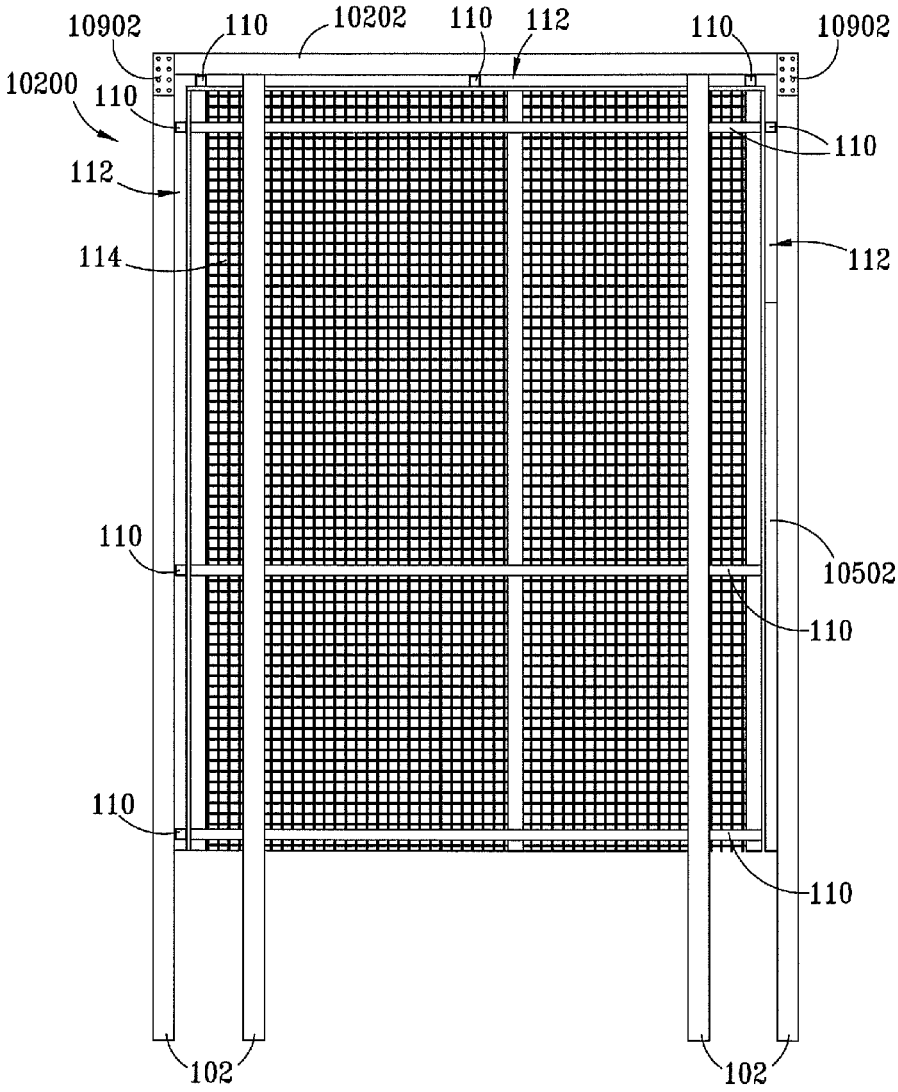
FIG. 111 presents an elevation view of the fence system of FIG. 102 taken along the line 111-111 of FIG. 102.
Figure 112:
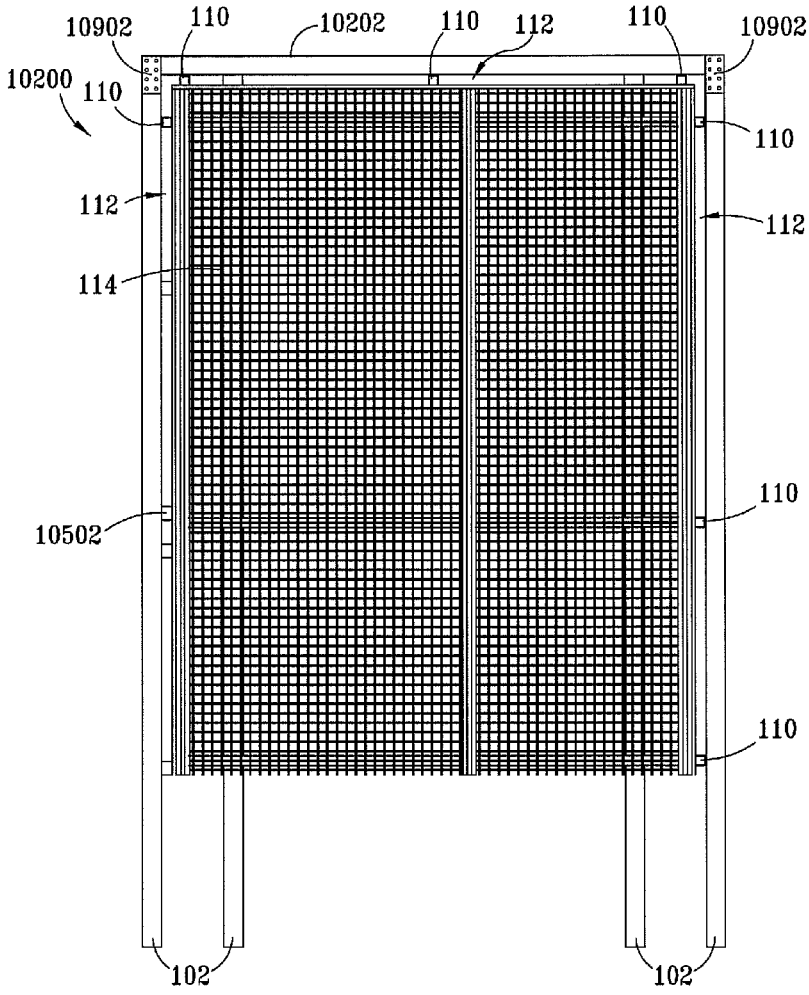
FIG. 112 presents an elevation view of the fence system of FIG. 102 taken along the line 112-112 of FIG. 102.

FIGS. 111 and 112 depict an end of the enclosure 10200 opposite the side depicted in FIGS. 109 and 110, viewed from the exterior and interior sides of the enclosure, respectively.

Figure 113:
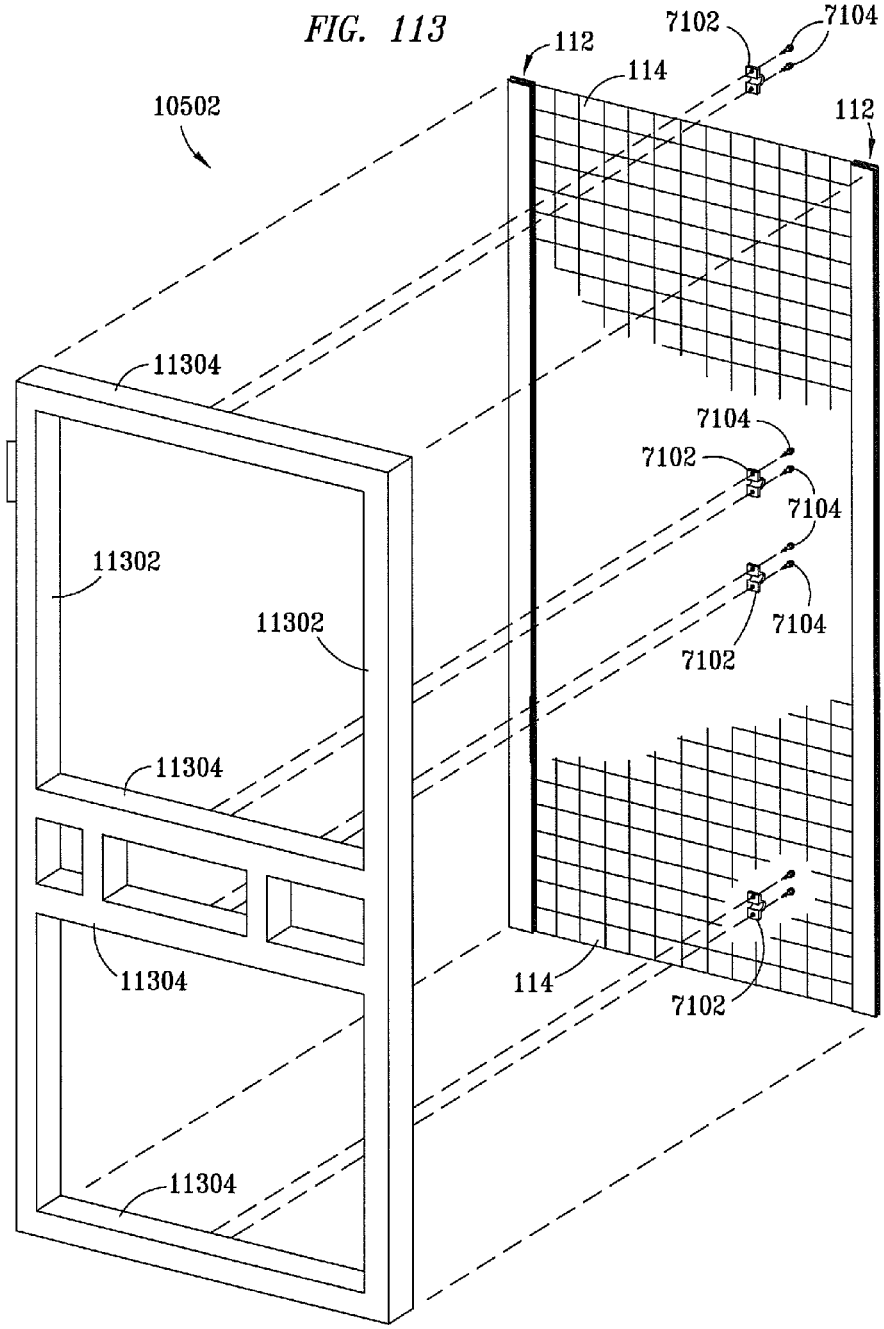
FIG. 113 exemplifies an elevation view of a gate adaptable for use with the fence system of FIG. 102.

FIG. 113 exemplifies, without limitation, details of the structure of the gate 10502 used in conjunction with the enclosure 10200, as described above with respect to FIGS. 105-106. The gate 10502 is sized and configured as needed in a conventional manner. More specifically, the gate 10502 comprises vertical structural members 11302 connected together via horizontal structural members 11304 in a conventional manner. Union strips 112 are preferably positioned on the vertical members 11302, and, as described above, infill material 114 is positioned within channels 112*a* of the union strips 112, and further secured thereto via a suitable clamp, such as described above with respect to FIGS. 71-88, exemplified as bracket 7102, positioned on a horizontal member 11304 intermediate the union strips 112.

Figure 114:
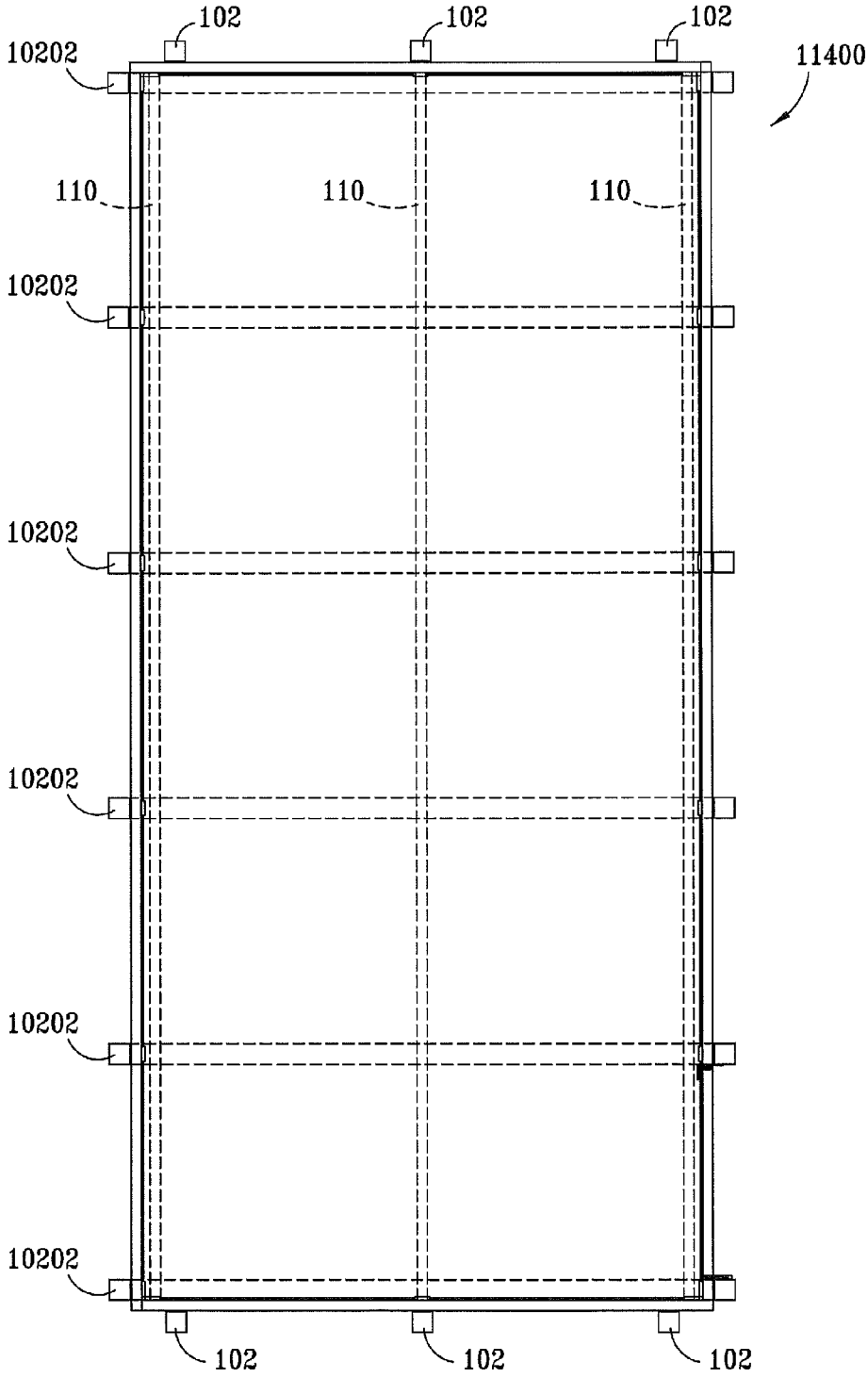
FIG. 114 exemplifies a site plan of a second embodiment of a fence system configured as an enclosure having infill material positioned on the interior of the enclosure and extending across the top of the enclosure in accordance with principles of the present invention.
Figure 115:
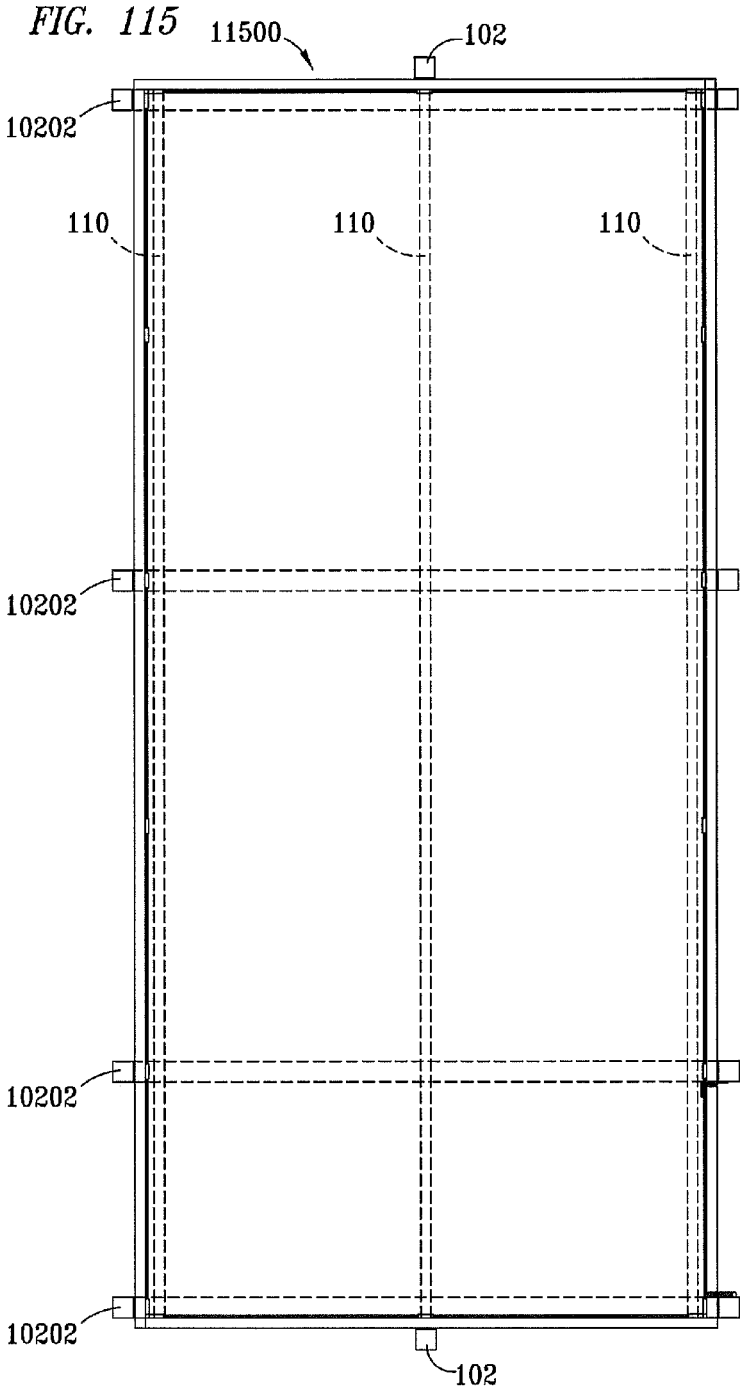
FIG. 115 exemplifies a site plan of a third embodiment of a fence system configured as an enclosure having infill material positioned on the interior of the enclosure and extending across the top of the enclosure in accordance with principles of the present invention.

FIGS. 114 and 115 depict two site plans, alternative to the site plan depicted in FIG. 102, which exemplify alternative embodiments of enclosure 10200 which may be configured in accordance with principles of the present invention. More specifically, FIGS. 114 and 115 exemplify, respectively, how fewer or additional rafters 10202 and posts 102 (not all of which are shown) may be utilized with and distributed about the enclosure.

Figure 116:
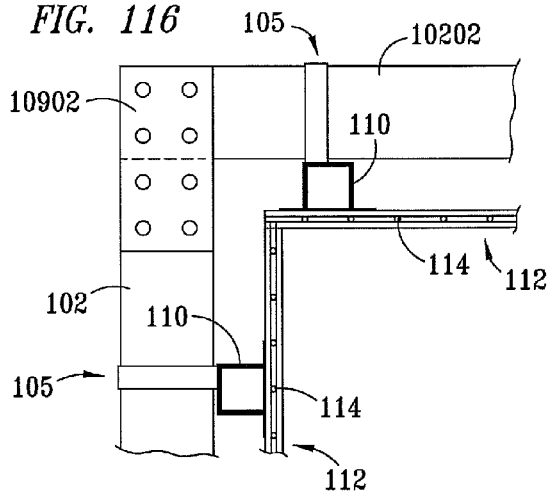
FIG. 116 depicts an elevation view of one preferred embodiment for securing a rafter to a post of an enclosure of FIGS. 102-115.

FIG. 116 exemplifies one preferred embodiment of a rafter-post plate 10902 that may be utilized to secure a rafter 10202 to a post 102. The plate 10902 is preferably a conventional flat plate attached via conventional fasteners (e.g., bolts and nuts) to each respective rafter 10202 and post 102. As also shown in FIG. 116, rails 110, channels 112, and infill material 114, are secured to the post 102 and rafter 10202 as described above with respect to FIGS. 1-101.

Figure 117:
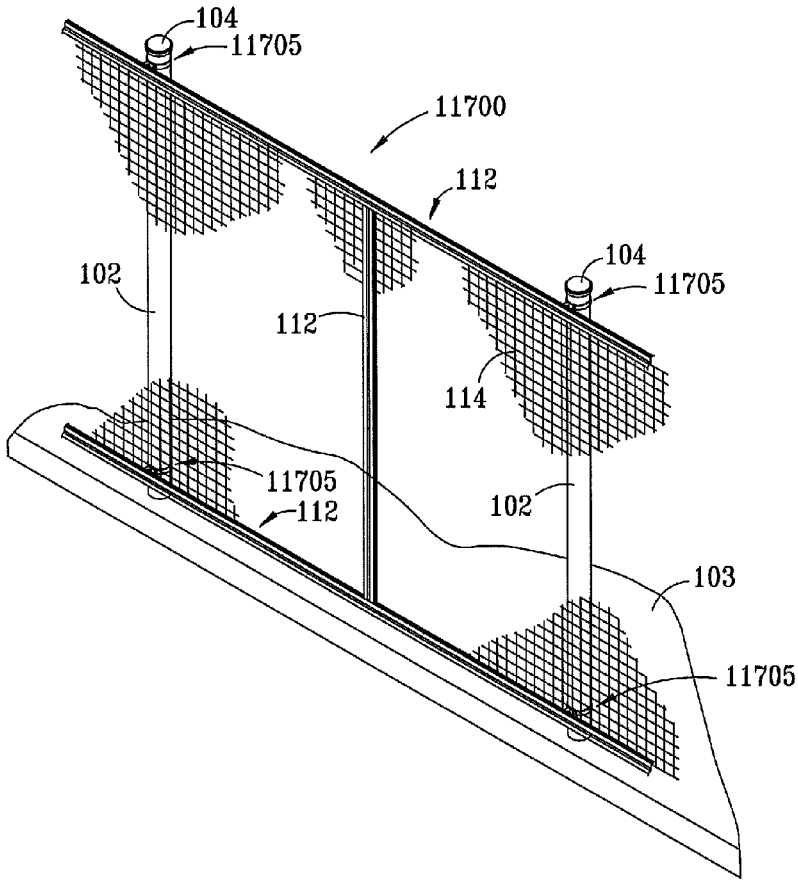
FIG. 117 depicts an alternate embodiment of the fence system of the present invention wherein union strips are secured horizontally directly to posts.

FIG. 117 depicts a fence system 11700 wherein union strips 112 are attached horizontally and directly to the posts 102 using channel hangers 11705 substantially similar to the rail hangers 105 (FIGS. 3-5, 19, and 23-52), but adapted for supporting horizontal union strips 112 without using rails 110. Further to FIG. 117, vertically oriented unions strips 112 may optionally be utilized to join or terminate vertical edges of infill material 114. FIGS. 118 and 119 have been discussed above in connection with FIG. 14.

Figure 120:
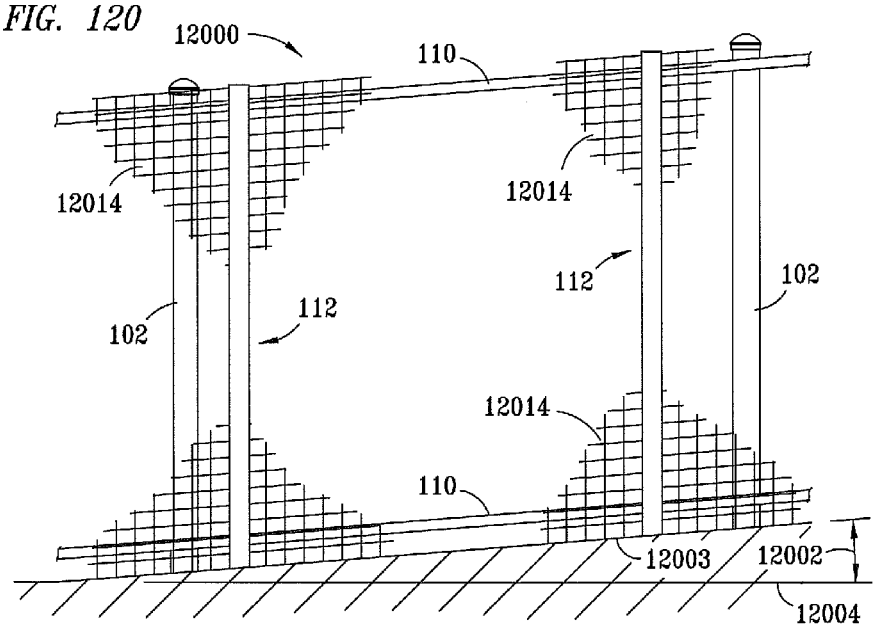
FIG. 120 presents an elevation view of an alternate embodiment of the present invention adapted for non-horizontal grades.

FIG. 120 depicts an embodiment 12000 having, infill material 12014, such as woven wire mesh, may be utilized having non-vertical wires that may be canted at an angular deviation 12002 from a horizontal plane 12004, while permitting the vertical wires remain substantially vertical, to thereby facilitate implementation of the fence system of the present invention on a graded surface 12003, corresponding to the substantially horizontal surface 103 discussed above with respect to FIGS. 1 and 2.

Figure 121:
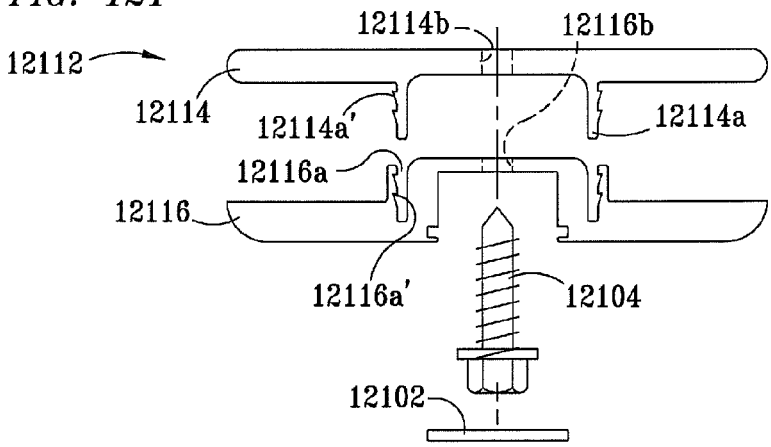
FIG. 121 presents an exploded plan view of an alternate embodiment of a union strip embodying features of the present invention for securing wire mesh to a fence system.
Figure 122:
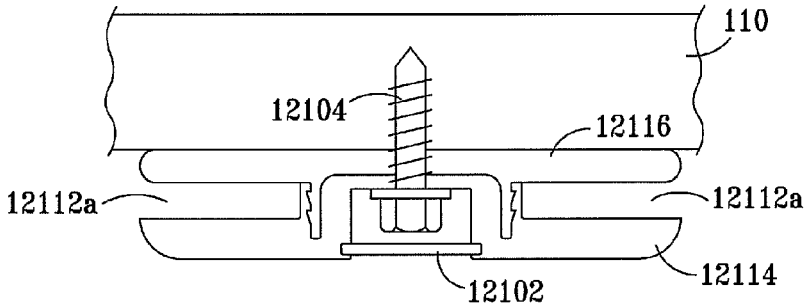
FIG. 122 presents an assembled plan view of the union strip of FIG. 121.
Figure 123:
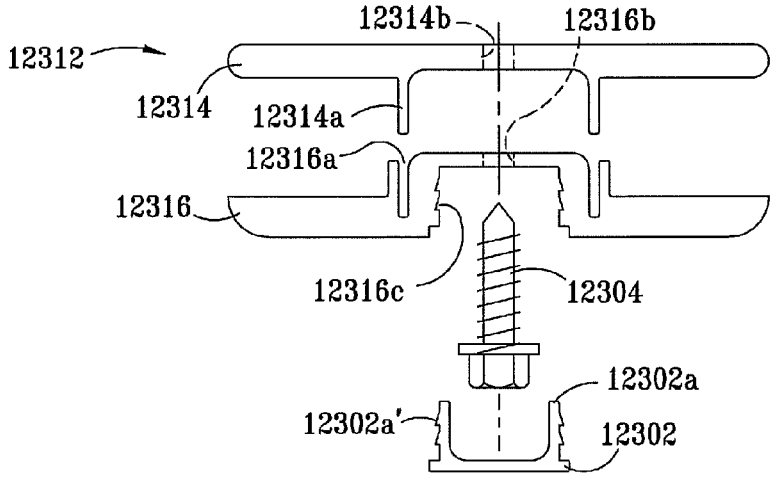
FIG. 123 presents an exploded plan view of a second alternate embodiment of a union strip embodying features of the present invention for securing wire mesh to a fence system.
Figure 124:
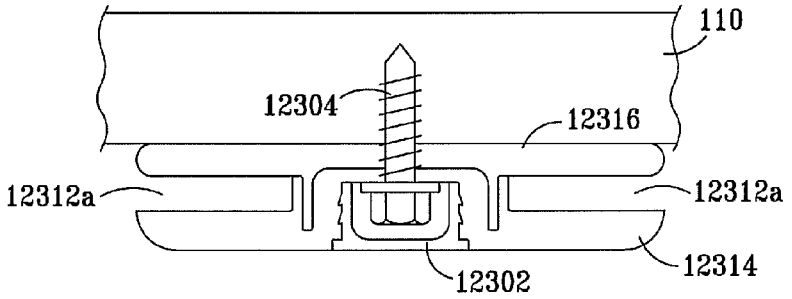
FIG. 124 presents an assembled plan view of the union strip of FIG. 123.

FIGS. 121 and 122 depict an embodiment of union strips designated by the reference numeral 12112 similar to the union strip 112 discussed above, with particular reference to FIG. 7, but is apportioned between a relatively flat portion 12114 and a shaped portion 12116. The flat portion 12114 includes engagement ribs 12114*a*, and the shaped portion 12116 includes engagement slots 12116*a* configured for matingly receiving the engagement ribs 12114*a*. Each of the engagement ribs 12114*a* and engagement slots 12116*a* preferably also includes respective ratchet teeth 12114*a*' and 12116*a*' for facilitating a secure fit when assembled together, as shown in FIG. 122. Alternatively, the engagement ribs 12114*a* and slots 12116*a* may be fabricated without the ratchet teeth. Holes 12114*b* and 12116*b* are defined for permitting passage of a fastener 12104, such as a screw, through the union strip 12112 into a rail 110 to thereby secure the union strip to a rail. A cover 12102 is provided for fitting into grooves 12116*c* and covering the fastener 12104 to preclude removal of the fastener thereof. As depicted in FIGS. 123-124, a cover 12302 and shaped portion 12316 are configured with ratchet teeth 12302*a*' (on engagement rib 12302*a*) and 12316*c* similarly as discussed above with respect to FIG. 7. It is understood that ratchet teeth may also be provided in a single union strip in connection with the engagement ribs 12114*a*, engagement slots 12116*a*, and the cover 12302 and 12316*c*.

Figure 125:
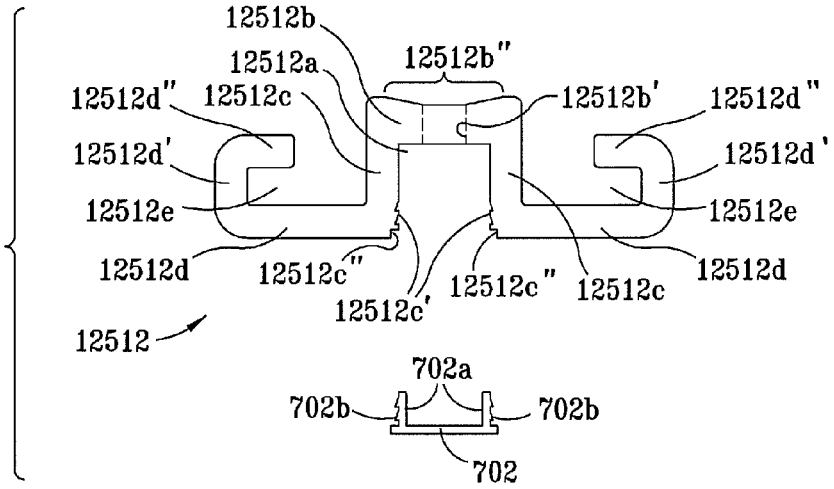
FIG. 125 is a plan view of an alternative embodiment of a union strip according to principles of the present invention.
Figure 126:
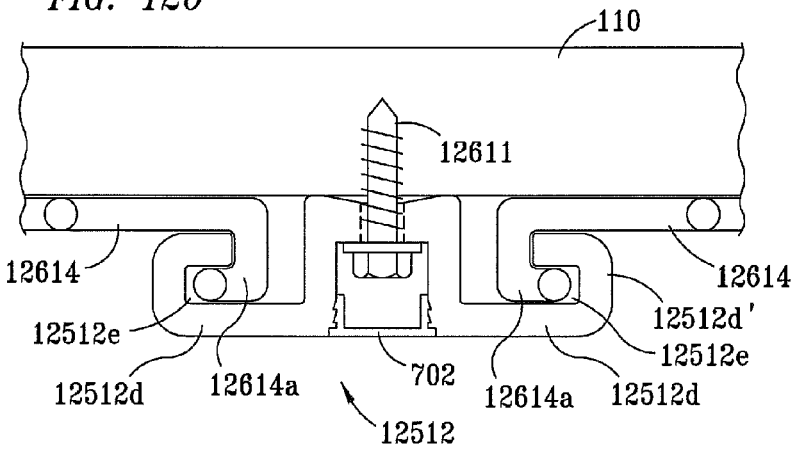
FIG. 126 is a plan view of the union strip of FIG. 122, presented with a cover secured thereto.

FIGS. 125 and 126 exemplify a further variation of the present invention, wherein a union strip 12512 depicted in FIG. 125 includes a center channel 12512*a* defined by a base portion 12512*b* and two walls 12512*c*. The base portion 12512*b* preferably also defines one or more holes 12512*b*' through which one or more fasteners (FIG. 126) may pass, and a concave radius 12512*b*" opposing the center channel 12512*a* for providing a spring action effective for enabling the one or more fasteners to be securely tightened and, for certain configurations wherein a union strip directly abuts a post 102, for enabling the union strip 12512 to seat against a post 102. The walls 12512*c* preferably include ratchet teeth 12512*c*' for receiving the cover strip 702 having projections 702*a* and ratchet teeth 702*b* preferably configured for matingly engaging the ratchet teeth 12512*c*', thereby precluding access to the center channel 12512*a* and fasteners, and enhancing security of the fence system 100. The walls 12512*c* further preferably define recesses 12512*c*" into which the cover 702 may be seated.

A flange 12512*d* extends outwardly from the end of each wall 12512*c*. Each flange 12512*d* further includes a first portion 12512*d*' that extends downwardly (as viewed in FIG. 125) and a second portion 12512*d*" that extends inwardly (as viewed in FIG. 125) back toward the channel 12512*a*, thereby forming a U-shaped flange 12512*d* defining a channel 12512*e*. Referring to FIG. 126, infill material 12614, preferably in the form of sheeted mesh infill material, defines U-shaped edges 12614*a* configured for matingly engaging the flange 12512*d*, for being received by and secured within the channel 12512*e*.

With reference to FIG. 126, in one preferred method of assembly, infill material 12614 is preferably secured, e.g., to one or more rails 110 and/or, optionally, another end of the infill material (not shown) is secured to another union strip 12512 (not shown). One channel 12512*e* of the union strip 12512 is then preferably positioned over a U-shaped edge 12614*a* of the infill material 12614, and the union strip is pulled away from the infill material 12614 until the edge

12614*a* of the infill material 12614 is firmly interlocked in a channel 12512*e* of the union strip 12512. An edge 12614*a* of further infill material 12614 is preferably positioned in a second channel 12512*e* of the union strip 12512 and urged against the union strip to thereby firmly interlock the edge 12614*a* of the further infill material 12614 into the second channel 12512*e* of the union strip 12512. With the edges 12614*a* of both infill materials 12614 firmly interlocked in the channels 12512*e*, the union strip 12512 is preferably secured to the one or more rails 110 by way of one or more fasteners 12611, such as hex washer head self-drilling screws (i.e., TEK screws), extended through the one or more holes 12512*b*' into the one or more rails 110. The fastener 12611 is preferably tightened sufficiently to incur a spring action from the concave portion 12512*b*" of the union strip to 12512 to secure the fastener in place, notwithstanding thermal fluctuations and expansions and contractions, aging, and the like, of the respective materials. The cover 702 is preferably positioned over the fastener 12611 and center channel 12512*a* to inhibit removal of the fastener. It is understood that alternate methods of assembly may be employed, for example, by securing a union strip 12512 to one or more rails 110, and then securing the edges of infill material 12614 to the U-shaped channels 12512*e* of the union strips 12512.

Figure 127:
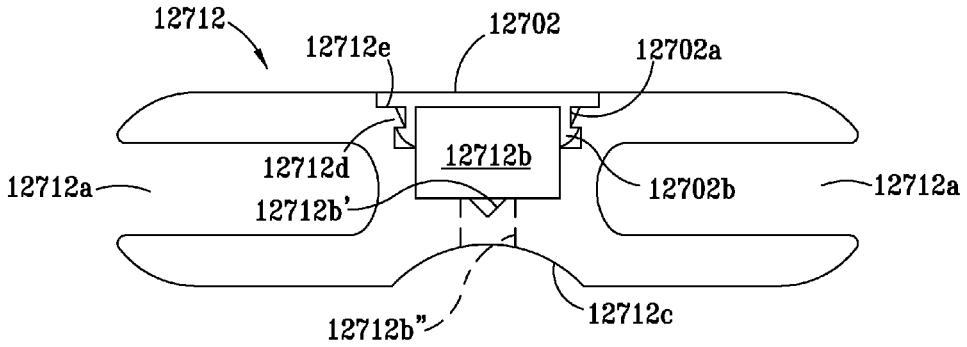
FIG. 127 exemplifies a plan view of an alternate embodiment of a union strip embodying features of the present invention.

FIG. 127 exemplifies a still further variation of the present invention, wherein a union strip 12712 is depicted, in plan view, for coupling together edges of two pieces of infill material 114 (discussed above, not shown in FIG. 127) and/or for securing infill material 114 to a fence system embodying features of the present invention. As shown therein, the union strip 12712 is similar to the union strip 112 and, accordingly, preferably defines two channels 12712*a*, though the union strip 12712 may alternatively include but a single channel 12712*a* where suitable, such as at a termination point or corner of a fence. A center channel 12712*b* is preferably formed in the union strip 12712 between the channels 12712*a*. However, unlike the union strip 112, in place of a hole (analogous to the hole 112*b*') formed in the center channel 12712*b*, a notch 12712*b*' is preferably defined, which may be used for facilitating the drilling of a hole 12712*b*" (shown in dashed outline) as needed, and/or guiding the passage of a fastener, such as the fastener 111, through the center channel 12712*b* to a rail 110 (not shown in FIG. 127), to thereby secure the union strip 112 to the rail 110. Like the union channel 112, the center channel 12712*b* preferably includes at least one ratchet tooth 12712*d* and an extended opening portion 12712*e*. A cover strip 12702 preferably includes two projections 12702*a*, each of which projections includes one ratchet tooth 12702*b* preferably configured for matingly engaging the center channel 12712*b* and a corresponding ratchet tooth 12712*d*, to thereby preclude access to the interior of the channel 12712*b* and enhancing security of the fence system 100. The union strip 12712 preferably also defines a concave radius 12712*c* opposing the center channel 12712*b* for providing a spring action effective for enabling a fastener 111 (e.g., FIGS. 5, 17, 18) to be tightened to thereby further secure the union strip 12712 to a rail, such as designated by the reference numeral 110. In operation, prior to securing the cover strip 12702 over the center channel 12712*b*, a fastener 111 may be inserted into the channel 12712*b*, positioned on the notch 12712*b*', and threaded through the union strip 12712 and concave radius 12712*c* into a structure, such as a rail 110. Alternatively, a hole 12712*b*" (shown in dashed outline) may be drilled to facilitate insertion of a fastener 111 through the union strip 12712. The cover 702 is preferably positioned over the fastener 111 and center channel 12712*b* to inhibit removal of the fastener. Infill material 114 (not shown) is preferably positioned in the channels 12712*a* in a manner similar to that described above with respect to, by way of example, FIGS. 3-4.

Figure 128:
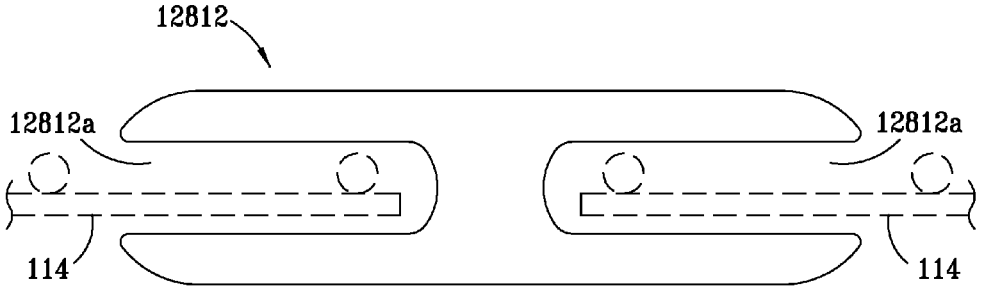
FIG. 128 exemplifies a plan view of a further alternate embodiment of a union strip embodying features of the present invention.

FIG. 128 exemplifies a still further variation of the present invention, wherein a union strip 12812 is depicted, in plan view, for coupling together edges of two pieces of infill material 114 (e.g., welded wire sheet, also referred to herein as welded wire mesh and welded wire panel) in accordance with principles of the present invention. As shown therein, the union strip 12812 preferably defines two opposing channels 12812*a* configured for receiving edges of two pieces of infill material 114, though the union strip 12812 may alternatively include but a single channel 12812*a* where suitable, such as at a termination point or corner of a fence. In operation, an edge of each of two pieces of infill material 114 is inserted into a respective one of the two channels 12812*a*. The union strip 12812 and/or the infill material 114 is then preferably secured to a rail, such as a rail 110, as discussed by way of example in further detail below with respect to FIGS. 130-134.

Figure 129:
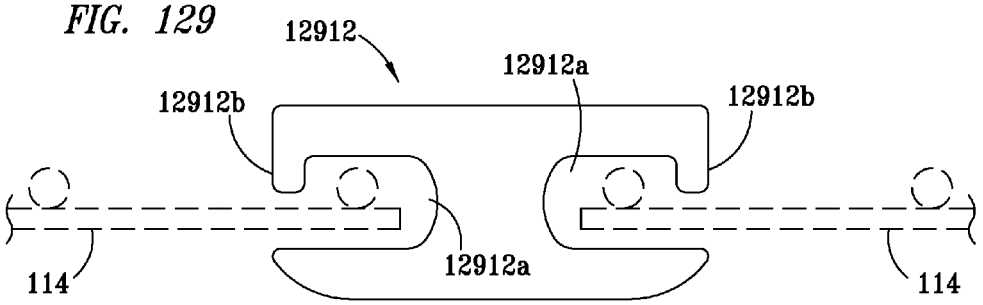
FIG. 129 exemplifies a plan view of a still further alternate embodiment of a union strip having a flange embodying features of the present invention.

FIG. 129 exemplifies a still further variation of the present invention, wherein a union strip 12912, similar to the union strip 12812 (FIG. 128), is depicted, in plan view, for coupling together, in accordance with principles of the present invention, edges of two pieces of infill material 114 (e.g., welded wire sheet), the infill material 114 preferably comprising cross-wires 114*a* (extending perpendicular to the drawing sheet, as viewed in FIG. 129) formed on one side of the infill material. As shown therein, the union strip 12912 preferably defines two opposing channels 12912*a* configured for receiving edges of two pieces of infill material 114, though the union strip 12912 may alternatively include but a single channel 12912*a* where suitable, such as at a termination point or corner of a fence. Each channel 12912*a* further comprises one flange 12912*b* extending inwardly toward a respective channel 12912*a* for facilitating retention of infill material 114 in a channel 12912*a*. More specifically, the infill material 114 is positioned so that movement of the cross-wire 114*a* is constrained by the flange 12912*b*. In operation, an edge of each of two pieces of infill material 114 is inserted into a respective one of the two channels 12912*a*, for example, by sliding the union strip 12912 longitudinally over the edge of infill material 114, the cross-wire 114*a* being positioned proximate to the flange 12912*b*. The union strip 12912 and/or the infill material 114 is then preferably secured to a rail, such as a rail 110, as discussed by way of example in further detail below with respect to FIGS. 130-134.

Figure 129A:
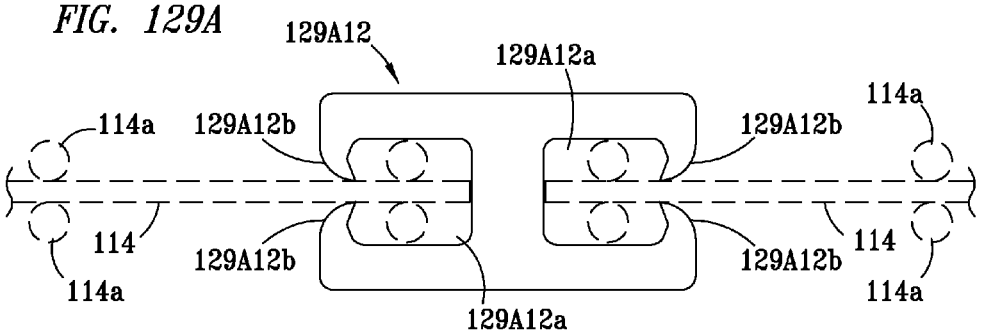
FIG. 129A exemplifies a plan view of a still further alternate embodiment of a union strip having dual flanges embodying features of the present invention.

FIG. 129A exemplifies a still further variation of the present invention, wherein a union strip 129A12, similar to the union strip 12912 (FIG. 129), is depicted, in plan view, for coupling together, in accordance with principles of the present invention, edges of two pieces of infill material 114 (e.g., welded wire sheet), the infill material 114 preferably comprising cross-wires 114*a* (extending perpendicular to the drawing sheet, as viewed in FIG. 129A) formed on both sides of the infill material. As shown therein, the union strip 129A12 preferably defines two opposing channels 129A12*a* configured for receiving edges of two pieces of infill material 114, though the union strip 129A12 may alternatively include but a single channel 129A12*a* where suitable, such as at a termination point or corner of a fence. In contrast to the union strip 12912, each channel 129A12*a* further comprises two flanges 129A12*b* extending inwardly toward a respective channel 129A12*a* for facilitating retention of infill material 114 in a channel 129A12*a*. More specifically, the infill material 114 is positioned so that movement of a cross-wire 114*a* on each side of the infill material is constrained by a respective flange 129A12*b*. In operation, an edge of each of two pieces of infill material 114 is inserted into a respective one of the two channels 129A12*a*, for example, by sliding the union strip 129A12 longitudinally over the edge of infill material 114, a cross-wire 114*a* being positioned proximate to each flange 129A12*b*. The union strip 129A12 and/or the infill material 114 is then preferably secured to a rail, such as a rail 110, as discussed by way of example in further detail below with respect to FIGS. 130-134.

Figure 129C:
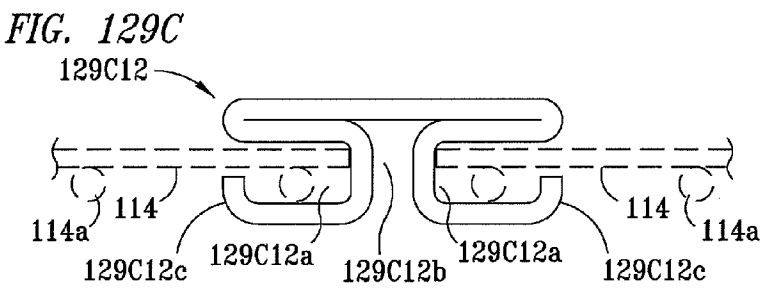
FIG. 129C exemplifies a plan view of a still further alternate embodiment of a union strip fabricated from sheet metal and having a flange in accordance with principles of the present invention.
Figure 129B:
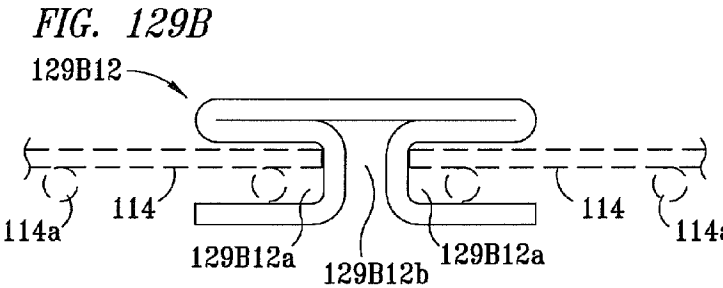
FIG. 129B exemplifies a plan view of a still further alternate embodiment of a union strip fabricated from sheet metal in accordance with principles of the present invention.

FIGS. 129B and 129C are plan views exemplifying a union strip 129B12 and 129C12, respectively, fabricated from sheet metal in accordance with principles of the present invention. The sheet metal is preferably shaped to form two channels 12912*a* configured for receiving in-fill material 114 as described above. A center channel 12912*b* is preferably also defined between the channels 12912*a* for facilitating passage of a fastener therethrough to secure the union strip 129 to one or more rails 110 (not shown). The union strips 129B12 and 129C12 are similar, but for the union strip 129C12 further comprising a flange 12C12*c* formed for more securely constraining infill material 114 having a cross-wire 114*a*. In operation, an edge of each of two pieces of infill material 114 is inserted into a respective one of the two channels 12912*a*, for example, by sliding the union strip 129B12 or 129C12 longitudinally over the edge of infill material 114. With respect to the union strip 129C12, a cross-wire 114*a* is further positioned proximate to each flange 112C12*c*. The union strip 129B12 or 129C12 and/or the infill material 114 is then preferably secured to a rail, such as a rail 110, as discussed by way of example in further detail below with respect to FIGS. 130-134.

Figure 131:
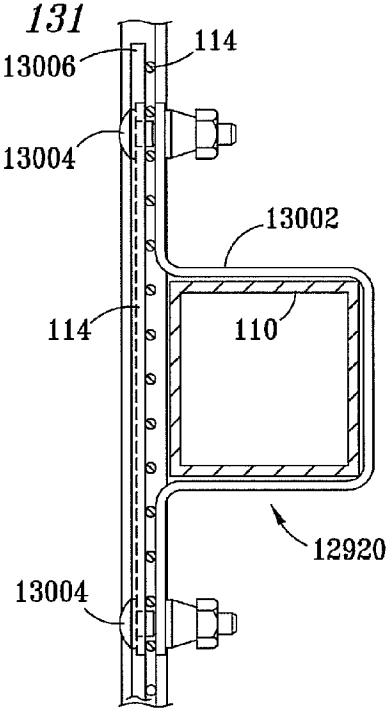
FIG. 131 presents a cross-sectional elevation view of the fence system of FIG. 130 taken along the line 131-131 of FIG. 130.
Figure 130:
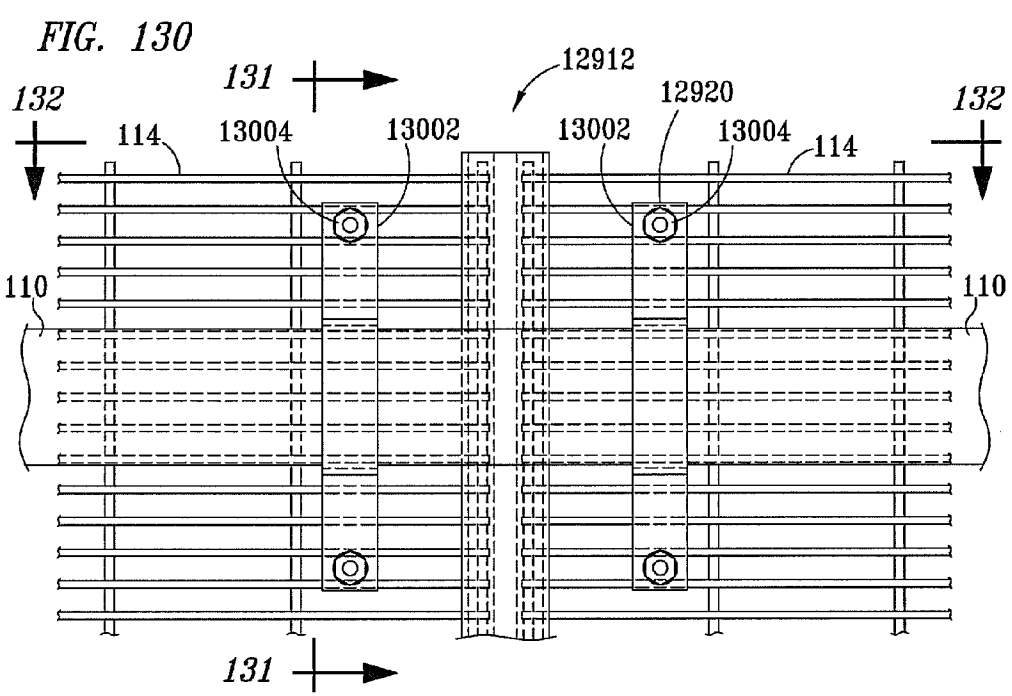
FIG. 130 exemplifies an elevation view of a portion of a fence system incorporating a union strip as depicted in FIG. 128 or FIG. 129.
Figure 132:
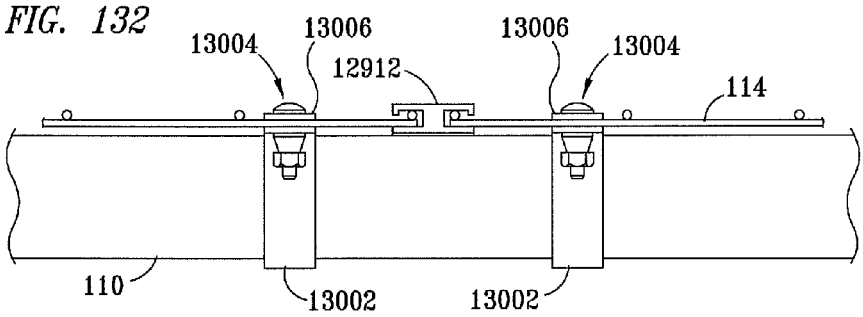
FIG. 132 presents a plan view of the fence system of FIG. 130 taken along the line 132-132 of FIG. 130.

FIGS. 130-132 depict one embodiment of the present invention effective for securing infill material 114 (e.g., welded wire sheet) to a rail 110, particularly two or more pieces of infill material coupled together as described above with respect to any of FIGS. 127-129C, exemplified herein using the union strip 12912, representative of any of union strips 12712, 12812, 12912, 129A12, 129B12, and 129C12. Accordingly, and as best shown in FIG. 131, a first sheet-to-rail strap 13002 is configured for wrapping around three sides of a rail 110 and then seating against infill material 114. A second, cooperating, sheet-to-rail strap 13006 is configured as a substantially flat strap for seating against infill material 114. Each of the straps 13002 and 13006 define two holes through which a fastener 13004 (e.g., as described above with respect to FIGS. 17 and 18) may be extended. In operation, infill material 114, typically coupled to at least one other piece of infill material via a union strip such as 12812 or 12912, is positioned abutting a rail 110. A first strap 13002 is then positioned against the rail 110 and infill material 114, and the second strap 13006 is positioned against an opposing side of the infill material so that holes in the first and second straps are aligned with each other. A fastener 13004 is then extended through each aligned pair of holes to secure the infill material to the rail 110. The infill material 114 is preferably secured at a suitable number of points along one or more rails 110 by additional pairs of first and second straps 13002 and 13006 to further secure the infill material to the one or more rails 110.

Figure 133:
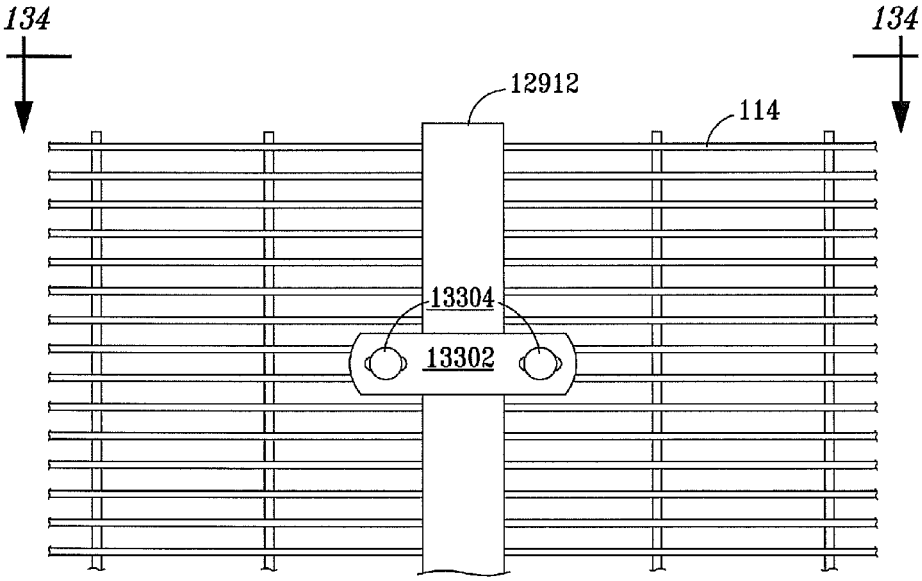
FIG. 133 exemplifies an elevation view of an alternate embodiment of a portion of a fence system incorporating a union strip as depicted in FIG. 128 or FIG. 129.
Figure 134:
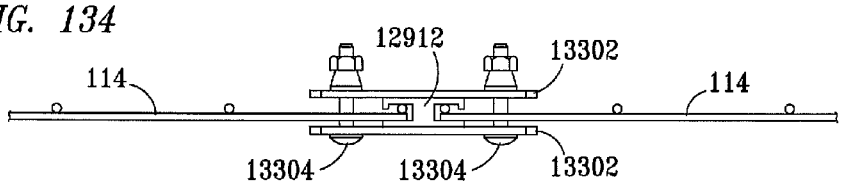
FIG. 134 presents a plan view of the fence system of FIG. 133 taken along the line 134-134 of FIG. 133.

FIGS. 133 and 134 depict an embodiment of the present invention effective for further securing together two pieces of infill material 114 (e.g., welded wire sheet) via a union strip, such as a union strip 12712, 12812, 12912, 129A12, 129B12, and 129C12 described above with respect to FIGS. 128-129C, exemplified herein using the union strip 12912. Accordingly, two substantially flat retension straps 13302 are configured for seating against infill material 114. Each of the straps 13302 define two holes through which a fastener 13304 (e.g., as described above with respect to FIGS. 17 and 18) may be passed. In operation, one piece of infill material 114 is coupled to another piece of infill material via a union strip such as 12912. The infill material 114 is preferably secured to a rail (not shown) by means such as welding or sheet-to-rail straps 13002 and 13006. One strap 13302 is then positioned generally perpendicularly across the union strip, and a second strip 13302 is positioned generally perpendicularly across an opposing side of the union strip, both straps being positioned so that each of two holes defined by each of the straps are aligned with corresponding holes of an opposing strap, thereby comprising two pairs of aligned holes on opposing sides of the union strip. A fastener 13304 is then passed through each aligned pair of holes to secure the infill material to the union strip. The infill material 114 is coupled in such manner at a suitable number of points along the union strip by additional pairs of straps 13302 and 13306 to further secure the two pieces of infill material to each other.

Figure 135:
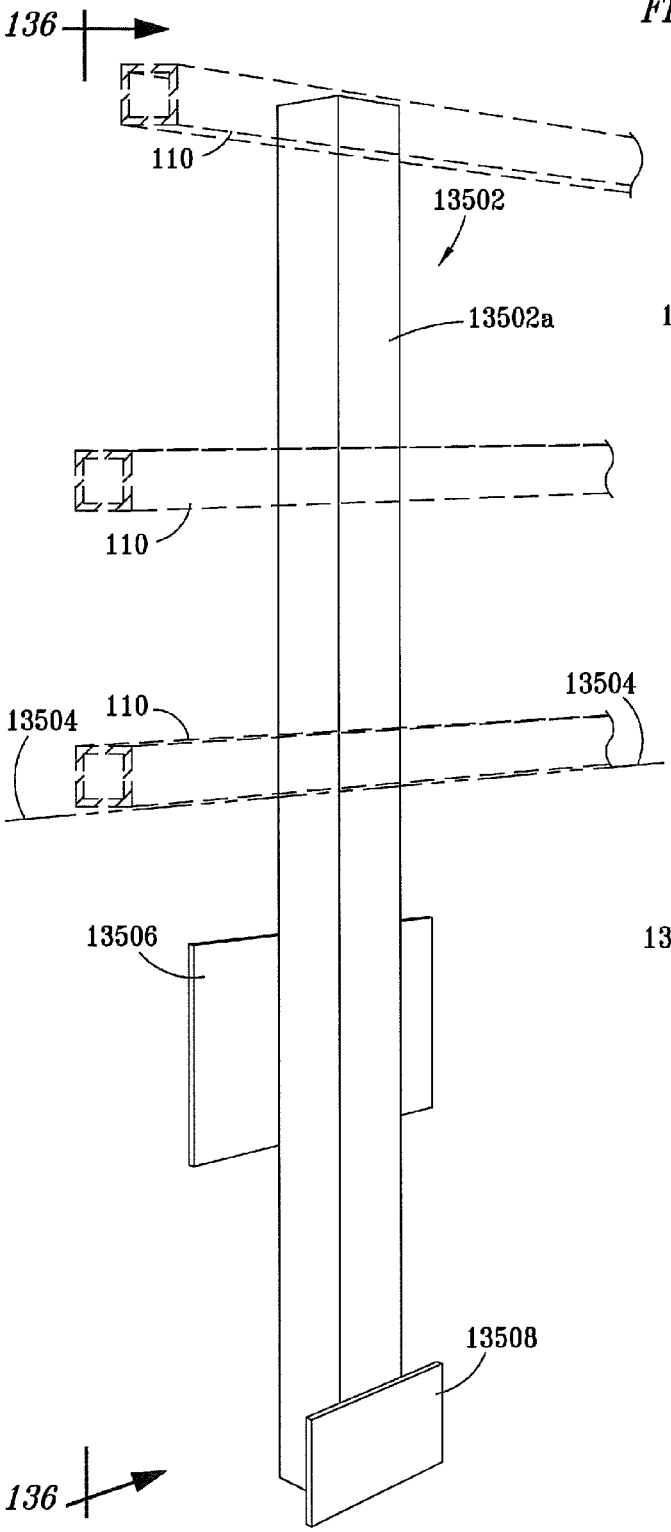
FIG. 135 presents a perspective view exemplifying an embodiment of a fence post embodying features of the present invention.
Figure 136:
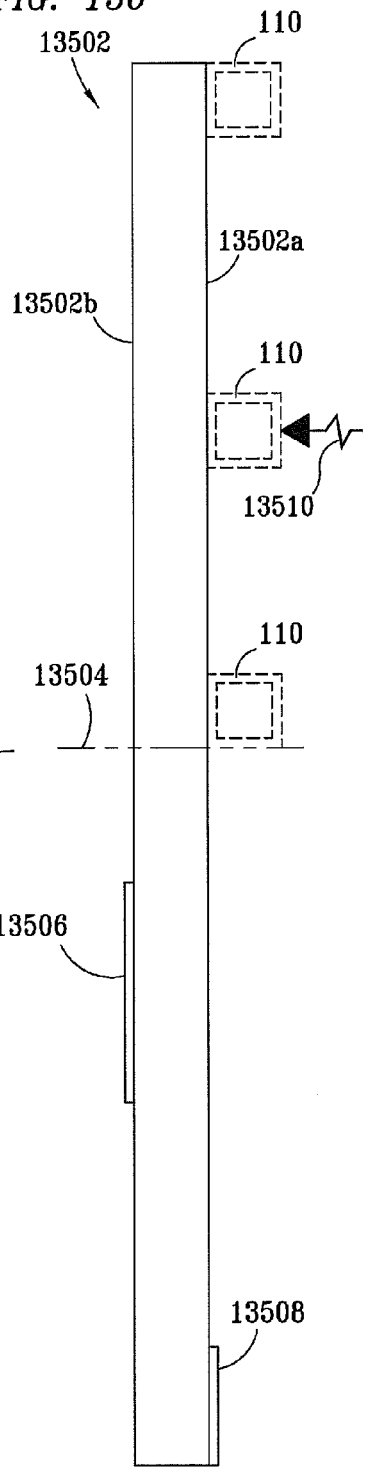
FIG. 136 presents an elevation view of the fence post of FIG. 135 taken along the line 136-136 of FIG. 135.

Referring to FIGS. 135 and 136 of the drawings, the reference numeral 13502 generally designates a bollard upright post embodying features of a post 102 of the present invention, a plurality of which posts may also be effective as a vehicular barrier. The post 13502 defines a first side 13512*a* as a side on which unwanted intrusion is anticipated, in a direction indicated by an arrow 13510, the prevention of which intrusion is desired, and a second side 13512*b* (FIG. 136), opposing the first side. The post 13512 preferably includes a lower fin, or plate, 13508 appended to the first side 13502*a* of the post at a lower end thereof, and an upper fin, or plate, 13506 appended to the second side 13502*b* of the post, above the lower plate 106, but preferably just below ground level, designated by the reference numeral 13504, when the post is embedded in earth. Alternatively, the post 13502 may be fabricated utilizing but a single plate, preferably the upper plate 13506 appended to the second side 13502*b* of the post. In a still further alternative embodiment, either or both the lower plate 13508 and/or the upper plate 13506 may extend from proximate the lower end of the post 13502 to and/or beyond proximate ground level 13504. At least two, and preferably three, rails, such as those described above with respect to FIGS. 5, 6, and 53-60, designated collectively herein by the reference numeral 110, are secured to (e.g., by way of brackets, welding, or the like, discussed above) and extend across the first side 13502*a* of the post 102 at heights suitable for securing union strips thereto. Union strips, such as described above with respect to FIGS. 7, 21, 2, 61-64, and 121-129 (not shown in FIGS. 135-136), are preferably secured to the rails 110, and infill material 114 is preferably disposed between the union strips, to thereby form a fence in accordance with principles of the present invention.

The post 13502 is sized as suitable for preventing intrusion that may be anticipated. For example, if vehicular intrusion is anticipated, the post 13502 is preferably manufactured from tubular steel, preferably defined by a square or rectangular cross-section having a width of about 8-12 inches per side, and a wall thickness of about 0.375 inches, though other sizes and thicknesses may be employed as desired. The length of the post 13502 may be any desired length, such as 10-20 feet, or preferably about 15 feet in length, wherein about half to about two-thirds of the length is preferably embedded in earth, that is, beneath the ground 13504. The lower plate 13508 preferably defines a square or rectangle having sides of about 1 to 3 feet in length. The upper plate 13506 is preferably larger than the lower plate 13508, preferably defining a square or rectangle having sides of about 2 to 5 feet in length. The plates 13506 and 13508 are preferably manufactured from steel plate of 0.25 to 0.50 inches in thickness, and preferably about 0.375 inches in thickness. The upper plate 13506 is positioned, and preferably welded, on a side of the post 13502 opposite the side on which the lower plate 13508 and the rails 110 are positioned and welded thereto. The rails 110 are preferably manufactured from tubular steel, and defined by a square or rectangular cross-section, each of which sides is preferably about 3 to 6 inches in length, preferably having a wall thickness of about 0.375 inches, though alternate materials, sizes, and thicknesses may be employed depending upon the strength desired. If a plurality of posts 13502 are to be effective as a vehicular barrier, then one rail should preferably be about two to three feet above the ground 13504.

In installation, the posts 13502 are preferably driven into the ground 13504 to a desired depth, such as 5 to 10 feet, or to any other depth desired, and so that the lower plate 108 faces in the direction 13510 from which intrusion (e.g., by vehicles) is anticipated and desired to be prevented. The posts 13502 are preferably spaced apart by about 2-10 feet apart, and more specifically, by about 4 feet apart. At least two rails 110 are then positioned on the side 13502*a* of the post 13502 and secured thereto, e.g., by being fastened or welded thereto. Alternatively, if only a vehicular barrier is desired, then only a single rail 110 need be positioned on the side 13502*a* of the post 13502 and secured thereto.

Figure 137:
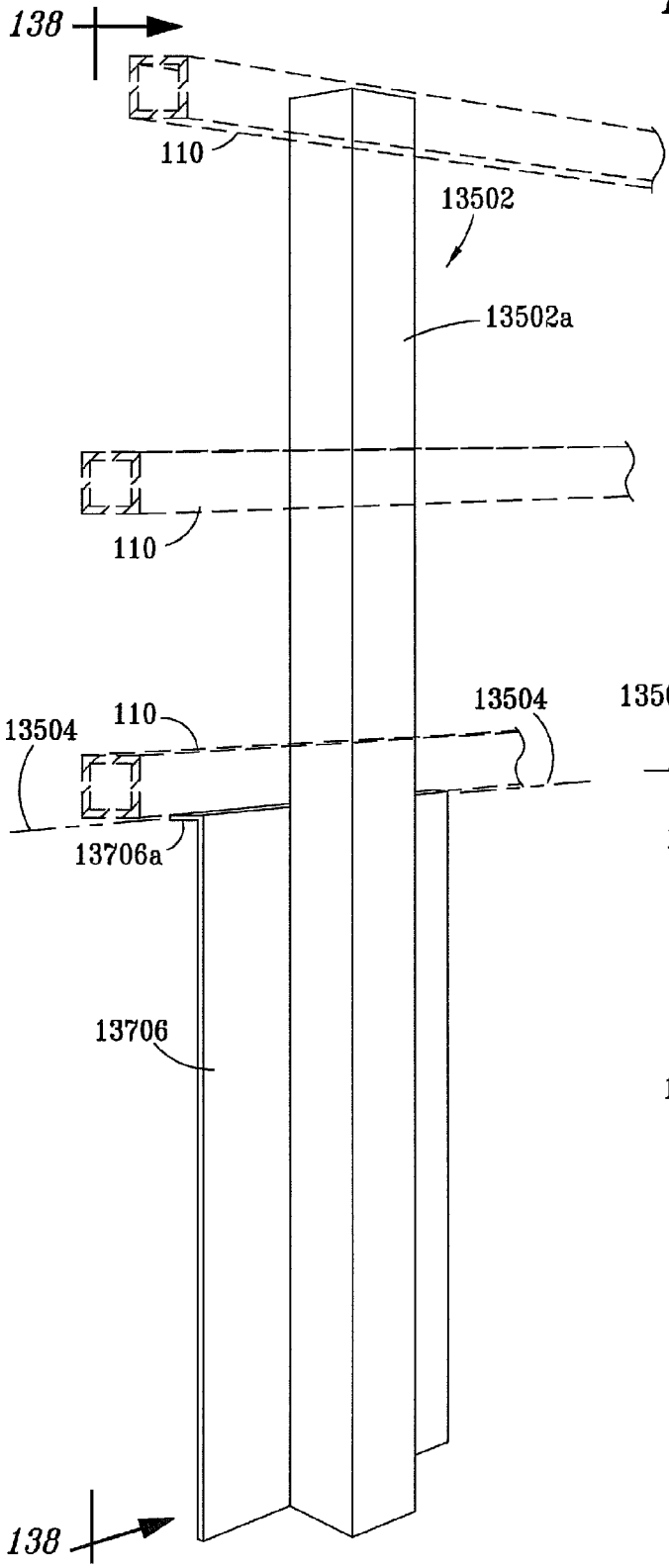
FIG. 137 presents a perspective view exemplifying an alternate embodiment of the fence post of FIGS. 135-136.
Figure 138:
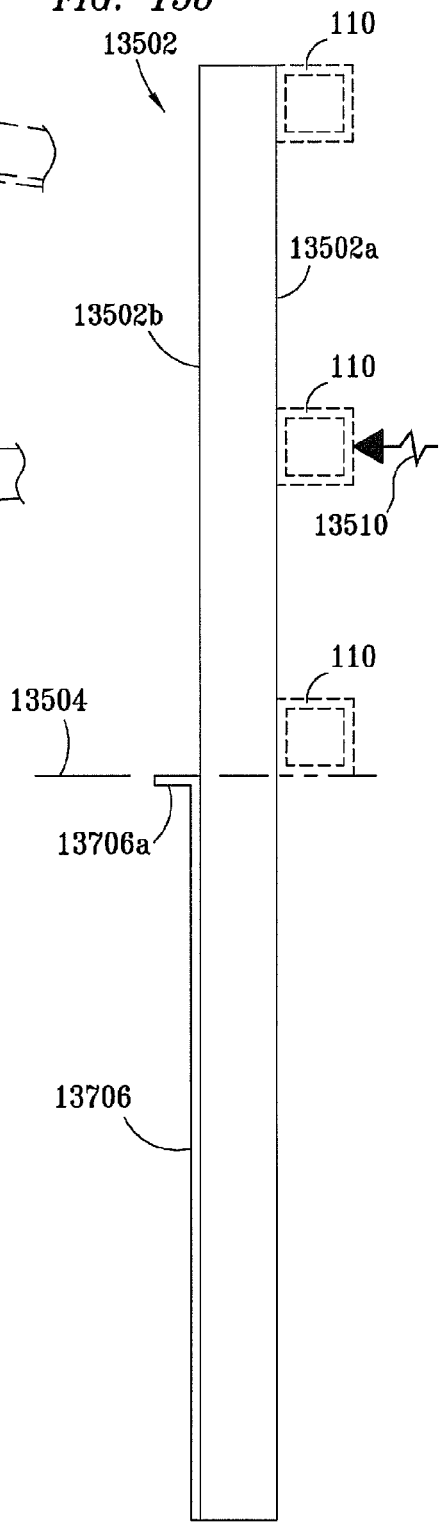
FIG. 138 presents an elevation view of the fence post of FIG. 137 taken along the line 138-138 of FIG. 135.

Referring to FIGS. 137 and 138 of the drawings, the reference numeral 13702 generally designates a bollard upright post embodying features of a post 102 of the present invention, a plurality of which posts may also be effective as a vehicular barrier. The post 13702 is similar to the post 13502, but for comprising a plate 13706 in place of the plates 13506 and 13508. The plate 13706 preferably includes a lip 13706*a* at an upper end of the plate which extends away from the post 13502. As viewed in FIGS. 137 and 138, the plate 13706 is preferably positioned on the side 13502*b* of the post opposing the rails 110 on the side 13502*a*, and extends approximately from a lower end of the post 13502 to ground level 13504. In installation, the posts 13502 are preferably driven into the ground 13504 until the top of the plate lip 13706*a* is about even with ground level, and so that the lower plate 108 faces in the direction 13510 from which intrusion (e.g., by vehicles) is anticipated and desired to be prevented. The posts 13502 are preferably spaced apart by about 2-10 feet apart, and more specifically, by about 4 feet apart. At least two rails 110 are then positioned on the side 13502*a* of the post 13502 and secured thereto, e.g., by being fastened or welded thereto. Alternatively, if only a vehicular barrier is desired, then only a single rail 110 need be positioned on the side 13502*a* of the post 13502 and secured thereto.

Figure 139:
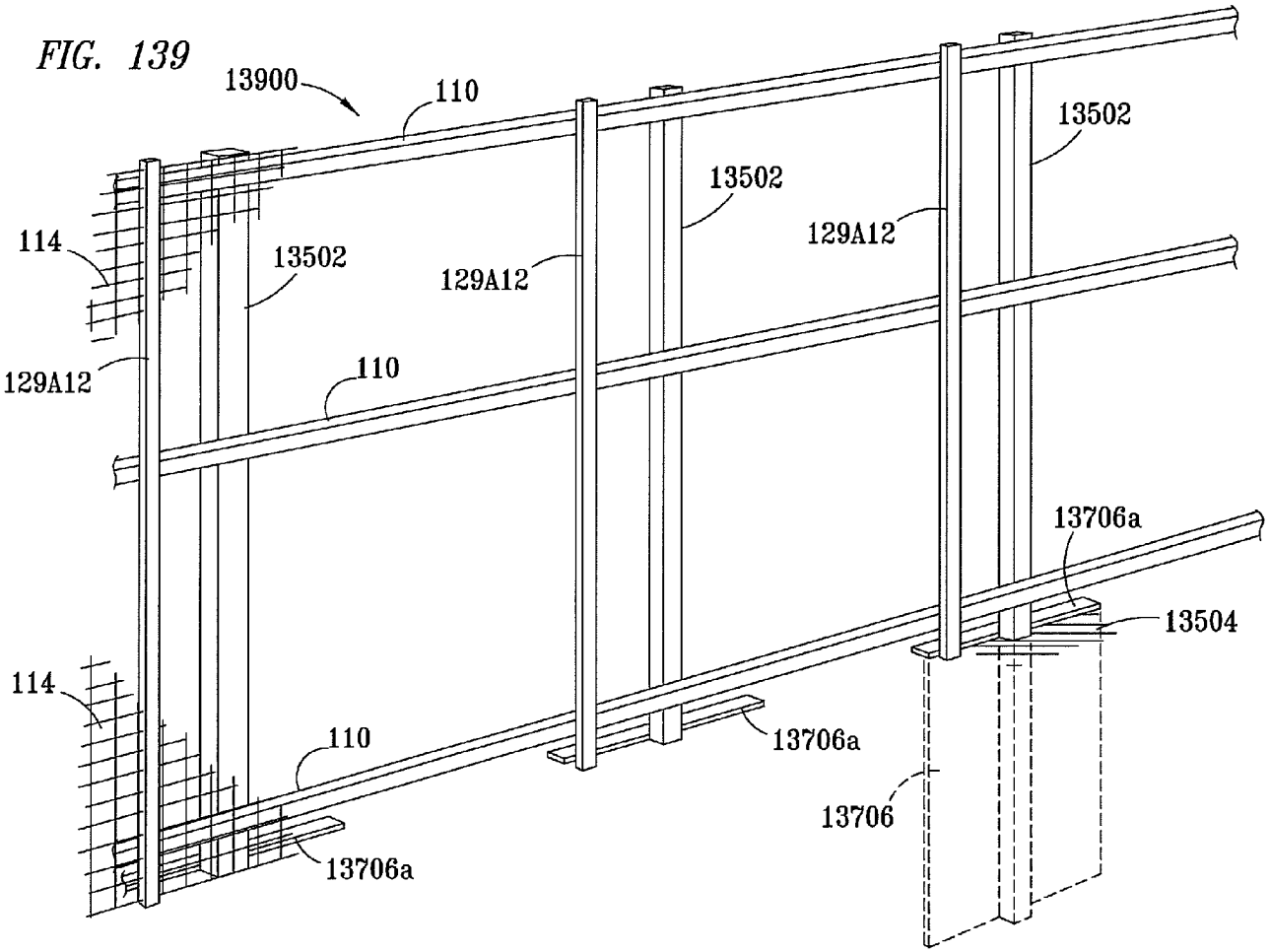
FIG. 139 presents a perspective view exemplifying the installation of a fence system embodying features of the present invention.

FIG. 139 exemplifies a portion of a complete fence system 13900 embodying principles of the present invention. As shown, posts 13706 are embedded in the ground 13504 up to the top of the lips 13706*a*. Rails 114 extend across the posts 13706, and union strips, represented by the union strip 129A12, though any union strips described hereinabove may be utilized, extend across the rails 114 in a manner as describe hereinabove. Infill material, such as welded wire mesh, 114 is then extended between the union strips 129A12, and preferably secured thereto utilizing means as described hereinabove, such as welding or straps 13002 and 13006.

Figure 140:
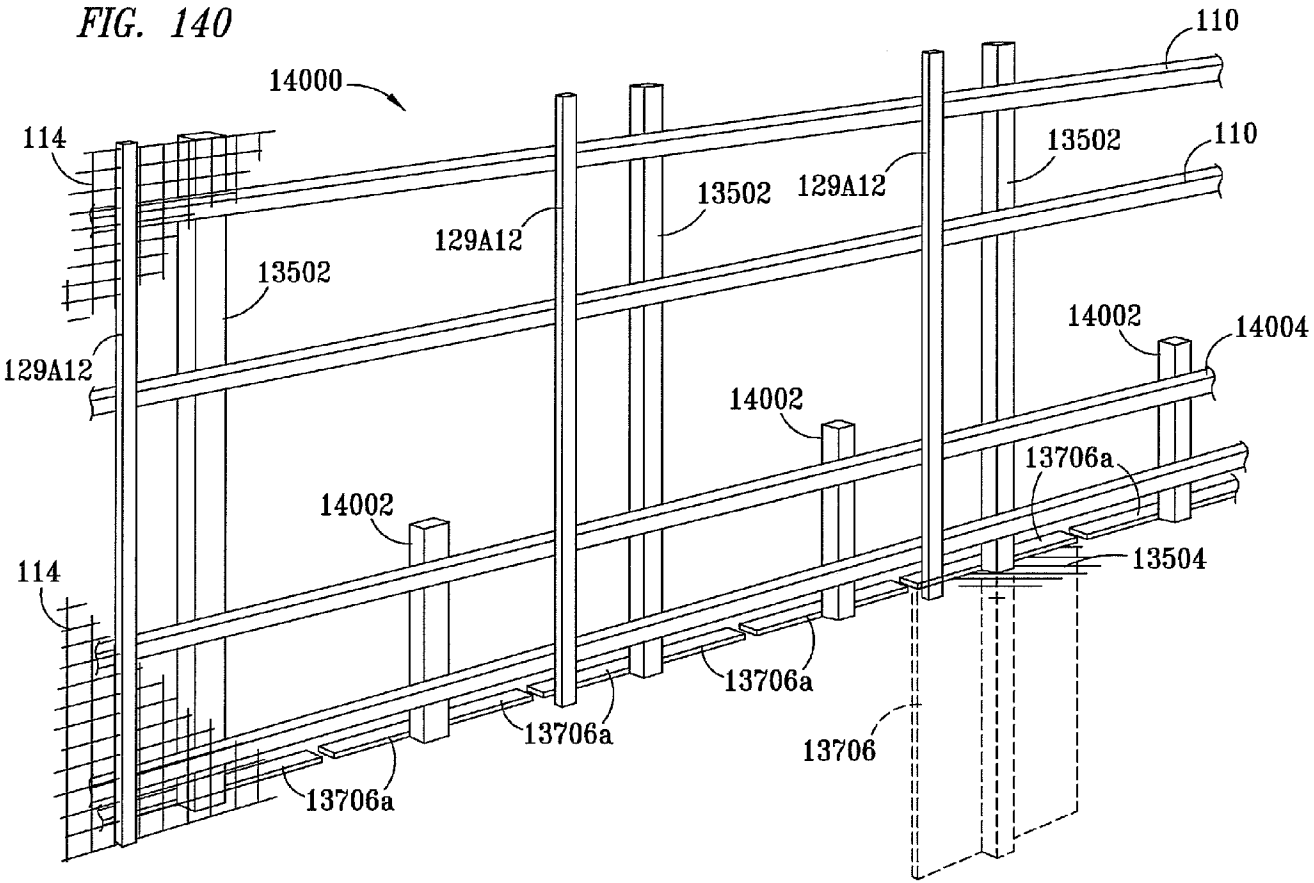
FIG. 140 presents a perspective view exemplifying the fence system of FIG. 139 further provided with a crash beam.

FIG. 140 exemplifies a fence system 14000 similar to the fence system 13900 of FIG. 139, but for further providing a crash beam. To that end, posts 14002, similar to the posts 13502, but for having a height sufficient to resist vehicular intrusion, thus typically being shorter than the posts 13502, are interposed between the posts 13502 and embedded in the ground 13504. A crash beam 14004 is then extended across the posts 13502 and 14002. The crash beam 14004 is preferably configured and fabricated from heavier gauge material than the rails 110 so as to be stronger than the rails 110 and to have sufficient strength to resist a crash impact from a fast-moving vehicle of substantial weight. The fence system 14000 is otherwise similar to the fence system 13900.

By the use of the present invention, a high security fence may be erected, or retrofitted onto regularly-spaced or irregularly-spaced posts of a previous fence, using standard sheeted infill material secured to posts that are spaced apart at non-standard intervals, or attached to a wall. The posts, furthermore, may be round or square, and of virtually any size, as exemplified in FIGS. 53-60. Still further, sheeted infill material does not require fabrication of a frame for the mesh panels and, therefore, no post-fabrication galvanization, is required. Still further, the union strips 112 contain rough cutting edges that may exist with infill material 114. The fence of the present invention may also be aesthetically appealing.

It is understood that the present invention may take many forms and embodiments. Accordingly, several variations may be made in the foregoing without departing from the spirit or the scope of the invention. For example, electrical current may be run through the fence system 100, or a portion thereof, to discourage individuals from touching the fence.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. A fence comprising:

two or more substantially vertical posts supporting one or more substantially horizontal rails secured across and against said posts;

at least first and second infill materials, each of said at least first and second infill materials defining a respective edge;

at least one substantially vertical union strip secured across and against said one or more horizontal rails, said at least one union strip having an H-shaped cross-section defining two oppositely facing channels, each channel receiving one of said respective edges therein;

first and second straps sandwiching said first infill material and one of said one or more horizontal rails between said first and second straps, each of said first and second straps having first and second holes defined there through; and first and second fasteners, said first fastener extending through said first holes and said first infill material, said second fastener extending through said second holes and said first infill material, said rail extending between said fasteners, thereby securing said edge of first infill material within a first one of said two oppositely facing channels.

2. The fence of claim 1 wherein said at least first and second infill materials comprise welded wire sheet.

3. The fence of claim 1 wherein said at least one union strip further comprises a center channel defined between said two oppositely facing channels, at least one hole defined through said center channel, and a cover strip securable over said center channel.

4. The fence of claim 1 wherein each of said two oppositely facing channels comprises at least one flange configured for inhibiting removal of said at least one edge of each of said at least first and second infill materials from said two oppositely facing channels.

5. The fence of claim 1 further comprising:

at least one first strap for seating on a first side of a first one of said at least first and second infill materials, extending across said at least one union strip, and seating on a first side of a second one of said at least first and second infill materials, said at least one first strap defining at least two first holes, each of said at least two said first holes being configured for receiving a fastener;

at least one second strap for seating on a second side of said first one of said at least first and second infill materials, extending across said at least one union strip, and seating on a second side of said second one of said at least first and second infill materials, said at least one second strap defining at least two second holes, each of said at least two second holes being configured for receiving a fastener; and at least two fasteners for extension through each of said at least two first holes of said first strap, and through each of said at least two second holes of said second strap, for securing said at least first and second infill materials to said at least one union strip.

6. The fence of claim 1 wherein said two or more posts comprise:

at least one post defining a lower portion for being embedded in earth, and an upper portion for extending above ground level of the earth, wherein said at least one rail extends across said upper portion; and a plate appended to said lower portion of said post.

7. The fence of claim 1 wherein said two or more posts comprise:

at least one post defining a lower portion having a lower end for being embedded in earth, and an upper portion for extending above ground level of the earth, and a first side across which said at least one rail extends, and a second side opposing said first side;

a lower plate appended to said first side of said lower portion of said post;

an upper plate appended to said second side of said lower portion of said post, said upper plate being positioned further from said lower end than said lower plate.

8. The fence of claim 1 wherein said at least one union strip is fabricated from sheet metal.

9. The fence of claim 1 wherein said at least one union strip includes at least a first union strip and a second union strip, and said system further comprises at least one substantially flat plate extending between said at least a first union strip and a second union strip, and at least one picket positioned on said at least one flat plate.

10. The fence of claim 1 further comprising an electrical power supply connected to said at least first and second infill materials for running current through said at least first and second infill materials.

11. The fence of claim 1 wherein said at least one union strip comprises at least two channels, and said at least one union strip further defines a concave radius interposed between said at least two channels.

12. The fence of claim 1 wherein:

said at least one union strip is fabricated from at least two elongated plates configured and secured together to define two channels directed in substantially opposing directions; and said at least first and second infill materials include at least one edge confined by one channel of said two channels of said at least one union strip.

13. The fence of claim 1 wherein:

said at least one union strip is fabricated from at least two substantially flat elongated plates; and each of said at least first and second infill materials include at least one edge portion interposed between said at least two plates of said at least one union strip.

14. The fence of claim 1 further comprising:

third and fourth straps sandwiching said second infill material and one of said one or more horizontal rails there between, each of said third and fourth straps having third and fourth holes defined there through; and third and fourth fasteners, said third fastener extending through said third holes and said second infill material, said fourth fastener extending through said fourth holes and said second infill material, said rail extending between said fasteners, thereby securing said edge of second infill material within a second one of said two oppositely facing channels.

15. The fence of claim 1, wherein:

said at least one vertical union strip further defines a center channel between said two oppositely facing channels, said center channel including two opposing walls and a center wall extending between said two opposing walls, each of said two opposing walls having at least one ratchet tooth, said center wall defining at least one of a hole or a notch for facilitating the drilling of a hole, said hole being configured for facilitating the passage there through of a fastener for engaging one of said one or more horizontal rails and securing said union strip to said one of said one or more horizontal rails; and said union strip further comprises a cover fitted over said center channel for precluding access to said channel, said cover including two projections configured for insertion in said center channel, each of said two projections including at least one ratchet tooth configured for matingly engaging said at least one ratchet tooth of a respective one of said two opposing walls for securing said cover over said center channel.

* * * * *